US011446535B1

(12) United States Patent
Iverson et al.

(10) Patent No.: US 11,446,535 B1
(45) Date of Patent: Sep. 20, 2022

(54) FOLDING EXERCISE RACK SYSTEM

(71) Applicant: PRx Performance, LLC, Fargo, ND (US)

(72) Inventors: Garrett A. Iverson, Fargo, ND (US); Jeremy K. Warzecka, Fargo, ND (US); Brian B. Brasch, Detroit Lakes, MN (US); Erik S. Hopperstad, Fargo, ND (US); Alexander M. Johnson, Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 0 days.

(21) Appl. No.: 17/519,148

(22) Filed: Nov. 4, 2021

(51) Int. Cl.

| | |
|---|---|
| ***A63B 21/062*** | (2006.01) |
| ***A63B 21/16*** | (2006.01) |
| ***A63B 21/00*** | (2006.01) |
| *A63B 1/00* | (2006.01) |

(52) U.S. Cl.
CPC ..... *A63B 21/0628* (2015.10); *A63B 21/169* (2015.10); *A63B 1/00* (2013.01); *A63B 21/00047* (2013.01); *A63B 2210/50* (2013.01)

(58) Field of Classification Search
CPC ..... A63B 21/0628; A63B 21/169; A63B 21/00047; A63B 2210/50; A63B 1/00
See application file for complete search history.

(56) References Cited

U.S. PATENT DOCUMENTS

| | | | |
|---|---|---|---|
| 332,989 | A | 12/1885 | Benedict |
| 618,990 | A | 2/1899 | Lubben |
| 1,104,505 | A | 7/1914 | Holworthy |
| 1,696,145 | A | 12/1928 | Wagoner |
| 2,219,219 | A | 10/1940 | Boger |
| 2,632,645 | A | 3/1953 | Barkschat |
| 2,855,200 | A | 10/1958 | Blickman |
| 3,414,262 | A | 12/1968 | Lavergne |

(Continued)

FOREIGN PATENT DOCUMENTS

| | | | |
|---|---|---|---|
| CN | 103598759 | A | 2/2014 |
| DE | 4307632 | A1 | 9/1993 |

(Continued)

OTHER PUBLICATIONS

Rogue Fitness; a. A Folding Exercise rack with a pair of arms attaching the exercise rack to the wall (Year: 2020).*

(Continued)

*Primary Examiner* — Megan Anderson
(74) *Attorney, Agent, or Firm* — Neustel Law Offices

(57) ABSTRACT

A folding exercise rack system which may be both adjusted with respect to a wall and adjusted between a folded position for storage and an extended position for use. The folding exercise rack system generally includes an exercise rack that is both adjustable with respect to the wall and foldable between extended and retracted positions. The exercise rack generally includes a pair of inner support members which are adjustably connected to the wall, and a pair of outer support members which are adjustable between an extended position and a retracted (e.g., folded) position. In the extended position, the outer support members are distally spaced away from the inner support members and wall. In the retracted position, the outer support members are positioned adjacent to the wall.

16 Claims, 48 Drawing Sheets

(56) References Cited

U.S. PATENT DOCUMENTS 3,614,097 A 10/1971 Blickman
3,874,657 A 4/1975 Niebojewski
3,918,710 A 11/1975 Niebojewski
4,249,726 A 2/1981 Faust
4,257,590 A 3/1981 Sullivan
4,262,901 A 4/1981 Faust
4,286,782 A 9/1981 Fuhrhop
4,300,761 A 11/1981 Howard
4,306,715 A 12/1981 Sutherland
4,358,109 A 11/1982 Schrems
4,368,884 A 1/1983 Colvin
4,369,966 A 1/1983 Silberman
4,396,191 A 8/1983 Metler
4,431,181 A 2/1984 Baswell
4,527,797 A 7/1985 Slade, Jr.
4,603,855 A 8/1986 Sebelle
4,615,524 A 10/1986 Sutherland
4,621,809 A 11/1986 Pearl
4,635,934 A 1/1987 Roethke
4,637,608 A 1/1987 Owens
4,645,196 A 2/1987 Christie
4,650,186 A 3/1987 McCreery
4,729,561 A 3/1988 Desjardins
4,757,998 A 7/1988 Landin
4,759,539 A 7/1988 Nieppola
4,765,616 A 8/1988 Wolff
4,773,642 A 9/1988 Cruz
4,781,374 A 11/1988 Lederman
4,795,149 A 1/1989 Pearson
4,804,179 A 2/1989 Murphy
4,826,153 A 5/1989 Schalip
4,842,270 A 6/1989 Lange
4,844,448 A 7/1989 Niznik
4,861,024 A 8/1989 Lee
4,861,025 A 8/1989 Rockwell
4,898,381 A 2/1990 Gordon
4,907,798 A 3/1990 Burchatz
4,915,377 A 4/1990 Malnke
4,919,419 A 4/1990 Houston
4,927,135 A 5/1990 Nieppola
4,928,961 A 5/1990 Madden
4,934,693 A 6/1990 Santoro
4,936,572 A 6/1990 Desiderio
4,955,604 A 9/1990 Pogue
4,958,833 A 9/1990 Stater
4,960,277 A 10/1990 LaRossa
4,974,837 A 12/1990 Someya
4,976,428 A 12/1990 Ghazi
5,011,141 A 4/1991 Towley, III
5,046,722 A 9/1991 Antoon
5,082,259 A 1/1992 Gonzalez
5,082,260 A 1/1992 Dinelli
5,098,093 A 3/1992 Dupre
5,098,361 A 3/1992 Danylieko
5,141,480 A 8/1992 Lennox
5,151,072 A 9/1992 Cone
5,184,992 A 2/1993 Banks
5,242,345 A 9/1993 Mitchell
5,249,858 A 10/1993 Nusser
5,281,193 A 1/1994 Colbo, Jr.
5,306,220 A 4/1994 Kearney
5,328,428 A 7/1994 Huang
5,346,448 A 9/1994 Sollo
5,350,346 A 9/1994 Martinez
D358,623 S 5/1995 Macasieb
5,456,644 A 10/1995 Hecox
5,466,204 A 11/1995 Nearing
5,509,876 A 4/1996 Reyes
5,551,936 A 9/1996 Parisi
5,669,859 A 9/1997 Liggett
5,688,216 A 11/1997 Mauriello
D390,287 S 2/1998 Hsieh
5,755,823 A 5/1998 Cleary
5,779,601 A 7/1998 Ish, III
5,813,951 A 9/1998 Einsig
D404,443 S 1/1999 Doyle
5,882,283 A 3/1999 Stevens
5,921,897 A 7/1999 Stevens
5,964,684 A 10/1999 Sokol
5,971,897 A 10/1999 Olson
6,027,433 A 2/2000 Flynn
6,073,624 A 6/2000 Laurent
6,248,048 B1 6/2001 Zuckerman
6,299,568 B1 10/2001 Prok
6,328,679 B1 12/2001 Croft
6,443,877 B1 9/2002 Hoecht
6,579,213 B1 6/2003 Webber
6,685,601 B1 2/2004 Knapp
7,070,546 B1 7/2006 Grasso
7,338,416 B2 3/2008 Smith
7,374,516 B2 5/2008 Lundquist
7,393,309 B2 7/2008 Webber
7,455,621 B1 11/2008 Anthony
7,488,277 B1 2/2009 Knapp
7,549,950 B1 6/2009 Lundquist
7,575,538 B1 8/2009 Clark
7,635,322 B2 12/2009 Parrilla
7,666,118 B1 2/2010 Anthony
7,699,756 B2 4/2010 Piane, Jr.
8,047,972 B1 1/2011 Dean
8,075,454 B2 12/2011 Piggins
8,231,509 B2 7/2012 Lundquist
8,491,449 B2 7/2013 Rogers
8,506,459 B2 8/2013 Cassidy
8,517,900 B1 8/2013 Britt
8,651,293 B2 2/2014 Boyer
8,727,953 B2 5/2014 Drechsler
9,192,799 B2 11/2015 Alenaddaf
9,333,387 B2 5/2016 Hopperstad
9,409,048 B1 8/2016 Hopperstad
9,498,670 B1 11/2016 Hopperstad
9,675,510 B2 6/2017 Moerth-Cross
9,713,745 B2 7/2017 Rogers
10,195,479 B2 2/2019 Brasch
10,226,661 B2 3/2019 Henniger
10,779,645 B2 9/2020 Siaperas
10,953,301 B2 3/2021 Brasch
D942,561 S * 2/2022 Dunahay ..... D21/686
2004/0092369 A1 5/2004 Slawinski
2008/0276551 A1 11/2008 Thomas
2009/0017997 A1 1/2009 Piggins
2009/0143203 A1 6/2009 Knapp
2009/0289535 A1 11/2009 Weber
2010/0048368 A1 2/2010 Donofrio
2011/0195822 A1 8/2011 Donofrio
2012/0289384 A1 11/2012 Staten
2013/0257242 A1 10/2013 Bunch
2014/0018215 A1 1/2014 Donofrio
2014/0031182 A1 1/2014 Donofrio
2014/0243174 A1 8/2014 Alenaddaf
2014/0339184 A1 11/2014 Couch
2015/0148197 A1 5/2015 Lentz
2015/0264823 A1 9/2015 Shirley
2015/0290488 A1 10/2015 Hopperstad
2015/0352395 A1 12/2015 Gregory
2016/0016033 A1 1/2016 Schrag
2016/0074698 A1 3/2016 Figueroa
2016/0096062 A1 4/2016 Moerth-Cross
2017/0065844 A1 3/2017 Hopperstad
2017/0146282 A1 3/2017 Dodge
2017/0197109 A1 7/2017 Cole
2017/0239512 A1 8/2017 Brasch
2018/0178051 A1 6/2018 Shaw, Jr.
2018/0326250 A1 11/2018 Henniger
2019/0126088 A1 5/2019 Henniger
2019/0166993 A1 6/2019 Siaperas
2019/0240525 A1 8/2019 Leipheimer
2020/0131825 A1 4/2020 Hirtsiefer
2020/0197737 A1 6/2020 Kistner
2020/0384337 A1 12/2020 Brasch

(56) References Cited

U.S. PATENT DOCUMENTS

FOREIGN PATENT DOCUMENTS

| | | | |
|---|---|---|---|
| GB | 2076299 | A | 12/1981 |
| WO | 2009003280 | A1 | 1/2009 |
| WO | 2019090121 | A1 | 5/2019 |

OTHER PUBLICATIONS https://www.roguefitness.com/monster-lite-rml-390-fullw-fold-back-wall-mount-power-rack; Rogue Fitness Monster Lite RML-390FULLW Fold Back Wall Mount Power Rack Webpage; Oct. 21, 2021.
https://www.youtube.com/watch?v=f6bPYbS_2Fw; YouTube Video Equipment Demo Rogue Dirty South Bar; Apr. 25, 2012.
https://www.roguefitness.com/rogue-r-3w-fold-back-wall-mount-rack; Rogue Fitness R-3W Fold Back Wall Mount Rack Website Page; Jan. 1, 2014.
2717 Equipment Facebook Posts—W-1 Pull Up and Rack; Nov. 8, 2012.
2717 Equipment Facebook Posts—Wall Mounted Pull Up and Squat Rack; Mar. 27, 2012.
https://www.youtube.com/watch?v=koAzH91o474; YouTube Video Matt Chan Talks the Dirty South Bar; Dec. 20, 2012.
Pictures of PRX Performance Pull-Up Bar on Central Rig Display at Granite Games; Oct. 5, 2013.
http://board.crossfit.com/showthread.php?t=86058; Pictures from Website for Crossfit Message Board; Feb. 8, 2014.
http://board.crossfit.com/showthread.php?t=86058; Website for Crossfit Message Board; Feb. 8, 2014.
http://www.roguefitness.com/rogue-4-monster-lite-wall-mount, Webpage from Rogue Fitness; Jan. 1, 2014.
http://www.roguefitness.com:80/x-43m-multi-grip-crossmember.php; Rogue Fitness X-43 Multi-Grip Crossmember Website Page; Jan. 23, 2013.
http://www.roguefitness.com:80/w4-garage-gym.php; Rogue Fitness W-4 Garage Gym Website Page; Jan. 23, 2013.
http://www.roguefitness.com:80/rogue-sm-2-monster-squat-stand.php; Rogue Fitness SM-2 Monster Squat Stand Website Page; Jan. 27, 2013.
http://www.roguefitness.com:80/rogue-r-3-power-rack.php; Rogue Fitness R3 Power Rack Website Page; Jan. 11, 2013.
http://www.roguefitness.com:80/bodyweight-gymnastics/rpg-pullup-system.php; Rogue Fitness Pull Up & RPG Systems Website Page; Jan. 23, 2013.
http://www.roguefitness.com:80/dirty-south-bar.php; Rogue Fitness Dirty South Bar Website Page; Jan. 23, 2013.
PCT International Search Report and Written Opinion for PCT/US2021/036713; dated Sep. 1, 2021.

* cited by examiner

FOLDING EXERCISE RACK SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to exercise racks which may be both adjusted with respect to a wall and adjusted between a folded position for storage and an extended position for use.

More and more people are looking to stay fit, particularly during times of quarantine and self-isolation. While exercise studios have become ubiquitous in modern life, constraints such as time, distance of travel, and health crises have caused more and more people to seek out exercise equipment to use in their own homes.

Home exercise equipment is widely available, including various exercise racks, exercise bikes, rowing machines, reformers, and the like. However, such exercise equipment can require a lot of space and leave various structures which can create a mess and heighten the risk of injury, such as from a child tripping over weights or an exercise rack. Additionally, such exercise equipment can create a nuisance when not in use by taking up valuable space inside a home gym. For example, an exercise rack installed in a garage can leave little room for a vehicle or storage space.

While such exercise equipment is suitable for performing exercises, it would be far more preferable to utilize exercise equipment which may be easily folded into a compact state to allow for maximum use of a space when the exercise equipment is not in use.

SUMMARY

Some of the various embodiments of the present disclosure relate to a folding exercise rack system which includes an exercise rack that is both adjustable with respect to a wall and foldable between extended and retracted (e.g., folded, collapsed) positions. The exercise rack generally includes a pair of inner support members which are connected to a pair of outer support members by upper and lower arms. The pair of inner support members may be adjustable with respect to the wall between an extended position and a retracted position. The pair of outer support members may be adjustable between an extended position and a retracted (e.g., folded, collapsed) position. In the extended position, the outer support members are distally spaced away from the inner support members and wall. In the retracted position, the outer support members are positioned adjacent to the wall.

In a first exemplary embodiment, the exercise rack is adjustably connected to the wall by one or more brackets such that the exercise rack may be adjusted between an extended position in which the inner support members are distally spaced away from the wall and a retracted position in which the inner support members are positioned adjacent to the wall. The exercise rack is also adjustable between extended and retracted (e.g., folded, collapsed) positions. In the extended position, the outer support members are distally spaced away from the wall. In the retracted position, the outer support members are collapsed or folded inwardly to be adjacent to the wall.

In a second exemplary embodiment, the exercise rack is fixed in position on the wall but is collapsible or foldable in on itself. The exercise rack may thus be adjusted between an extended position and a retracted (e.g., folded, collapsed) position. Linkages which are connected to the inner support members are pivotably connected to corresponding hinges that are secured to the wall. The inner support members and interconnected frames may thus be pivoted inwardly towards the wall into the retracted position, or outwardly away from the wall into the extended position.

In a third exemplary embodiment, the exercise rack is adjustably connected to the wall by one or more brackets such that the exercise rack may be adjusted between an extended position in which the inner support members are distally spaced away from the wall and a retracted position in which the inner support members are positioned adjacent to the wall. The exercise rack is also adjustable between extended and retracted (e.g., folded, collapsed) positions. In the extended position, the outer support members are distally spaced away from the wall. In the retracted position, the outer support members are collapsed or folded inwardly to be adjacent to the wall.

In a fourth exemplary embodiment, the exercise rack is adjustably connected to the wall by a plurality of scissor connectors such that the exercise rack may be adjusted between an extended position in which the inner support members are distally spaced away from the wall and a retracted position in which the inner support members are positioned adjacent to the wall. The exercise rack is also adjustable between extended and retracted (e.g., folded, collapsed) positions in the same manner as the third exemplary embodiment.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
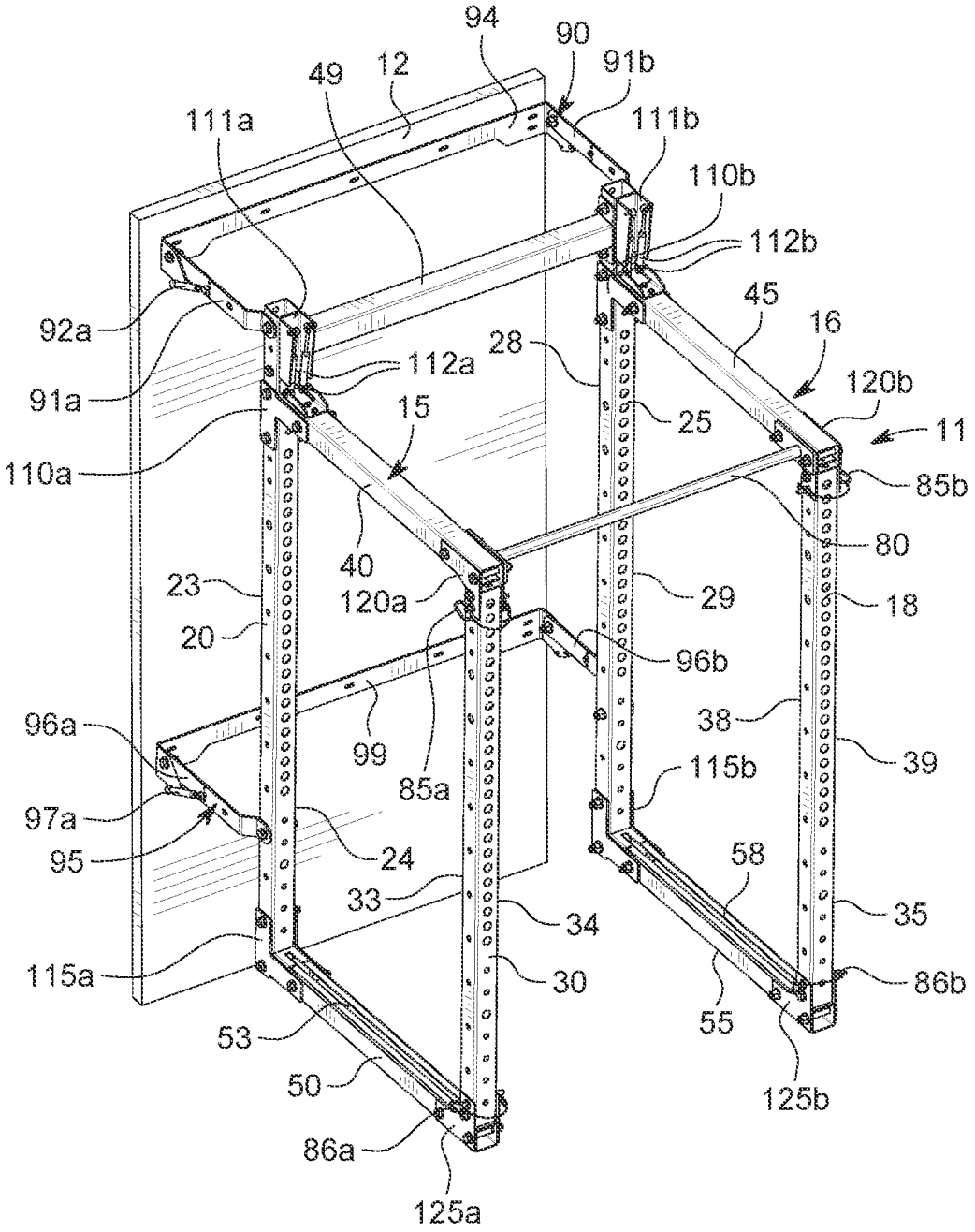
FIG. 1 is a perspective view of a folding exercise rack system in an extended position in accordance with a first exemplary embodiment.
Figure 2:
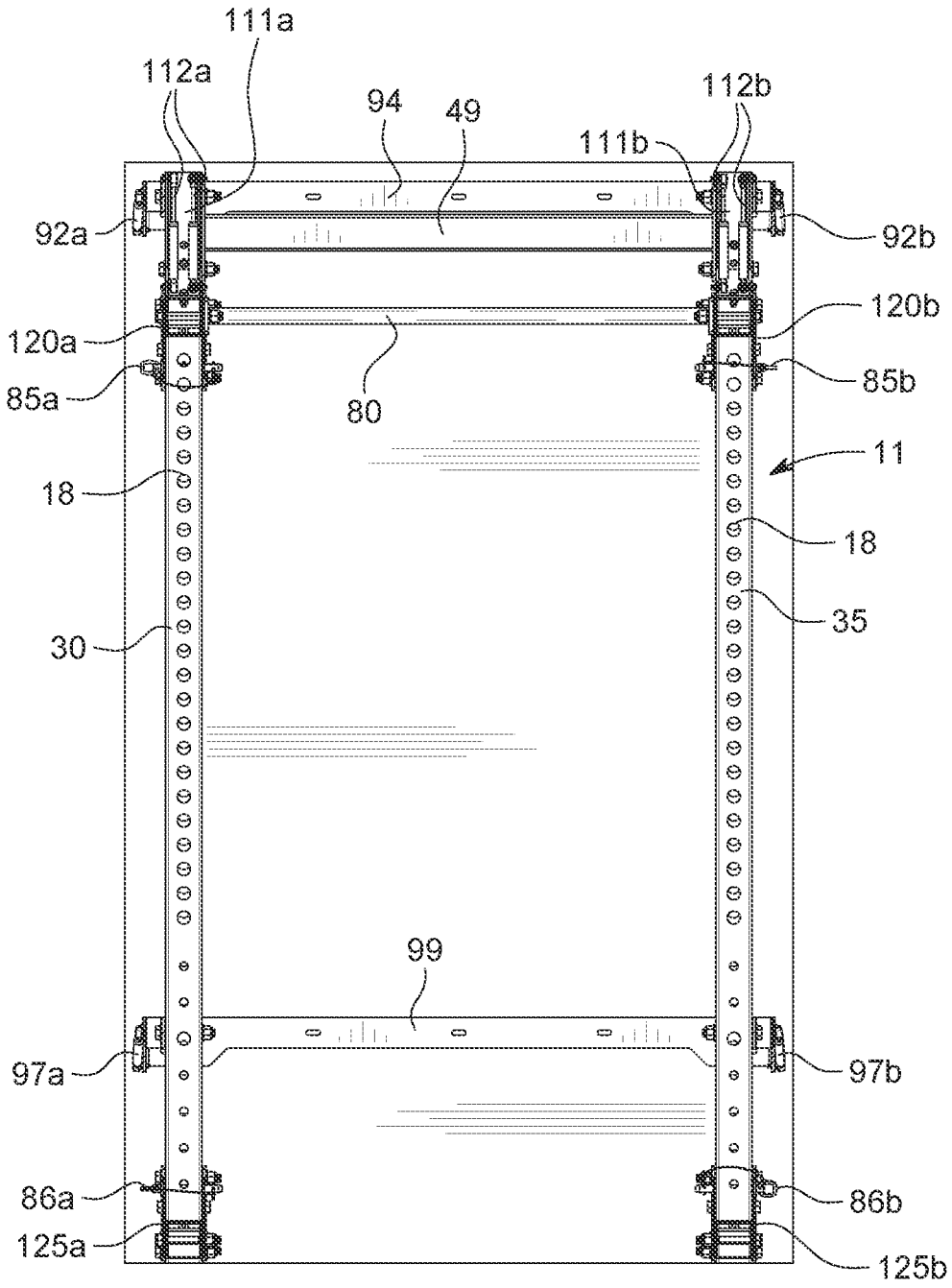
FIG. 2 is a front view of a folding exercise rack system in an extended position in accordance with a first exemplary embodiment.

Some of the various embodiments of the present disclosure relate to a foldable exercise rack system that can be collapsed or folded in on itself into a retracted position. In some of the embodiments, an exercise rack 11 of the foldable exercise rack system may additionally be adjustable with respect to a wall 12.

Each of the exemplary embodiments generally includes an exercise rack 11 comprising a first frame 15 and a second frame 16. The first frame 15 generally includes a first inner support member 20, a first outer support member 30, and a pair of first arms 40, 50 connected between the first inner and outer support members 20, 30. The second frame 16 generally includes a second inner support member 25, a second outer support member 35, and a pair of second arms 45, 55 connected between the second inner and outer support members 25, 35. In each of the exemplary embodiments, the first and second frames 15, 16 may be pivoted inwardly into a retracted (e.g., collapsed, folded) position and may be pivoted outwardly into an extended position.

In the first exemplary embodiment shown in FIGS. 1-12, a first upper arm 40 is pivotably connected at its first end 41 to the first inner support member 20, a first lower arm 50 is pivotably connected at its first end 51 to the first inner support member 20 below the first upper arm 40, a second upper arm 45 is pivotably connected at its first end 46 to the second inner support member 25, and a second lower arm 55 is pivotably connected at its first end 56 to the second inner support member 25 below the second upper arm 45.

A first outer support member 30 is slidably connected between the first upper and lower arms 40, 50 and a second outer support member 35 is slidably connected between the second upper and lower arms 45, 55. The outer support members 30, 35 may be slid inwardly towards their respective inner support members 20, 25 or outwardly away from their respective inner support members 20, 25. The upper arms 40, 45 may be pivoted inwardly and downwardly towards the first and second inner support members 20, 25 or pivoted outwardly and upwardly away from the first and second inner support members 20, 25. The lower arms 50, 55 may be pivoted inwardly and upwardly towards the first and second inner support members 20, 25 or pivoted outwardly and downwardly away from the first and second inner support members 20, 25.

In the second exemplary embodiment shown in FIGS. 13-24, each of the frames 15, 16 are pivotably connected to one or more of a plurality of hinges 71*a*, 71*b*, 76*a*, 76*b* by one or more of a plurality of linkages 70*a*, 70*b*, 75*a*, 75*b*. The first and second frames 15, 16 may be folded inwardly into a retracted (e.g., folded, collapsed) position or folded outwardly into an extended position, with the frames 15, 16 pivoting about the hinges 71*a*, 71*b*, 76*a*, 76*b* with respect to the wall 12.

In the third and fourth exemplary embodiments shown in FIGS. 25-36 and 37-48, each of the frames 15, 16 may be folded inwardly into a retracted (e.g., collapsed, folded) position or folded outwardly into an extended position. The first upper and lower arms 40, 50 are pivotably connected at their first ends 41, 51 to a hinge 71*a*, 76*a* and fixedly connected at their second ends 42, 52 to the first outer support member 30. The second upper and lower arms 45, 55 are pivotably connected at their first ends 46, 56 to a hinge 71*b*, 76*b* and fixedly connected at their second ends 47, 57 to the second outer support member 35.

The first, third, and fourth embodiments shown in FIGS. 1-12 and 25-48 may also be adjusted with respect to the wall 12. The first and third embodiments may be adjustably connected to the wall 12 by one or more brackets 90, 95 which pivot inwardly and upwardly towards the wall 12 or outwardly and downwardly away from the wall. The fourth embodiment may be adjustably connected to the wall 12 by a plurality of scissor connectors 101*a*, 101*b*, 106*a*, 106*b* which adjust inwardly towards the wall 12 or outwardly away from the wall 12.

B. Exercise Rack

As shown throughout the figures, the systems and methods described herein may each utilize a plurality of support members 20, 25, 30, 35 which, taken together, form an exercise rack 11 that is adapted to be extended away from a wall 12 for use, and folded/retracted towards the wall 12 for storage. While each of the embodiments described herein illustrate the usage of four discrete support members 20, 25, 30, 35, it should be appreciated that, in some embodiments, more or less support members 20, 25, 30, 35 may be utilized.

The figures illustrate embodiments which utilize a first inner support member 20, a second inner support member 25, a first outer support member 30, and a second outer support member 35. Each of the support members 20, 25, 30, 35 are illustrated as being distally-spaced with respect to each other. The distance between the respective support members 20, 25, 30, 35 may vary in different embodiments to suit different exercise rack 11 configurations and types of exercises.

Each of the support members 20, 25, 30, 35 may include various openings 18 on any of their respective sides. The exemplary figures illustrate the support members 20, 25, 30, 35 which include openings 18 on their respective outer sides 24, 29, 34, 39. It should be appreciated that such openings 18 may be included on any surface of any portion of the exercise rack 11, and thus should not be construed as limited to the locations shown in the exemplary figures. The openings 18 may be utilized to secure various other devices, such as exercise attachments and the like, to various portions of the exercise rack 11, such as but not limited to one or more of the support members 20, 25, 30, 35. The openings 18 may also be utilized to secure brackets, arms, or other structural components of an exercise rack 11 to the support members 20, 25, 30, 35 such as by use of fasteners as shown in the figures.

In the exemplary embodiments shown in the figures, it can be seen that a pair of inner support members 20, 25 are adapted to be secured to a wall 12. The manner by which the inner support members 20, 25 are secured to the wall 12 may vary in different embodiments. In some embodiments, the inner support members 20, 25 may be adjustably secured to the wall 12 such that the inner support members 20, 25 may be adjusted towards or away from the wall 12 and/or be raised or lowered. In other embodiments, the inner support members 20, 25 may be fixedly secured to the wall 12.

It should be appreciated that the inner support members 20, 25 may be directly or indirectly connected to the wall 12. In some embodiments, the inner support members 20, 25 may be directly secured to the wall 12, such as by use of various fasteners and the like. In other embodiments, the inner support members 20, 25 may be indirectly secured to the wall 12, such as by usage of wall mounts 60, 65 as shown in FIGS. 13-24, brackets 90, 95 such as shown in FIGS. 1-12 and 25-36, scissor connectors 101*a*, 101*b*, 106*a*, 106*b* such as shown in FIGS. 37-48, and various other hinges, brackets, or other devices.

As shown throughout the figures, the first inner support member 20 includes an upper end 21 and a lower end 22. An inner side 23 of the first inner support member 20 faces towards the wall 12 and an outer side 24 of the first inner support member 20 faces away from the wall 12. Similarly, the second inner support member 25 includes an upper end 26 and a lower end 27. An inner side 28 of the second inner support member 25 faces towards the wall 12 and an outer side 29 of the second support member 25 faces away from the wall 12.

The first and second inner support members 20, 25 will generally be aligned and parallel as shown in the figures. In some embodiments such as shown in FIGS. 13-24, the first and second inner support members 20, 25 may be interconnected so as to be adjusted together (e.g., such that adjustment of the first inner support member 20 causes similar adjustment in the second inner support member 25, and vice versa).

In other embodiments such as shown in FIGS. 1-12 and 25-48, the first and second inner support members 20, 25 may not be interconnected with each other. In such embodiments, each of the first and second inner support members 20, 25 may be independently adjusted (e.g., such that the first inner support member 20 may be adjusted independently of the second inner support member 25, and vice versa).

In the exemplary embodiments shown in FIGS. 1-12 and 25-48, it can be seen that the first and second inner support members 20, 25 may be interconnected with each other. For example, the embodiments shown in FIGS. 1-12 and 25-48 illustrate an inner cross bar 49 which is connected between the first and second inner support members 20, 25. While the figures illustrate that the inner cross bar 49 may be positioned at or near the respective upper ends 21, 26 of the inner support members 20, 25, it should be appreciated that the inner cross bar 49 may be positioned at various other locations on the inner support members 20, 25 (e.g., alternatively or additionally at or near the lower ends 22, 27 of the inner support members 20, 25).

As shown throughout the figures, a pair of outer support members 30, 35 may be interconnected with the pair of inner support members 20, 25 to form the exercise rack 11. In the exemplary embodiments shown throughout the figures, it can be seen that a first outer support member 30 is aligned with and distally positioned with respect to the first inner support member 20, and a second outer support member 35 is aligned with and distally positioned with respect to the second inner support member 35. When extended, the inner and outer support members 20, 25, 30, 35 may be positioned to form a square- or rectangular-shaped configuration when viewed from the top such as in the figures.

As shown in the figures, it can be seen that the first outer support member 30 may comprise an upper end 31, a lower end 32, an inner side 33, and an outer side 34. The inner side 33 of the first outer support member 30 faces towards the wall 12 and the outer side 34 of the first outer support member 30 faces away from the wall 12. Similarly, the second outer support member 35 may comprise an upper end 36, a lower end 37, an inner side 38, and an outer side 39. The inner side 38 of the second outer support member 35 faces towards the wall 12 and the outer side 39 of the second outer support member 35 faces away from the wall 12.

Each of the outer support members 30, 35 may be interconnected (e.g., indirectly connected) with a respective inner support member 20, 25. Thus, as shown in FIGS. 1-48, the first outer support member 30 may be interconnected with the first inner support member 20 and the second outer support member 35 may be interconnected with the second inner support member 25.

As best shown in FIGS. 3, 15, 27, and 39, it can be seen that a first upper arm 40 may be connected between the first inner support member 20 and the first outer support member 30. The first upper arm 40 may comprise an elongated member such as a rod or the like including a first end 41 and a second end 42. The first end 41 of the first upper arm 40 may be connected to the first inner support member 20 and the second end 42 of the first upper arm 40 may be connected to the first outer support member 30.

The positioning of the first upper arm 40 with respect to the first inner and outer support members 20, 30 may vary in different embodiments. In the exemplary embodiments shown in the figures, the first upper arm 40 is positioned at or near the respective upper ends 21, 31 of the first inner and outer support members 20, 30. In other embodiments, the first upper arm 40 may be positioned at various other locations along the length of the first inner and outer support members 20, 30.

The first upper arm 40 may be fixedly connected between the first inner and outer support members 20, 30 such as shown in FIGS. 13-24, or may be pivotably connected such as shown in FIGS. 1-12 and 25-48. The manner by which the first upper arm 40 is connected between the first and outer support members 20, 30 may vary in different embodiments. By way of example, brackets, fasteners, hinges, and various other types of connectors may be utilized in different embodiments as discussed in more detail below.

As best shown in FIGS. 1, 13, 25, and 37, it can be seen that a first lower arm 50 may be connected between the first inner support member 20 and the first outer support member 30 below the first upper arm 40. The first lower arm 50 may comprise an elongated member such as a rod or the like including a first end 51 and a second end 52. The first end 51 of the first lower arm 50 may be connected to the first inner support member 20 and the second end 52 of the first lower arm 50 may be connected to the first outer support member 30.

The positioning of the first lower arm 50 with respect to the first inner and outer support members 20, 30 may vary in different embodiments. In the exemplary embodiments shown in the figures, the first lower arm 50 is positioned at or near the respective lower ends 22, 32 of the first inner and outer support members 20, 30. In other embodiments, the first lower arm 50 may be positioned at various other locations along the length of the first inner and outer support members 20, 30.

The first lower arm 50 may be fixedly connected between the first inner and outer support members 20, 30 such as shown in FIGS. 13-24, or may be pivotably connected such as shown in FIGS. 1-12 and 25-48. The manner by which the first lower arm 50 is connected between the first and outer support members 20, 30 may vary in different embodiments.

By way of example, brackets, fasteners, hinges, and various other types of connectors may be utilized in different embodiments as discussed in more detail below.

As shown throughout the figures, it can be seen that a second upper arm 45 may be connected between the second inner support member 25 and the second outer support member 35. The second upper arm 45 may comprise an elongated member such as a rod or the like including a first end 46 and a second end 47. The first end 46 of the second upper arm 45 may be connected to the second inner support member 25 and the second end 47 of the second upper arm 45 may be connected to the second outer support member 35.

The positioning of the second upper arm 45 with respect to the second inner and outer support members 25, 35 may vary in different embodiments. In the exemplary embodiments shown in the figures, the second upper arm 45 is positioned at or near the respective upper ends 26, 36 of the second inner and outer support members 25, 35. In other embodiments, the second upper arm 45 may be positioned at various other locations along the length of the second inner and outer support members 25, 35.

The second upper arm 45 may be fixedly connected between the second inner and outer support members 25, 35 such as shown in FIGS. 13-24, or may be pivotably connected such as shown in FIGS. 1-12 and 25-48. The manner by which the second upper arm 45 is connected between the second and outer support members 25, 35 may vary in different embodiments. By way of example, brackets, fasteners, hinges, and various other types of connectors may be utilized in different embodiments as discussed in more detail below.

As shown throughout the figures, a second lower arm 55 may be connected between the second inner support member 25 and the second outer support member 35 below the second upper arm 45. The second lower arm 55 may comprise an elongated member such as a rod or the like including a first end 56 and a second end 57. The first end 56 of the second lower arm 55 may be connected to the second inner support member 25 and the second end 57 of the second lower arm 55 may be connected to the second outer support member 35.

The positioning of the second lower arm 55 with respect to the second inner and outer support members 25, 35 may vary in different embodiments. In the exemplary embodiments shown in the figures, the second lower arm 55 is positioned at or near the respective lower ends 27, 37 of the second inner and outer support members 25, 35. In other embodiments, the second lower arm 55 may be positioned at various other locations along the length of the second inner and outer support members 25, 35.

The second lower arm 55 may be fixedly connected between the second inner and outer support members 25, 35 such as shown in FIGS. 13-24, or may be pivotably connected such as shown in FIGS. 1-12 and 25-48. The manner by which the second lower arm 55 is connected between the second and outer support members 25, 35 may vary in different embodiments. By way of example, brackets, fasteners, hinges, and various other types of connectors may be utilized in different embodiments as discussed in more detail below.

As shown in FIGS. 1-48, the first inner support member 20, the first outer support member 30, the first upper arm 40, and the first lower arm 50 are each interconnected so as to form a first frame 15. Similarly, the second inner support member 25, the second outer support member 35, the second upper arm 45, and the second lower arm 55 are each interconnected so as to form a second frame 16 which may be a mirror of the first frame 15.

The respective frames 15, 16 may be interconnected with each other such as shown in FIGS. 1-12 and 25-48 (e.g., by the use of an inner cross bar 49) or may not be interconnected with each other such as shown in FIGS. 13-24. In some embodiments, each frame 15, 16 may be independently pivoted inwardly towards the wall 12 or pivoted outwardly away from the wall 12 as discussed herein. The frames 15, 16 will each generally be comprised of a rectangular shape as shown in the figures, though other shapes may be utilized in some embodiments. In some embodiments, the frames 15, 16 may each be square-shaped.

It should be appreciated that a wide range of exercise attachments may be removably connected to the exercise rack 11 formed by the inner and outer support members 20, 25, 30, 35. It can be seen in the figures that a cross bar 80 may be removably connected between the first and second outer support members 30, 35. Such a cross bar 80 may be utilized, e.g., as a pull-up bar for performing pull-ups. The figures illustrate the cross bar 80 being removably secured between the respective upper ends 31, 36 of the first and second outer support members 30, 35. However, using the openings 18 extending along the first and second outer support members 30, 35, the height of the cross bar 80 may be adjusted to suit different exercisers.

While the figures only illustrate use of a cross bar 80 with the exercise rack 11, it should be appreciated that any type of exercise attachment known for use with an exercise rack 11 may be utilized with the systems and methods described herein. By way of example and without limitation, such exercise attachments may include weightlifting attachments (e.g., brackets for supporting weightlifting bars), mobility bands, dip stations, benches, spotter arms, and the like. By way of example and without limitation, the various exercise attachments shown and described in U.S. Pat. No. 11,058,936 may be utilized in connection with the folding exercise rack system, the entire disclosure of which, except for any definitions, disclaimers, disavowals, and inconsistencies, are incorporated herein by reference.

As shown throughout the figures, each of the embodiments shown and described herein may be adjusted between various positions, such as by pivoting/swinging various elements towards or away from the wall 12. In the embodiments shown in FIGS. 13-48, it can be seen that the first and second outer support members 30, 35 may be pivoted inwardly towards the wall 12 (e.g., by swinging side-to-side) for storage. In the embodiment shown in FIGS. 1-12, it can be seen that the first and second outer members 30, 35 may be slid towards the first and second inner support members 20, 25, with the upper and lower arms 40, 45, 50, 55 being pivoted upwardly/downwardly into a folded configuration. The manner by which the outer support members 30, 35 may be so adjusted may vary as discussed in more detail below.

It can also be seen in FIGS. 1-12 and 25-48 that the inner support members 20, 25 may in some embodiments be similarly adjustable. For example, as shown in FIGS. 1-12, the inner support members 20, 25 may be adjusted towards or away from the wall 12. As a further example, the inner support members 20, 25 may additionally or alternatively be adjusted upwardly or downwardly with respect to the wall 12. The manner by which the inner support members 20, 25 are so adjusted may vary as discussed in more detail below.

C. First Exemplary Embodiment (FIGS. 1-12)

FIGS. 1-12 illustrate a first exemplary embodiment of a folding exercise rack system. As shown in the figures, the first exemplary embodiment includes an exercise rack 11 comprised of a first frame 15 comprised of a first inner support member 20, a first outer support member 30, a first upper arm 40 connected near the respective upper ends 21, 31 of the first inner support member 20 and the first outer support member 30, and a first lower arm 50 connected near the respective lower ends 22, 32 of the first inner support member 20 and the first outer support member 30.

Continuing to reference FIGS. 1-12, a second frame 16 is shown in a distally-spaced position along the wall 12 from the first frame 15. The second frame 16 may comprise a second inner support member 25, a second outer support member 35, a second upper arm 45 connected near the respective upper ends 26, 36 of the second inner support member 25 and the second outer support member 35, and a second lower arm 55 connected near the respective lower ends 27, 37 of the second inner support member 25 and the second outer support member 35.

As best shown in FIG. 1, the first and second frames 15, 16, which form an exercise rack 11, may be interconnected by an inner cross bar 49. The inner cross bar 49 is shown as being connected between a point near the respective upper ends 21, 31 of the first and second inner support members 20, 30. However, the inner cross bar 49 may be positioned at various other locations along the length of the first and second inner support members 20, 30 in some embodiments.

Generally, the exercise rack 11 shown in FIGS. 1-12 may be adjustable between an extended and a retracted (e.g., folded, collapsed) position. The manner by which the exercise rack 11 is adjusted may vary. In the exemplary embodiment shown in FIGS. 1-12, the first and second outer support members 30, 35 may be slid inwardly or outwardly along the upper and lower arms 40, 45, 50, 55, with the upper and lower arms 40, 45, 50, 55 pivoting upwardly/downwardly into the retracted (e.g., folded) position.

FIGS. 1-4 illustrate such an exercise rack 11 in an extended position, in which the first and second outer support members 30, 35 are releasably locked into an outer position at or near the respective second ends 42, 47, 52, 57 of the upper and lower arms 40, 45, 50, 55 which is distally-spaced away from the wall 12. As shown, the upper and lower arms 40, 45, 50, 55 are each positioned perpendicular to each of the wall 12, inner support members 20, 25, and outer support members 30, 35 in an extended position.

FIGS. 5-8 illustrate the exercise rack 11 midway through being adjusted into a retracted (e.g., folded) position. As shown, the outer support members 30, 35 have been unlocked and are being slid towards the wall 12 along the upper and lower arms 40, 45, 50, 55. More specifically, it can be seen that the first outer support member 30 is being slid between the first upper arm 40 and the first lower arm 50 towards the first inner support member 20. Similarly, it can be seen that the second outer support member 35 is being slid between the second upper arm 45 and the second lower arm 55 towards the second inner support member 25.

Continuing to reference FIGS. 5-8, it can be seen that the upper and lower arms 40, 45, 50, 55 are midway through being retracted (e.g., folded) inwardly towards the wall 12 and first and second inner support members 20, 25. More specifically, it can be seen that the first upper arm 40 is pivoting downwardly towards the wall 12 and first inner support member 20. The first lower arm 50 is pivoting upwardly towards the wall 12 and first inner support member 20. The second upper arm 45 is pivoting downwardly towards the wall 12 and second inner support member 25. The second lower arm 55 is pivoting upwardly towards the wall 12 and second inner support member 25.

FIGS. 9-12 illustrate the exercise rack 11 in the retracted (e.g., folded) position. As shown in FIGS. 9-12, the first and second outer support members 30, 35 have been slid to rest against the first and second inner support members 20, 25, and the upper and lower arms 40, 45, 50, 55 have been pivoted inwardly towards the wall 12 and inner support members 20, 25 to rest against the outer support members 30, 35.

More specifically, the first outer support member 30 has been slid in to rest against the first inner support member 20, with the first upper arm 40 pivoted downwardly to rest against the first outer support member 30 and the first lower arm 50 pivoted upwardly to rest against the first outer support member 30. Similarly, the second outer support member 35 has been slid in to rest against the second inner support member 25, with the second upper arm 45 pivoted downwardly to rest against the second outer support member 35 and the second lower arm 55 pivoted upwardly to rest against the second outer support member 35.

As shown throughout FIGS. 1-12, the exercise rack 11 itself may be adjustable with respect to the wall 12 between an extended position in which the first inner support member 20 and the second inner support member 25 are distally positioned away from the wall and a retracted position in which the first inner support member 20 and the second inner support member 25 are positioned adjacent to the wall 12.

The manner by which the exercise rack 11 is so adjusted with respect to the wall 12 may vary. In the embodiment shown in FIGS. 1-12, the inner support members 20, 25 are each adapted to be raised into the retracted position and lowered into the extended position. By way of non-limiting example, one or more brackets 90, 95 may be connected between the inner support members 20, 25 and the wall 12.

Figure 5:
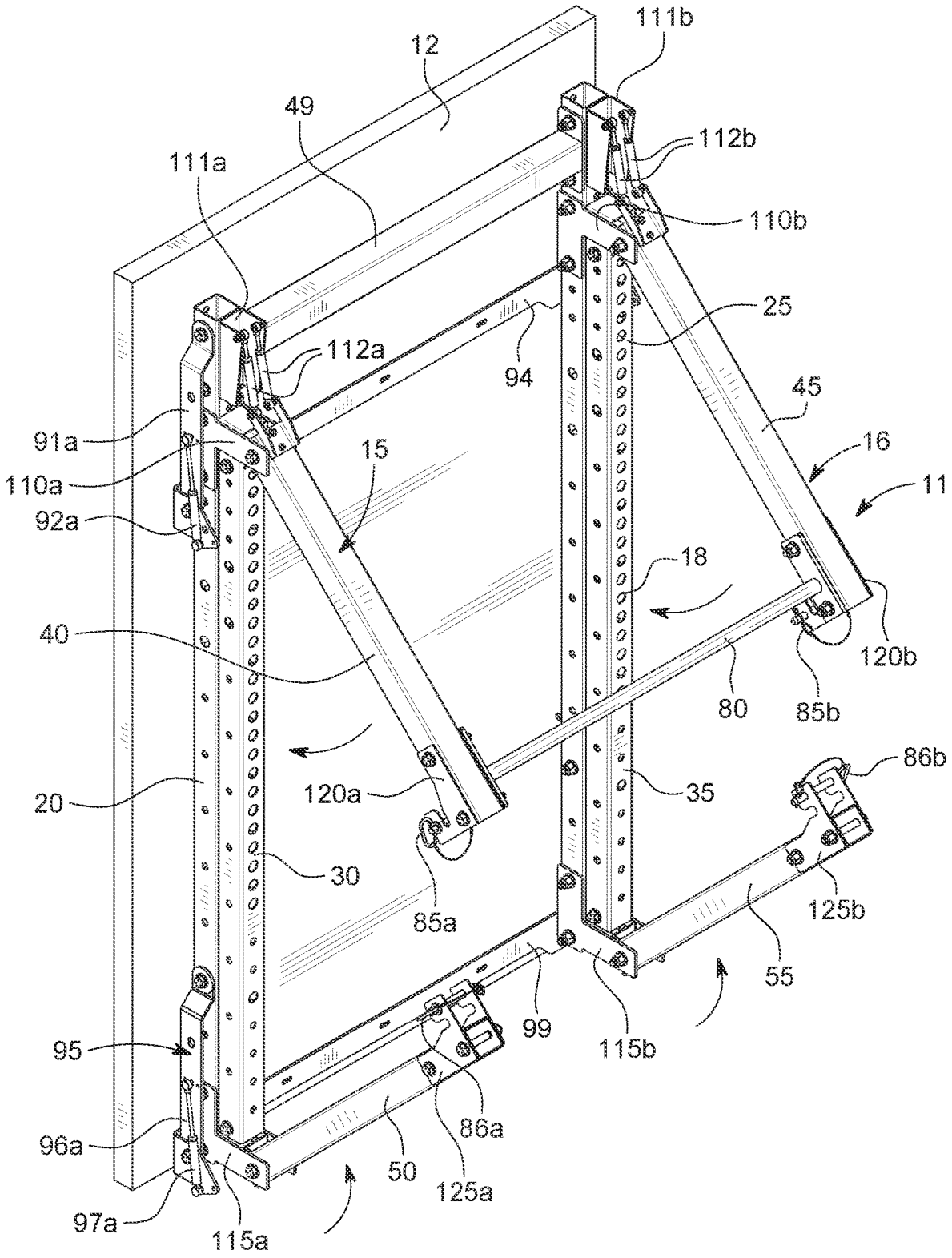
FIG. 5 is a perspective view of a folding exercise rack system during adjustment between retracted and extended positions in accordance with a first exemplary embodiment.
Figure 9:
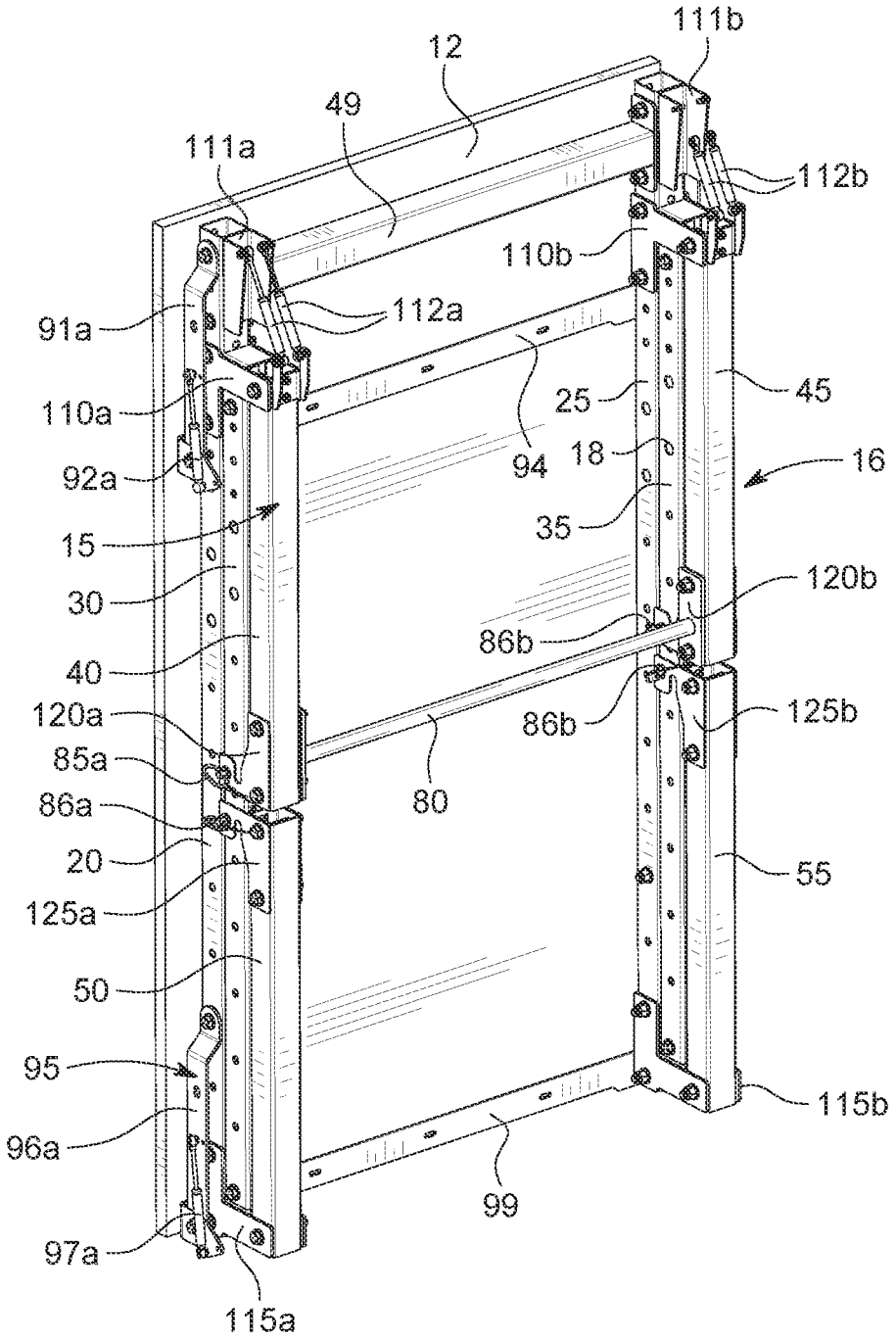
FIG. 9 is a perspective view of a folding exercise rack system in a retracted position in accordance with a first exemplary embodiment.
Figure 10:
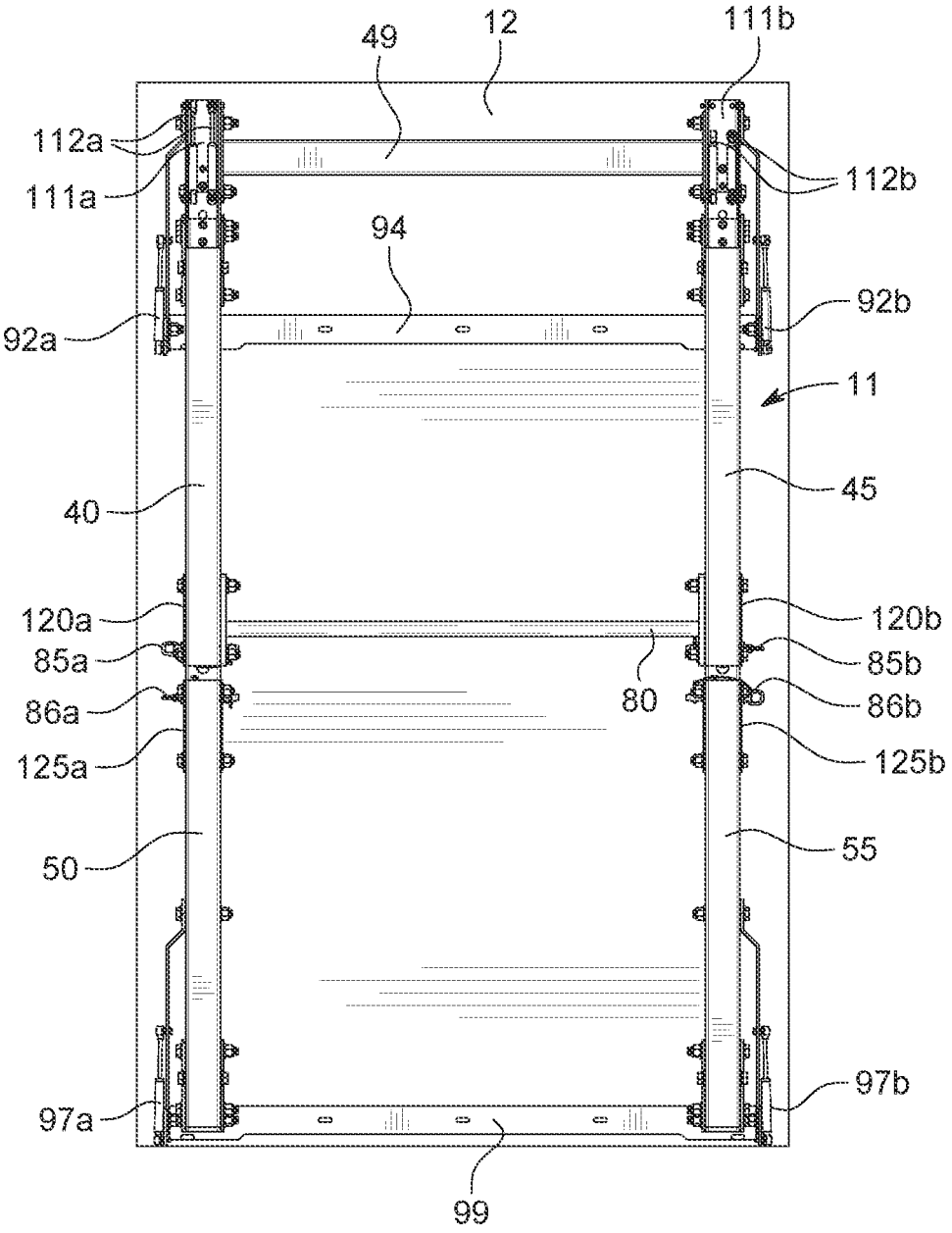
FIG. 10 is a front view of a folding exercise rack system in a retracted position in accordance with a first exemplary embodiment.

As best shown in FIGS. 1, 5, and 9, the exercise rack 11 may be adjustably connected to the wall 12 by one or more brackets 90, 95. Although the figures illustrate usage of a pair of brackets 90, 95, it should be appreciated that, in some embodiments (e.g., compact embodiments or embodiments utilizing lightweight materials), only a single bracket 90, 95 may be utilized. In other embodiments, additional brackets 90, 95 (e.g., three, four, five, etc.) may be utilized.

In the exemplary embodiment shown in the figures, an upper bracket 90 is connected between the wall 12 and a position at or near the upper ends 21, 26 of the inner support members 20, 25. A lower bracket 95 is connected between the wall 12 and the inner support members 20, 25 below the upper bracket 90. Each of the brackets 90, 95 are adapted to pivot the exercise rack 11 towards the wall 12 or away from the wall 12. In the embodiment shown in the figures, the exercise rack 11 is raised into the retracted position and lowered into the extended position. Such an embodiment functions to raise the exercise rack 11 off of the floor 13 when the exercise rack 11 is retracted such as shown in FIGS. 9-12.

The configuration of the brackets 90, 95 may vary in different embodiments. In the exemplary embodiment shown in FIGS. 1-12, the upper bracket 90 is shown as comprising an upper wall mount 94 which is secured to the wall 12 (e.g., by fasteners) and a pair of arms 91*a*, 91*b* which are each pivotably connected between the upper wall mount 94 and the respective inner support members 20, 25. The pair of arms 91*a*, 91*b* may comprise a first arm 91*a* connected near a first side of the upper wall mount 94 and a second arm 91*b* connected near a second side of the upper wall mount 94.

More specifically, it can be seen that a first arm 91*a* is pivotably connected at its first end to the upper wall mount 94 and is pivotably connected at its second end to the first inner support member 20. Similarly, a second arm 91*b* is pivotably connected at its first end to the upper wall mount 94 and is pivotably connected at its second end to the second inner support member 25. A first shock 92*a* may be connected between the upper wall mount 94 and the first arm 91*a*, and a second shock 92*b* may be connected between the upper wall mount 94 and the second arm 91*b*.

Continuing to reference FIGS. 1-12, it can be seen that the lower bracket 95 may comprise a lower wall mount 99 which is secured to the wall 12 (e.g., by fasteners) and a pair of arms 96*a*, 96*b* which are each pivotably connected between the lower wall mount 99 and the respective inner support members 20, 25. The pair of arms 96*a*, 96*b* may be comprised of a first arm 96*a* which is connected near a first side of the lower wall mount 99 and a second arm 96*b* which is connected near a second side of the lower wall mount 99.

The first arm 96*a* may be pivotably connected at its first end to the lower wall mount 99 and at its second end to the first inner support member 20.

Similarly, the second arm 96*b* may be pivotably connected at its first end to the lower wall mount 99 and at its second end to the second inner support member 25. A first shock 97*a* may be connected between the lower wall mount 99 and the first arm 96*a*, and a second shock 97*b* may be connected between the lower wall mount 99 and the second arm 96*b*.

As shown in FIGS. 1-12, the respective brackets 90, 95 may be pivoted upwardly into the retracted position adjacent to the wall 12, and pivoted downwardly into the extended position which is distally positioned with respect to the wall 12. The arms 91*a*, 91*b*, 96*a*, 96*b* may be pivoted upwardly to raise the inner support members 20, 25 (and thus the exercise rack 11) into the retracted position adjacent to the wall 12, such as for storage. The arms 91*a*, 91*b*, 96*a*, 96*b* may conversely be pivoted downwardly to lower the inner support members 20, 25 (and thus the exercise rack 11) into the extended position away from the wall 12, ready for use. The shocks 92*a*, 92*b*, 97*a*, 97*b*, which may be comprised of various devices such as actuators and the like, may aid in raising and lowering the exercise rack 11.

As shown throughout the figures, the exercise rack 11 may comprise various openings 18 for attachment of various brackets, attachments, locking devices, and the like. The openings 18 may be positioned on various portions of the exercise rack 11, such as but not limited to the inner support members 20, 25, outer support members 30, 35, upper arms 40, 45, lower arms 50, 55, inner cross bar 49, and/or brackets 90, 95.

As best shown in FIGS. 5-8, the first upper arm 40 is pivotably connected at its first end 41 to the first inner support member 20. The first upper arm 40 may be pivotably connected to the first inner support member 20 such that the first upper arm 40 may be pivoted upwardly into a perpendicular position with respect to the first inner support member 20 and pivoted downwardly to rest against the first inner support member 20 in a parallel position.

A first upper hinge 110*a* may be utilized to pivotably connect the first inner support member 20 and the first end 41 of the first upper arm 40. The type of hinge utilized may vary in different embodiments and thus should not be construed as limited by the exemplary embodiments shown in the figures. In the exemplary embodiment shown in FIGS. 1-12, it can be seen that the first upper hinge 110*a* may comprise a pair of L-shaped brackets which are connected on either side of the first inner support member 20, with the first end 41 of the first upper arm 40 being pivotably connected between the pair of L-shaped brackets.

One or more first upper shocks 112*a* may be connected between the first inner support member 20 and the first upper arm 40 to aid with and/or smoothen adjustment of the first upper arm 40 between its positions with respect to the first inner support member 20. In the exemplary embodiment shown in the figures, it can be seen that a first upper shock bracket 111*a* is connected near the upper end 21 of the first inner support member 20, with the first upper shocks 112*a* being connected to the first upper shock bracket 111*a*. The first upper shock bracket 111*a* may be comprised of various configurations, such as but not limited to a U-shaped bracket as shown in the figures.

Figure 3:
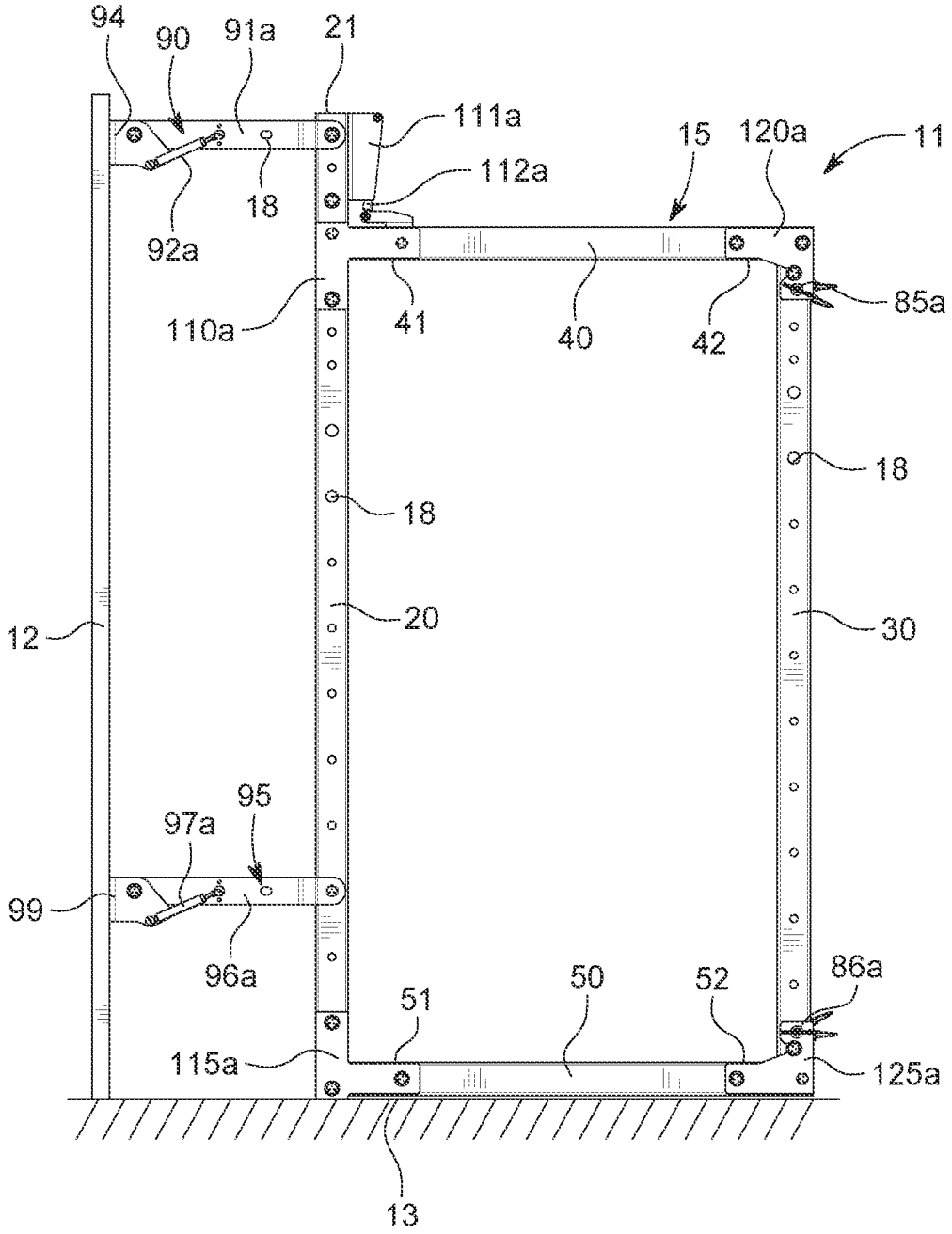
FIG. 3 is a side view of a folding exercise rack system in an extended position in accordance with a first exemplary embodiment.
Figure 4:
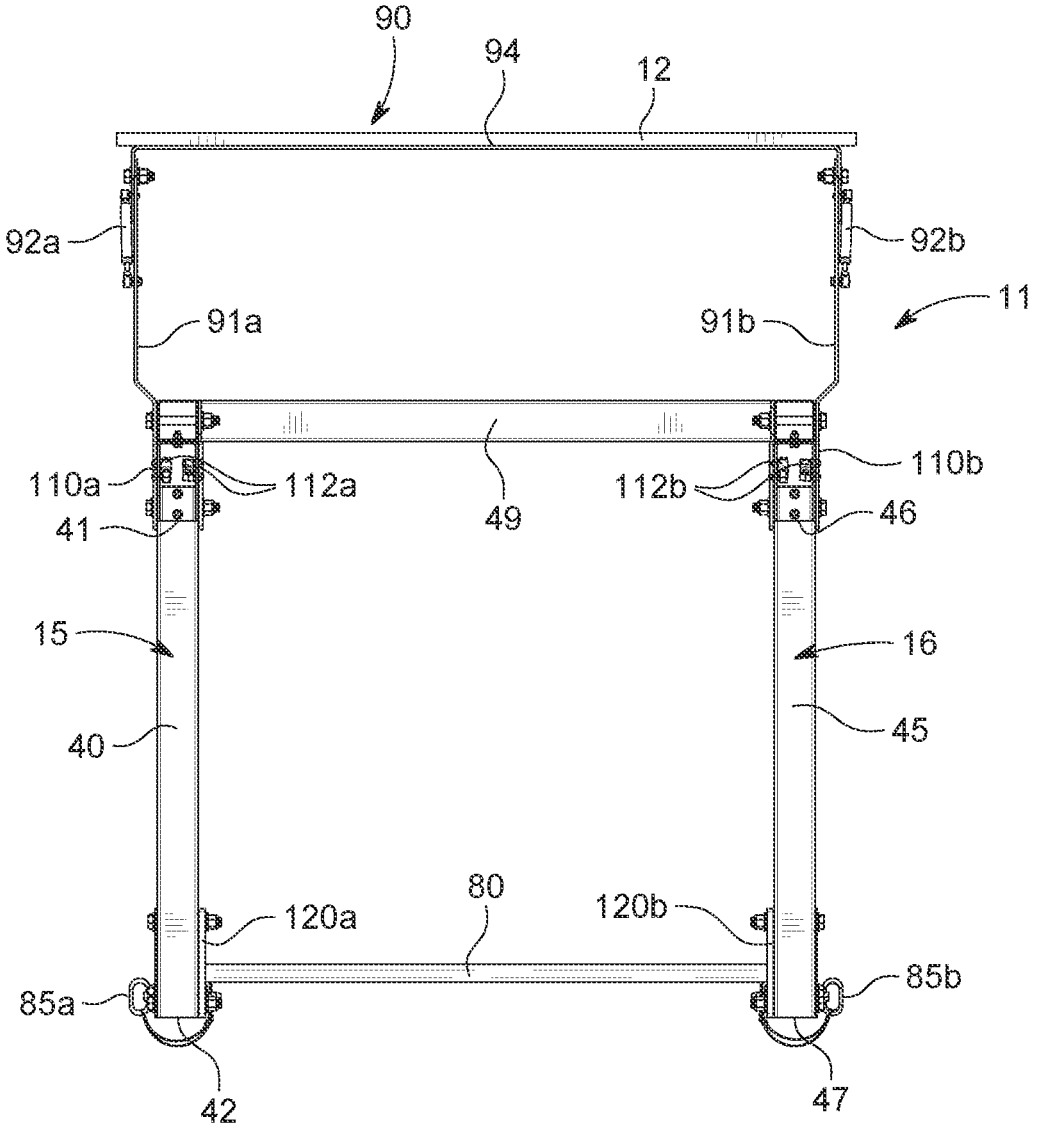
FIG. 4 is a top view of a folding exercise rack system in an extended position in accordance with a first exemplary embodiment.
Figure 6:
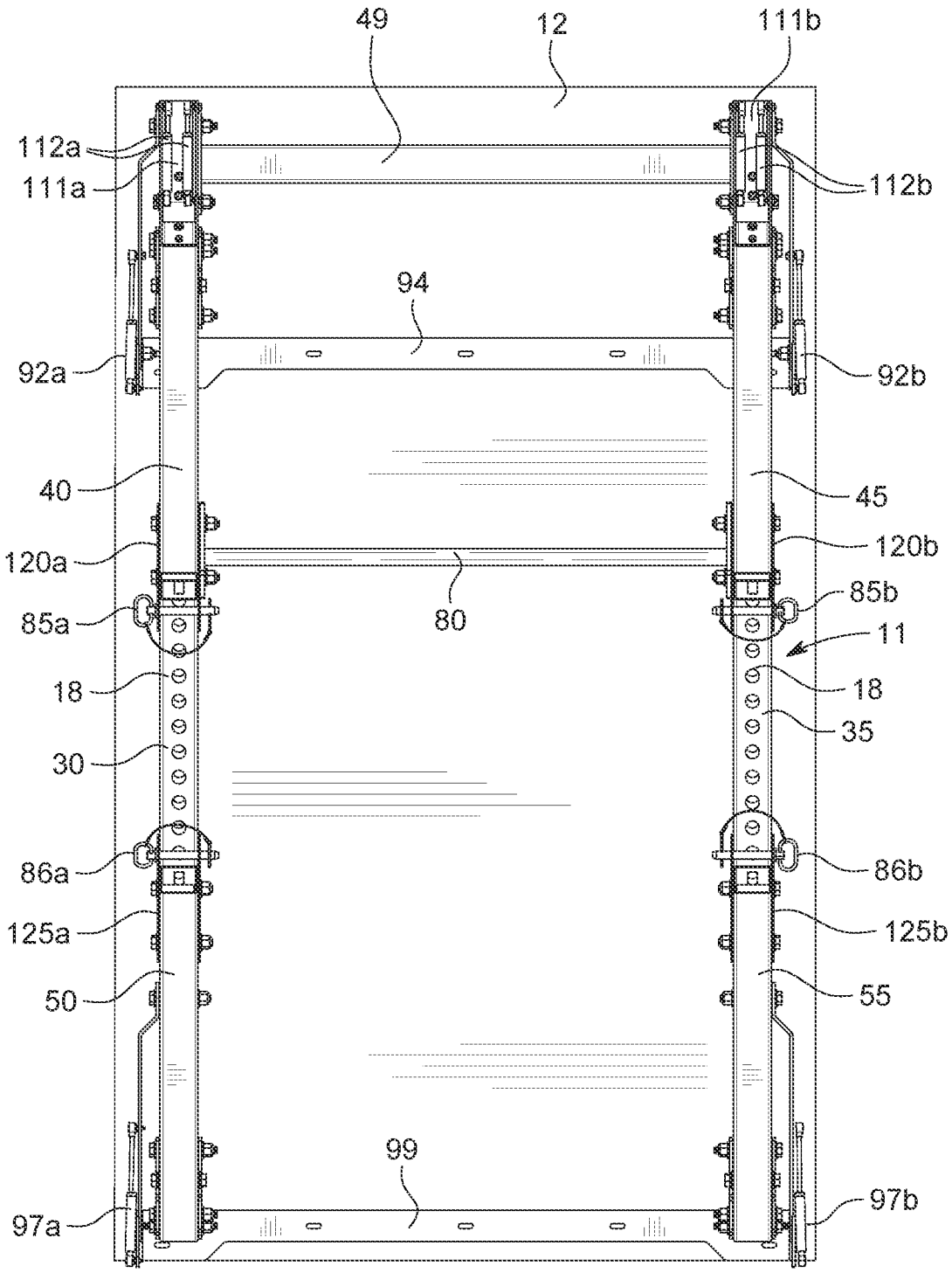
FIG. 6 is a front view of a folding exercise rack system during adjustment between retracted and extended positions in accordance with a first exemplary embodiment.
Figure 7:
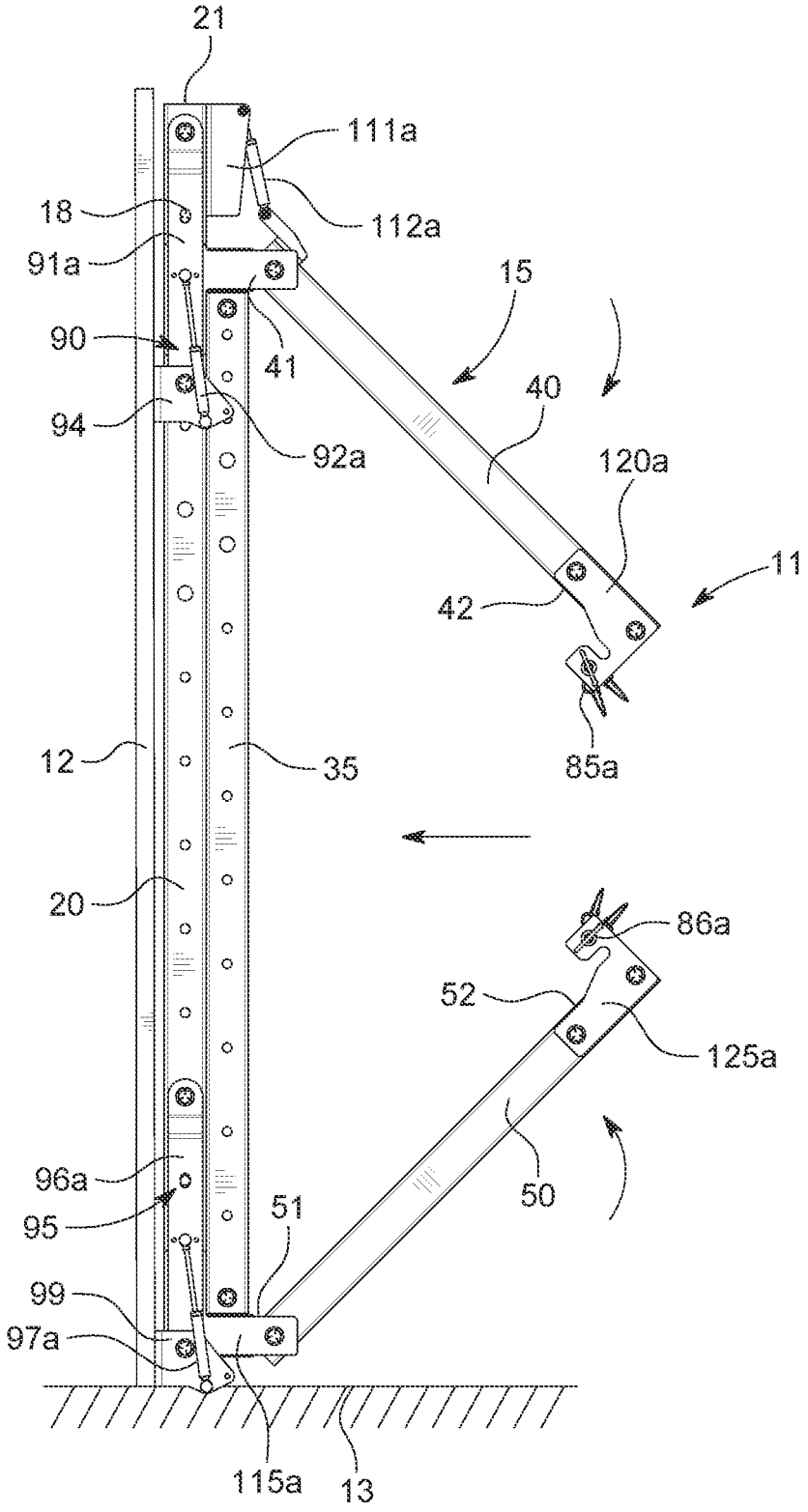
FIG. 7 is a side view of a folding exercise rack system during adjustment between retracted and extended positions in accordance with a first exemplary embodiment.
Figure 8:
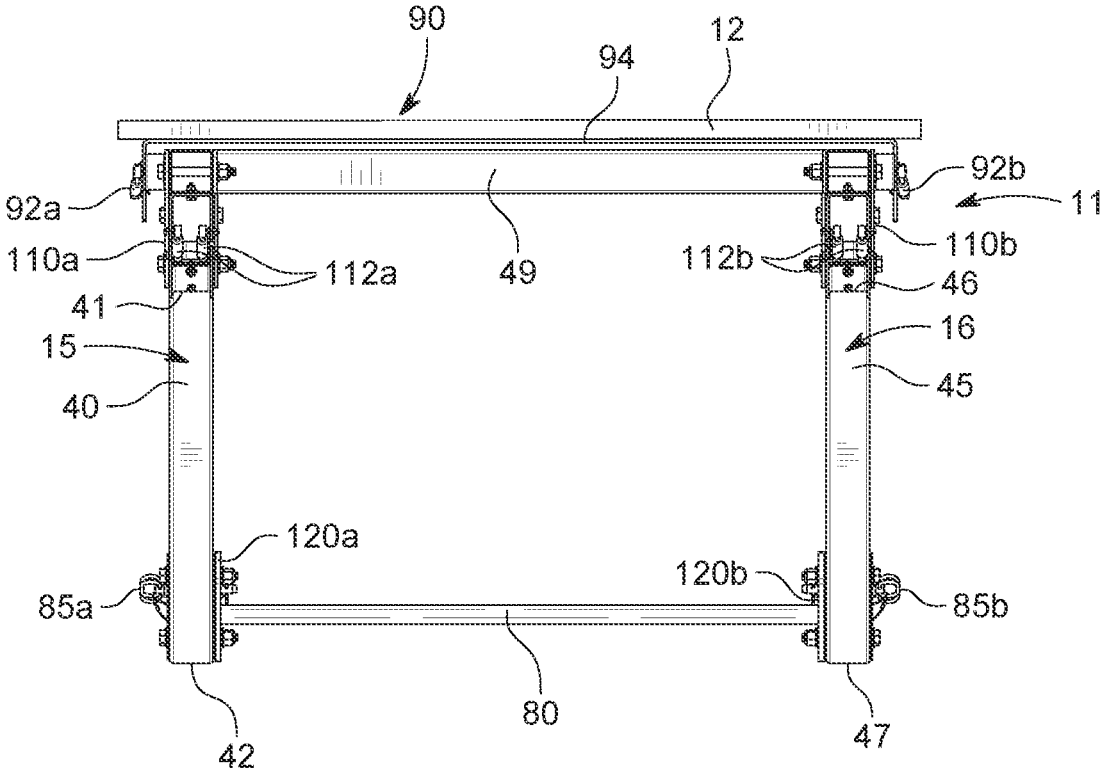
FIG. 8 is a top view of a folding exercise rack system during adjustment between retracted and extended positions in accordance with a first exemplary embodiment.
Figure 11:
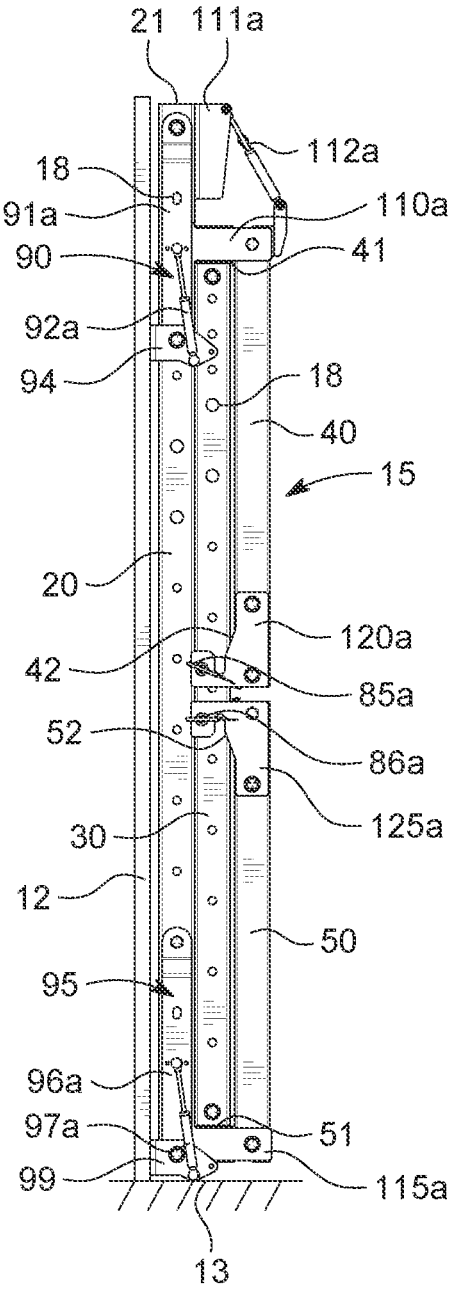
FIG. 11 is a side view of a folding exercise rack system in a retracted position in accordance with a first exemplary embodiment.
Figure 12:
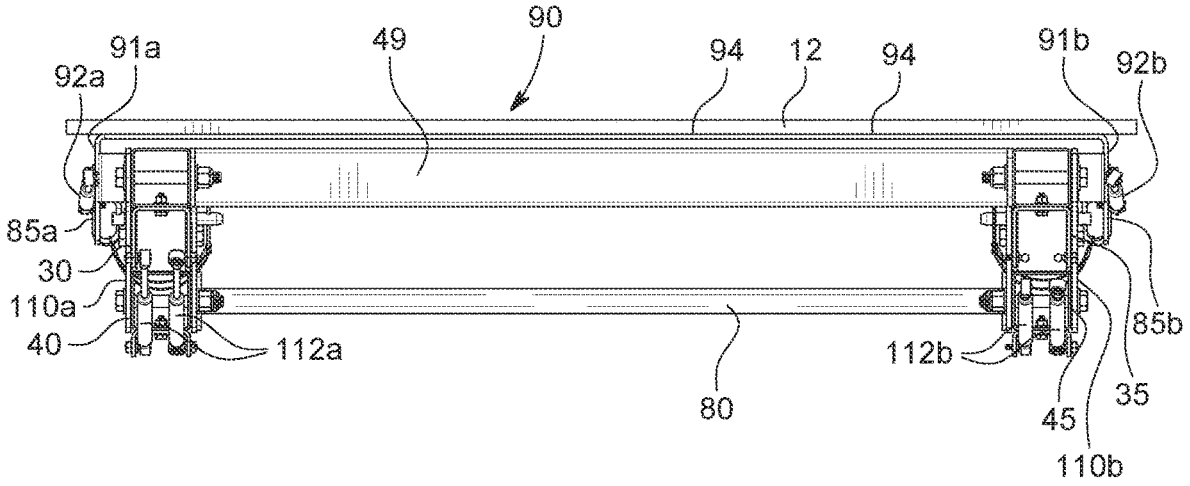
FIG. 12 is a top view of a folding exercise rack system in a retracted position in accordance with a first exemplary embodiment.

A first lower hinge 115*a* may be utilized to pivotably connect the first inner support member 20 and the first end 51 of the first lower arm 50 such as shown in FIGS. 3, 7, and 11. The type of hinge utilized may vary in different embodiments and thus should not be construed as limited by the exemplary embodiments shown in the figures. In the exemplary embodiment shown in FIGS. 1-12, it can be seen that the first lower hinge 115*a* may comprise a pair of L-shaped brackets which are connected on either side of the first inner support member 20, with the first end 51 of the first lower arm 50 being pivotably connected between the pair of L-shaped brackets.

Although not shown in the embodiments shown in the figures, it should be appreciated that one or more first lower shocks may in some embodiments be connected between the first inner support member 20 and the first lower arm 50 to aid with and/or smoothen adjustment of the first lower arm 50 between its positions with respect to the first inner support member 20.

A second upper hinge 110*b* may be utilized to pivotably connect the second inner support member 25 and the first end 46 of the second upper arm 45 such as shown in FIGS. 1, 5, and 9. The type of hinge utilized may vary in different embodiments and thus should not be construed as limited by the exemplary embodiments shown in the figures. In the exemplary embodiment shown in FIGS. 1-12 it can be seen that the second upper hinge 110*b* may comprise a pair of L-shaped brackets which are connected on either side of the second inner support member 25, with the first end 46 of the first second arm 45 being pivotably connected between the pair of L-shaped brackets.

One or more second upper shocks 112*b* may be connected between the second inner support member 25 and the second upper arm 45 to aid with and/or smoothen adjustment of the second upper arm 45 between its positions with respect to the second inner support member 25. In the exemplary embodiment shown in the figures, it can be seen that a second upper shock bracket 111*b* is connected near the upper end 26 of the second inner support member 25, with the second upper shocks 112*b* being connected to the second upper shock bracket 111*b*. The second upper shock bracket 111*b* may be comprised of various configurations, such as but not limited to a U-shaped bracket as shown in the figures.

A second lower hinge 115*b* may be utilized to pivotably connect the second inner support member 25 and the first end 56 of the second lower arm 55 such as shown in FIGS. 1, 5, and 9. The type of hinge utilized may vary in different embodiments and thus should not be construed as limited by the exemplary embodiments shown in the figures. In the exemplary embodiment shown in FIGS. 1-12, it can be seen that the second lower hinge 115*b* may comprise a pair of L-shaped brackets which are connected on either side of the second inner support member 25, with the first end 56 of the second lower arm 55 being pivotably connected between the pair of L-shaped brackets.

Although not shown in the embodiments shown in the figures, it should be appreciated that one or more second lower shocks may in some embodiments be connected between the second inner support member 25 and the second lower arm 55 to aid with and/or smoothen adjustment of the second lower arm 55 between its positions with respect to the second inner support member 25.

As best shown in FIGS. 1, 5, and 9, each of the upper and lower arms 40, 45, 50, 55 may include slots 53, 58 within which the outer support members 30, 35 may slide when being adjusted inwardly towards the inner support members 20, 25 or outwardly away from the inner support members 20, 25. While the slots of the upper arms 40, 45 are not visible in the figures, it should be appreciated that the first upper arm 40 may include a first upper slot along its lower surface and the second upper arm 45 may include a first lower slot along its lower surface.

As best shown in FIGS. 1, 5, and 9, the first lower arm 50 may include a first lower slot 53 extending along its upper surface. Similarly, the second lower arm 55 may include a second lower slot 58 extending along its upper surface. The first outer support member 30 may be slidably positioned within the first upper slot of the first upper arm 40 and the first lower slot 53 of the first lower arm 50. The second outer support member 35 may be slidably positioned within the second upper slot of the second upper arm 45 and the second lower slot 58 of the second lower arm 55. The first outer support member 30 may thus include a projection such as a fastener or the like on each of its upper and lower ends 31, 32 to engage within the slots 53. Similarly, the second outer support member 35 may include a projection such as a fastener or the like on each of its upper and lower ends 36, 37 to engage within the slots 58.

As shown in FIGS. 1-12, each of the second ends 42, 47, 52, 57 (e.g., distal ends) of the upper and lower arms 40, 45, 50, 55 may include a bracket 120*a*, 120*b*, 125*a*, 125*b*. Various types of brackets 120*a*, 120*b*, 125*a*, 125*b* may be utilized, including but not limited to the L-shaped brackets shown in the figures. The brackets 120*a*, 120*b*, 125*a*, 125*b* function to secure the respective outer support members 30, 35 in their extended positions such as shown in FIGS. 1-4.

With reference to FIGS. 1-4, it can be seen that the second end 42 of the first upper arm 40 includes a first upper bracket 120*a* comprised of a pair of L-shaped members secured (e.g., by fasteners, welding, adhesives, or the like) to the sides of the second end 42 of the first upper arm 40. The first upper bracket 120*a* includes one or more openings which are adapted to align with one or more openings 18 of the first outer support member 30 when the first outer support member 30 is in its extended (e.g., outer) position. As shown in FIG. 1, a first upper locking member 85*a* may be selectively and removably inserted through such openings to lock the first outer member 30 in position at or near the second end 42 of the first upper arm 40.

Continuing to reference FIGS. 1-4, it can be seen that the second end 52 of the first lower arm 50 includes a first lower bracket 125*a* comprised of a pair of L-shaped members secured (e.g., by fasteners, welding, adhesives, or the like) to the sides of the second end 52 of the first lower arm 50. The first lower bracket 125*a* includes one or more openings which are adapted to align with one or more openings 18 of the first outer support member 30 when the first outer support member 30 is in its extended (e.g., outer) position. As shown in FIG. 1, a first lower locking member 86*a* may be selectively and removably inserted through such openings to lock the first outer member 30 in position at or near the second end 52 of the first lower arm 50.

As should be apparent in the figures, the first outer support member 30 may be secured between the first upper bracket 120*a* and the first lower bracket 125*a* when the first outer support member 30 is in its outer position, distally spaced away from the first inner support member 20 and the wall 12. More specifically, the upper end 31 of the first outer support member 30 may be releasably secured within the first upper bracket 120*a* and the lower end 32 of the first outer support member 30 may be releasably secured within the first lower bracket 125*a*. The first upper and lower locking members 85*a*, 86*a* function to releasably secure the first outer support member 30 between the brackets 120*a*, 125*a*.

Continuing to reference FIGS. 1-4, it can be seen that the second end 47 of the second upper arm 45 includes a second upper bracket 120*b* comprised of a pair of L-shaped members secured (e.g., by fasteners, welding, adhesives, or the like) to the sides of the second end 47 of the second upper arm 45. The second upper bracket 120*b* includes one or more openings which are adapted to align with one or more openings 18 of the second outer support member 35 when the second outer support member 35 is in its extended (e.g., outer) position. As shown in FIG. 1, a second upper locking member 85*b* may be selectively and removably inserted through such openings to lock the second outer member 35 in position at or near the second end 47 of the second upper arm 45.

Continuing to reference FIGS. 1-4, it can be seen that the second end 57 of the second lower arm 55 includes a second lower bracket 125*b* comprised of a pair of L-shaped members secured (e.g., by fasteners, welding, adhesives, or the like) to the sides of the second end 57 of the second lower arm 55. The second lower bracket 125*b* includes one or more openings which are adapted to align with one or more openings 18 of the second outer support member 35 when the second outer support member 35 is in its extended (e.g., outer) position. As shown in FIG. 1, a second lower locking member 86*b* may be selectively and removably inserted through such openings to lock the second outer member 35 in position at or near the second end 57 of the second lower arm 55.

As should be apparent in the figures, the second outer support member 35 may be secured between the second upper bracket 120*b* and the second lower bracket 125*b* when the second outer support member 35 is in its outer position, distally spaced away from the second inner support member 25 and the wall 12. More specifically, the upper end 36 of the second outer support member 35 may be releasably secured within the second upper bracket 120*b* and the lower end 37 of the second outer support member 35 may be releasably secured within the second lower bracket 125*b*. The second upper and lower locking member 85*b*, 86*b* function to releasably secure the second outer support member 35 between the brackets 120*b*, 125*b*.

As best shown in FIGS. 1-4, a cross bar 80 may be connected between the upper brackets 120*a*, 120*b*, such as by fasteners or the like. However, in some embodiments, the cross bar 80 may instead be connected between various locations along the lengths of the first and second outer support members 30, 35. While the figures illustrate that the cross bar 80 remains interconnected between the outer support members 30, 35 when folded, in some embodiments, the cross bar 80 may be removably connected between the outer support members 30, 35 such that the cross bar 80 may be removed when the exercise rack is folded.

D. Second Exemplary Embodiment (FIGS. 13-24)

FIGS. 13-24 illustrate a second exemplary embodiment of a folding exercise rack system. As shown in the figures, the second exemplary embodiment includes an exercise rack 11 comprised of a first frame 15 comprised of a first inner support member 20, a first outer support member 30, a first upper arm 40 connected near the respective upper ends 21, 31 of the first inner support member 20 and the first outer support member 30, and a first lower arm 50 connected near the respective lower ends 22, 32 of the first inner support member 20 and the first outer support member 30.

Continuing to reference FIGS. 13-24, a second frame 16 is shown in a distally-spaced position along the wall 12 from the first frame 15. The second frame 16 may comprise a second inner support member 25, a second outer support member 35, a second upper arm 45 connected near the respective upper ends 26, 36 of the second inner support member 25 and the second outer support member 35, and a second lower arm 55 connected near the respective lower ends 27, 37 of the second inner support member 25 and the second outer support member 35.

In the exemplary embodiment shown in FIGS. 13-24, it can be seen that the first and second frames 15, 16 are not interconnected with each other, except by a removable cross bar 80. Thus, when the cross bar 80 is removed, the first and second frames 15, 16 may be independently adjusted (e.g., the first frame 15 may be adjusted independently of the second frame 16, and vice versa).

Generally, the exercise rack 11 shown in FIGS. 13-24 may be adjustable between an extended and a retracted (e.g., folded, collapsed) position. The manner by which the exercise rack 11 is adjusted may vary. As shown in the figures, the first frame 15 may be pivotably connected to the wall 12 and the second frame 16 may be pivotably connected to the wall 12. In the exemplary embodiment shown in FIGS. 13-24, the first frame 15 may be pivoted inwardly towards the second frame 16, and the second frame 16 may be pivoted inwardly towards the first frame 15.

More specifically, it can be seen in FIGS. 17-21 that the first frame 15 may be pivoted inwardly to be positioned adjacent to the wall 12 in an orientation which is parallel to the wall 12. Similarly, the second frame 16 may be pivoted inwardly to be positioned adjacent the folded first frame 15 in an orientation which is parallel to the wall 12. While the figures illustrate that the first frame 15 is pivoted first, and the second frame 16 is pivoted second, in some embodiments the reverse could be true (e.g., the second frame 16 could instead be pivoted first).

FIGS. 13-16 illustrate the exercise rack 11 in an extended position, in which the first and second frames 15, 16 are each extended perpendicular to the wall 12 such that the first and second outer support members 30, 35 are distally spaced away from the wall 12. Thus, the upper and lower arms 40, 45, 50, 55 are shown as being each positioned perpendicularly with respect to the wall 12 and the upper and lower wall mounts 60, 65 which are discussed in more detail below. In such an extended position, the exercise rack 11 is ready for use.

FIGS. 17-20 illustrate the exercise rack 11 midway through being adjusted into the retracted (e.g., folded) position. As shown in FIGS. 17-20, the first frame 15 has been pivoted inwardly towards the wall 12 and the second frame 16, with the first upper and lower arms 40, 50 being parallel to the wall 12. The second frame 16 has not yet been pivoted inwardly, and thus the second upper and lower arms 45, 55 remain perpendicular to the wall 12.

FIGS. 21-24 illustrate the exercise rack 11 in the retracted (e.g., folded) position. As shown in FIGS. 21-24, the first frame 15, comprised of the first inner support member 20, the first outer support member 30, the first upper arm 40, and the first lower arm 50, has been pivoted inwardly to be positioned adjacent to and parallel with respect to the wall 12. The second frame 16, comprised of the second inner support member 25, the second outer support member 35, the second upper arm 45, and the second lower arm 55, has been pivoted inwardly to be positioned adjacent to and parallel with respect to the folded first frame 15. Such a position may be desirable when the exercise rack 11 is not in use so as to not take up valuable space in an exercise space (e.g., home gym, garage, exercise studio, or the like).

As best shown in FIGS. 13-24, the exercise rack 11 may be adjustably connected to the wall 12 by one or more wall mounts 60, 65. Each wall mount 60, 65 may comprise various structures and devices capable of supporting the weight of the exercise rack 11 when secured to a wall 12, such as but not limited to the elongated, flat member shown in the figures. In the exemplary embodiment shown, a pair of wall mounts 60, 65 are utilized, comprising an upper wall mount 60 and a lower wall mount 65 positioned below the upper wall mount 60.

Continuing to reference FIGS. 13-24, it can be seen that a first upper hinge **71*a* is connected to a first end of the upper wall mount 60 and a second upper hinge 71*b* is connected to a second end of the upper wall mount 60. Similarly, a first lower hinge 76*a* is connected to a first end of the lower wall mount 65 and a second lower hinge 76*b* is connected to a second end of the lower wall mount 65. In some embodiments, the hinges 71*a*, 71*b*, 76*a*, 76*b* may be integrally formed or indirectly connected to the respective wall mounts 60, 65. Various types of hinges 71*a*, 71*b*, 76*a*, 76*b*** capable of pivoting an elongated member may be utilized, and thus the configuration shown in the figures should not be construed as limiting in scope.

Figure 13:
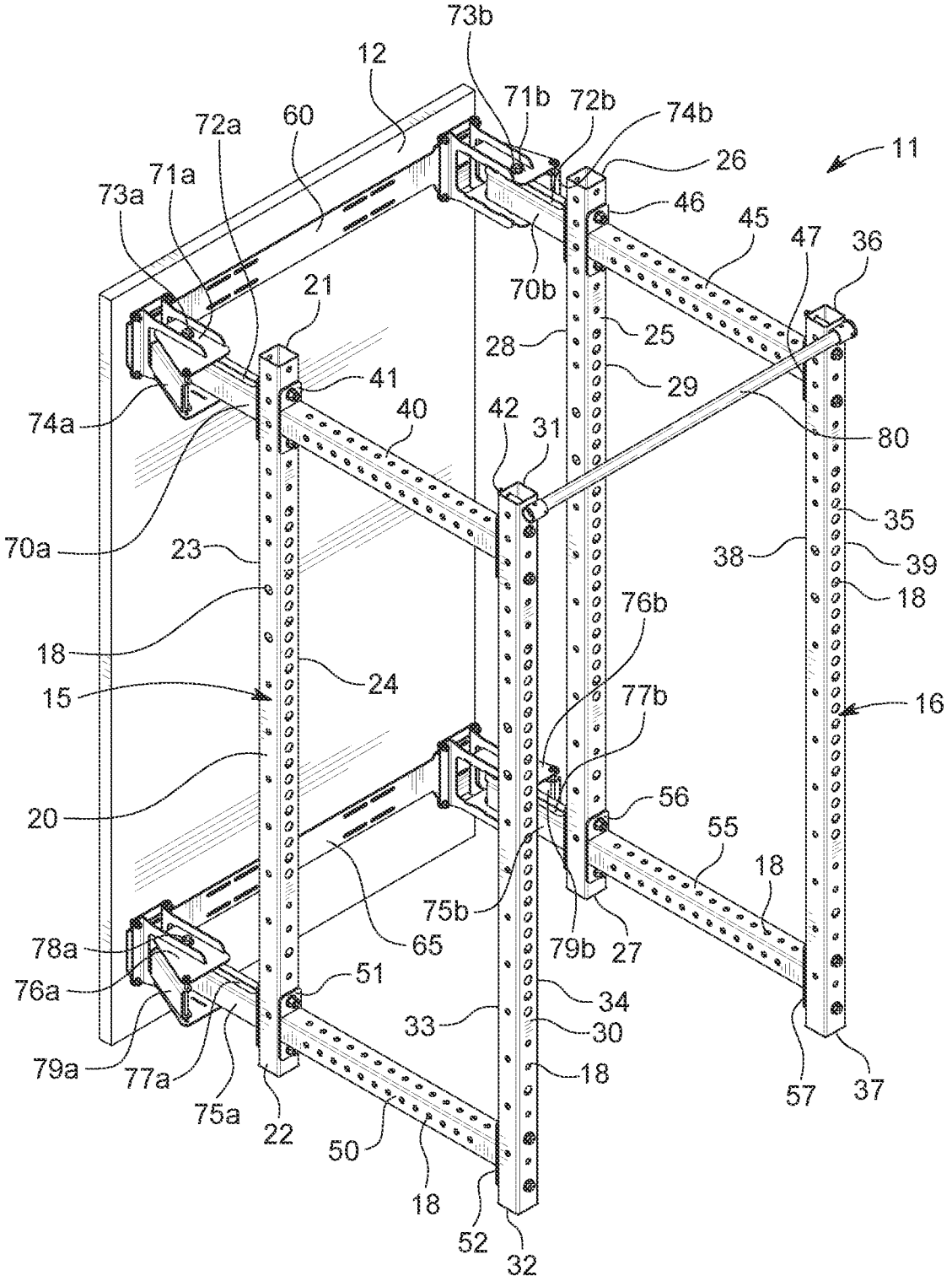
FIG. 13 is a perspective view of a folding exercise rack system in an extended position in accordance with a second exemplary embodiment.
Figure 14:
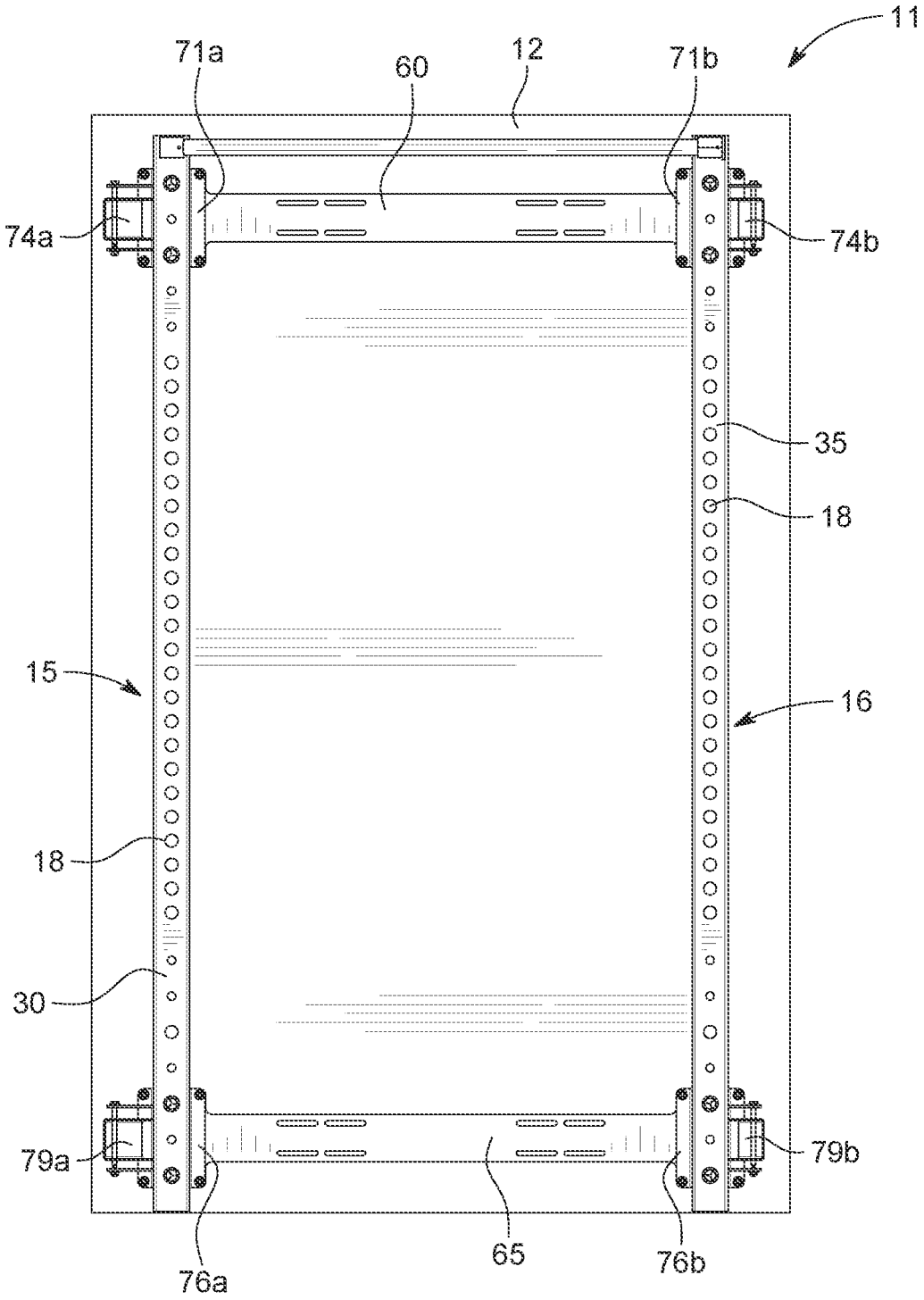
FIG. 14 is a front view of a folding exercise rack system in an extended position in accordance with a second exemplary embodiment.
Figure 15:
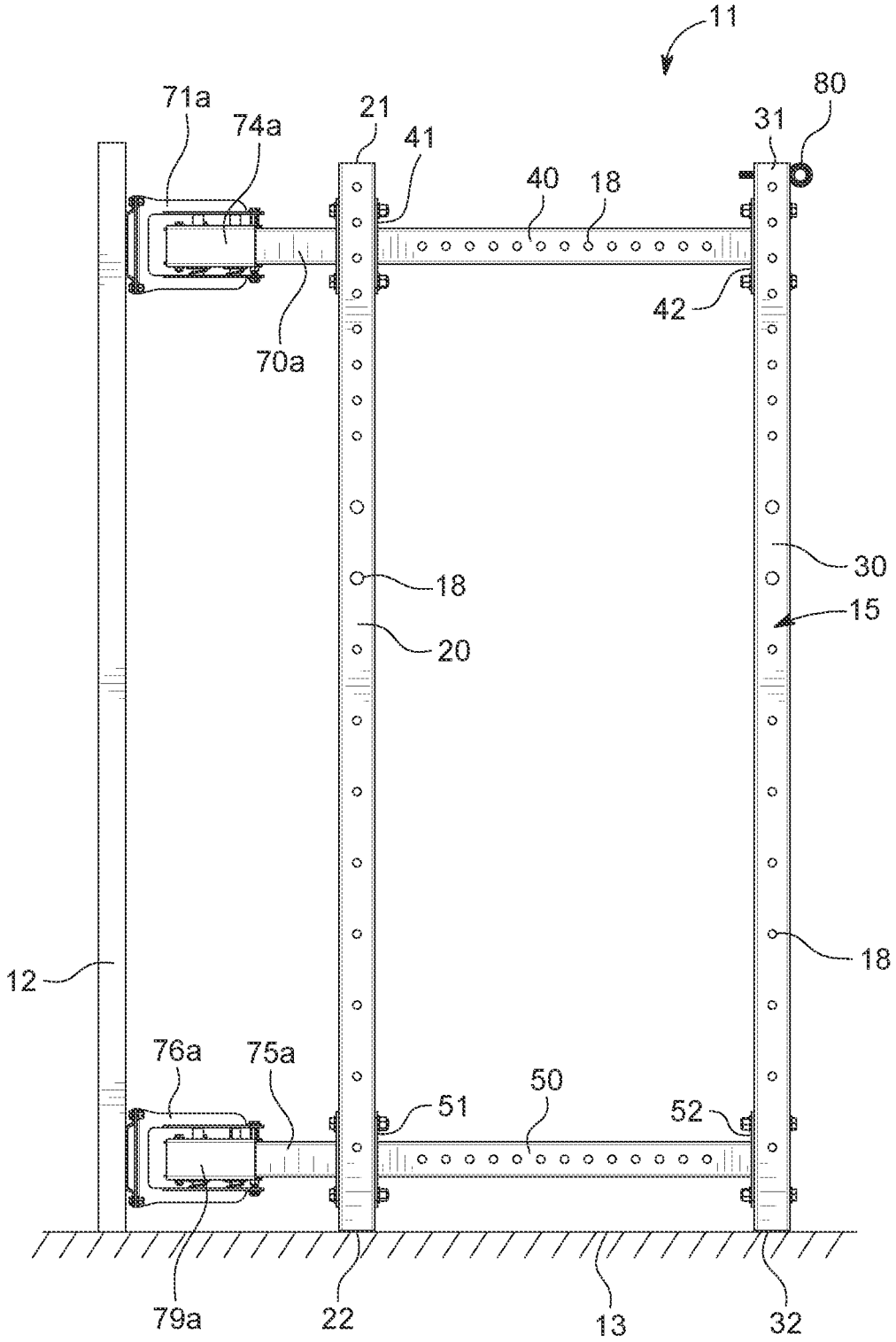
FIG. 15 is a side view of a folding exercise rack system in an extended position in accordance with a second exemplary embodiment.
Figure 16:
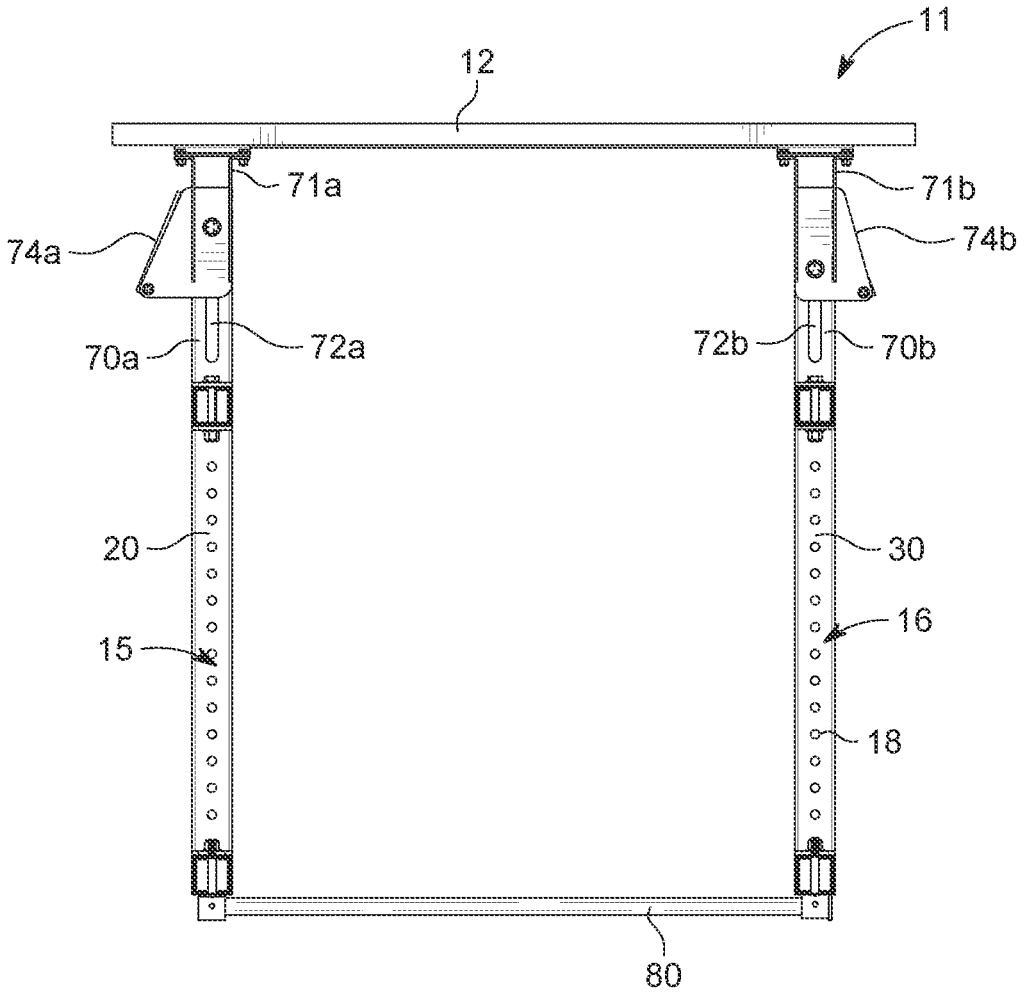
FIG. 16 is a top view of a folding exercise rack system in an extended position in accordance with a second exemplary embodiment.
Figure 17:
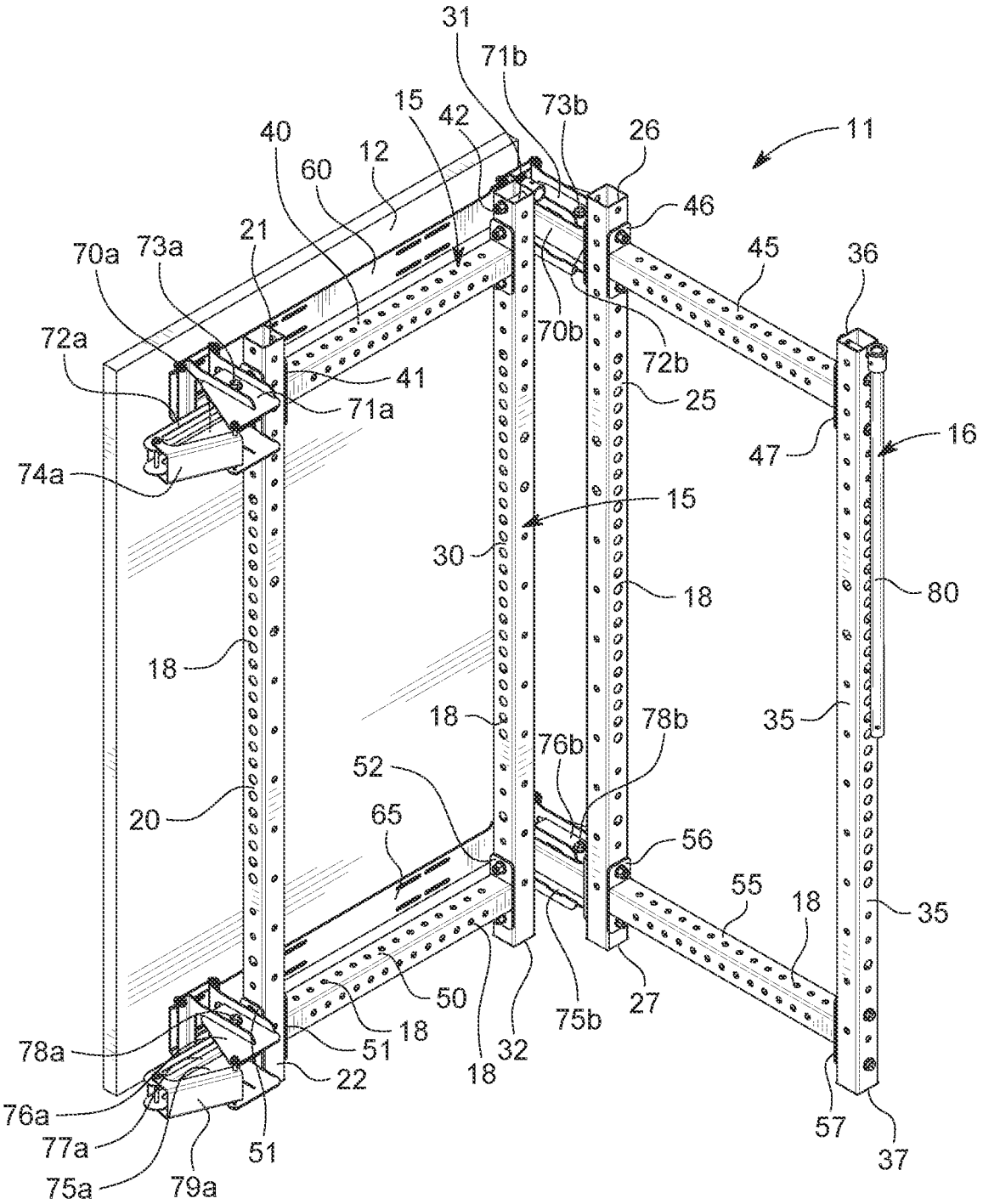
FIG. 17 is a perspective view of a folding exercise rack system during adjustment between retracted and extended positions in accordance with a second exemplary embodiment.
Figure 18:
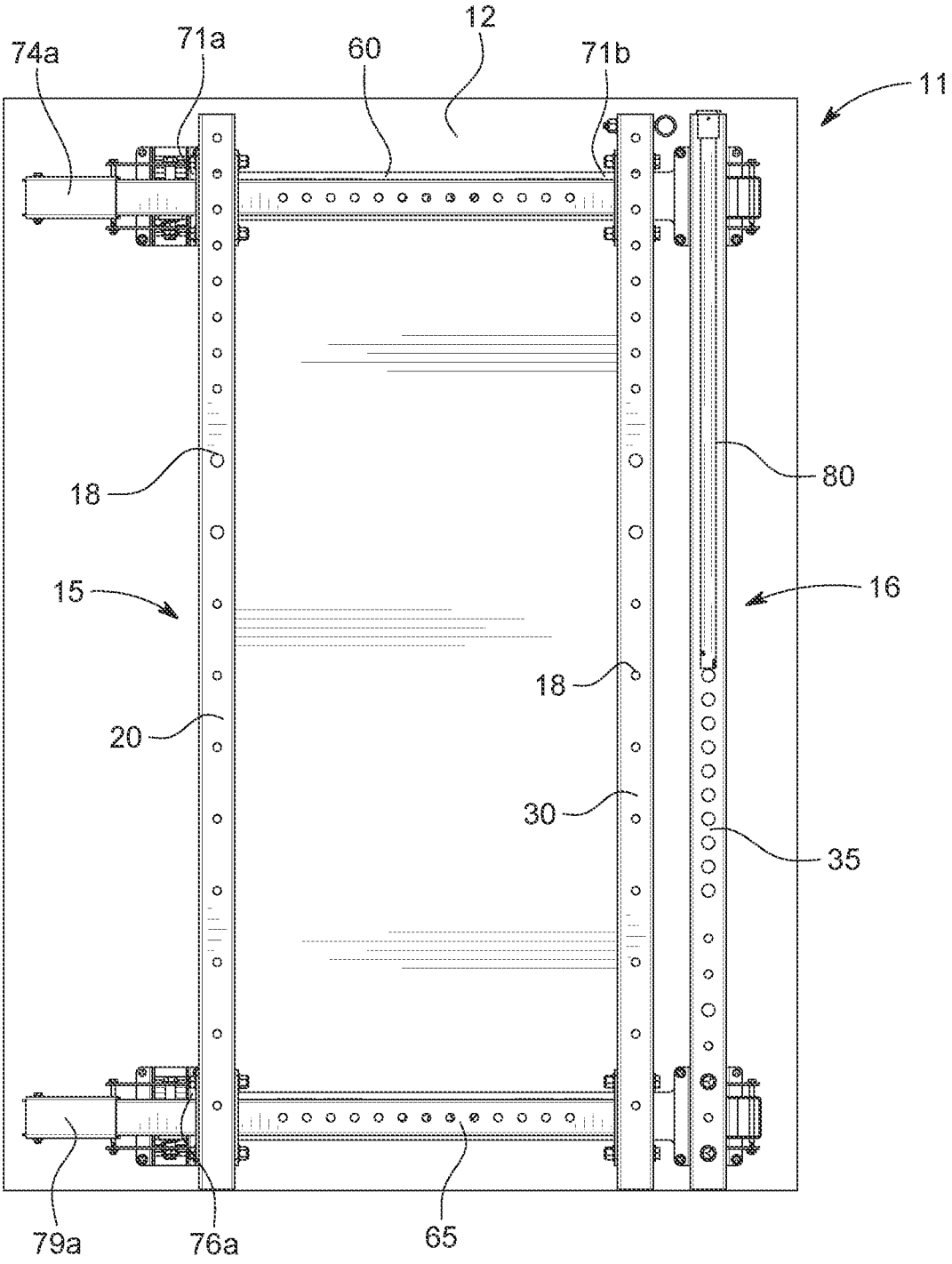
FIG. 18 is a front view of a folding exercise rack system during adjustment between retracted and extended positions in accordance with a second exemplary embodiment.
Figure 19:
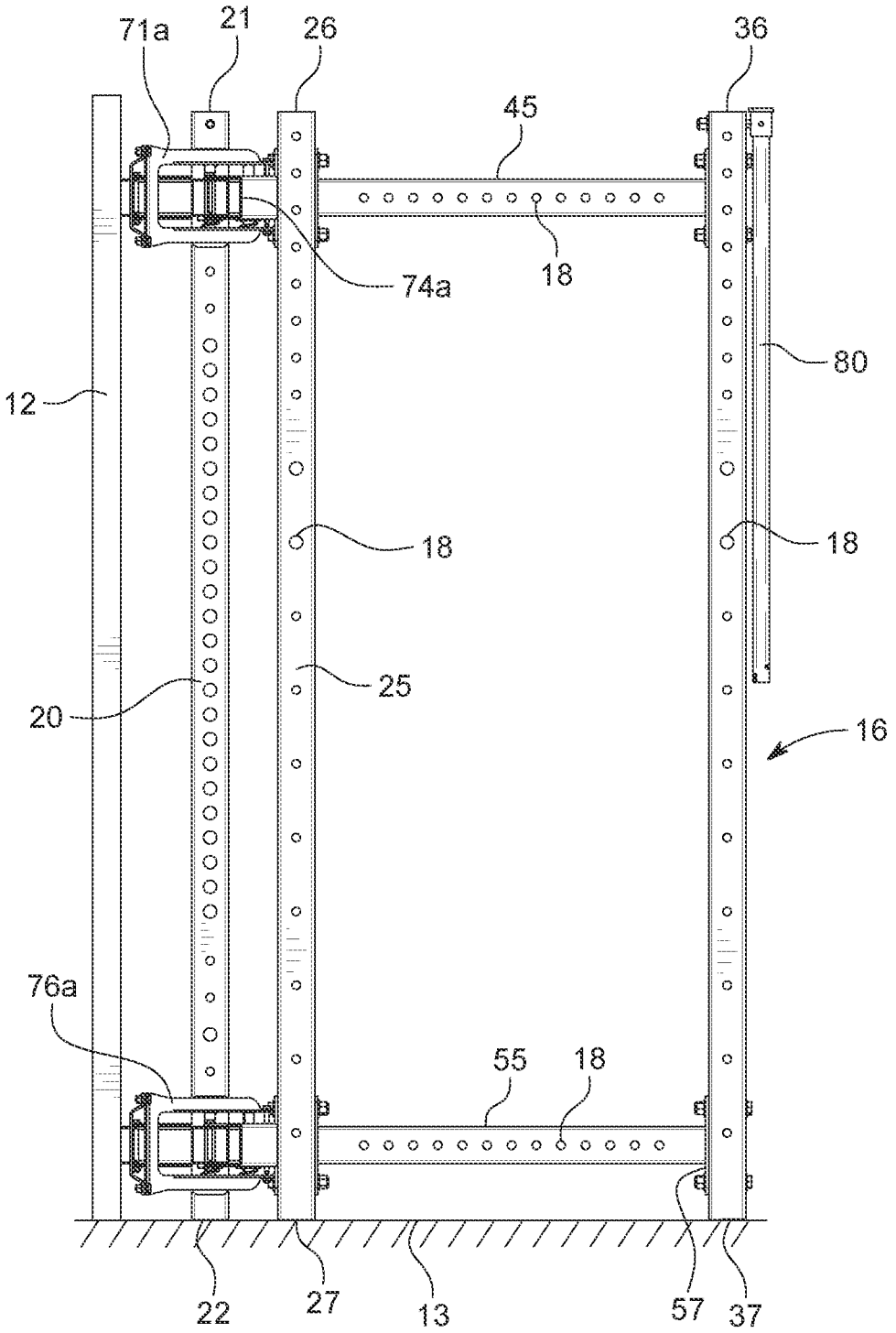
FIG. 19 is a side view of a folding exercise rack system during adjustment between retracted and extended positions in accordance with a second exemplary embodiment.
Figure 20:
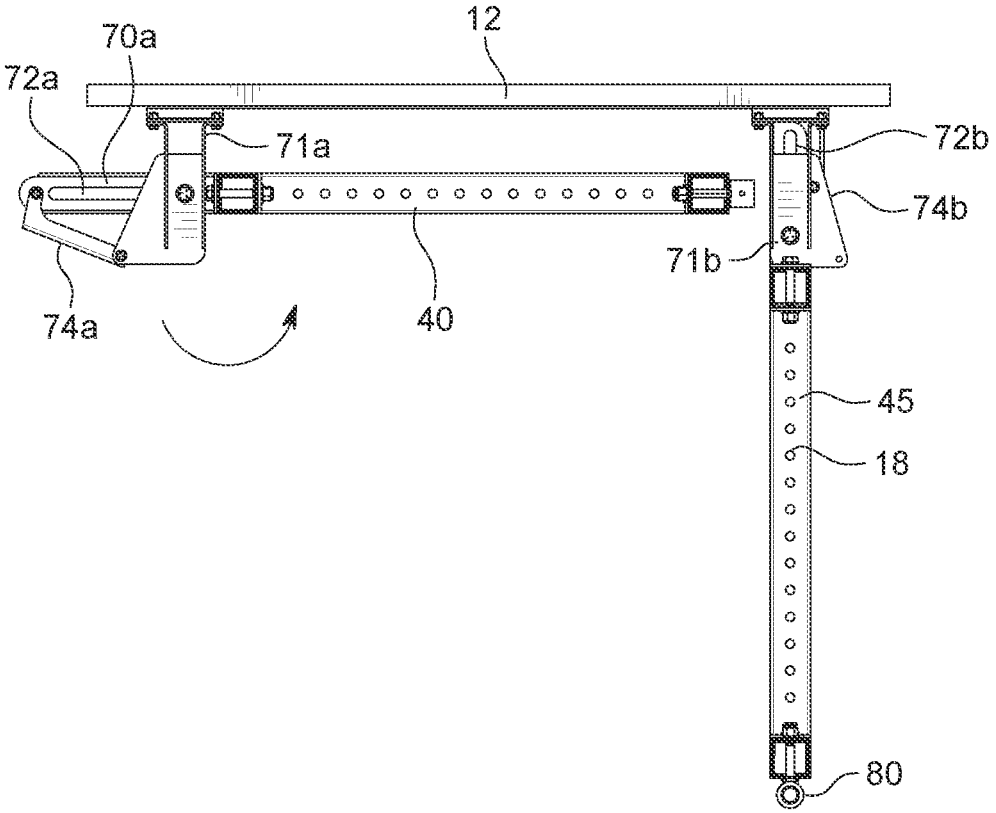
FIG. 20 is a top view of a folding exercise rack system during adjustment between retracted and extended positions in accordance with a second exemplary embodiment.
Figure 21:
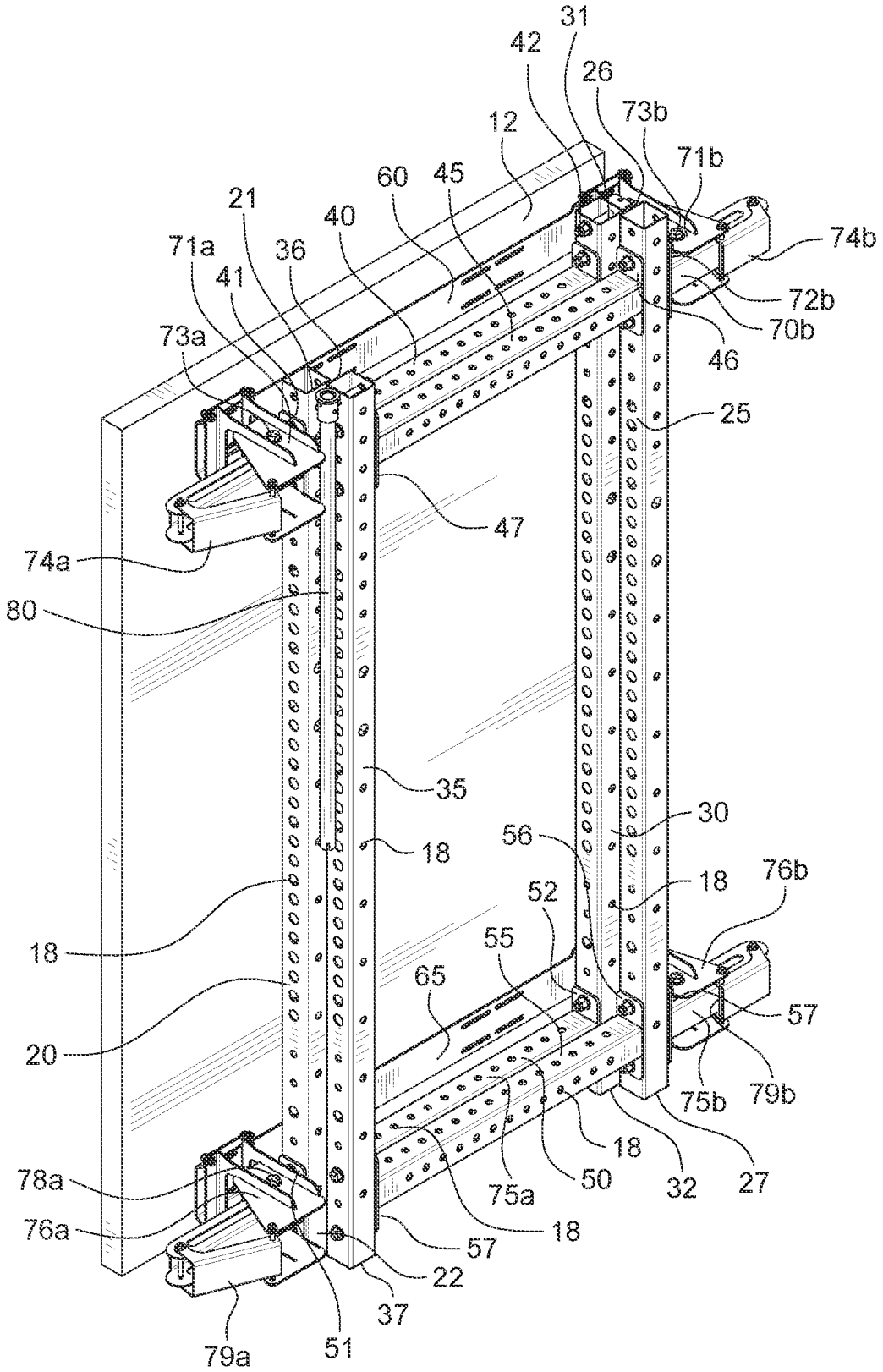
FIG. 21 is a perspective view of a folding exercise rack system in a retracted position in accordance with a second exemplary embodiment.
Figure 22:
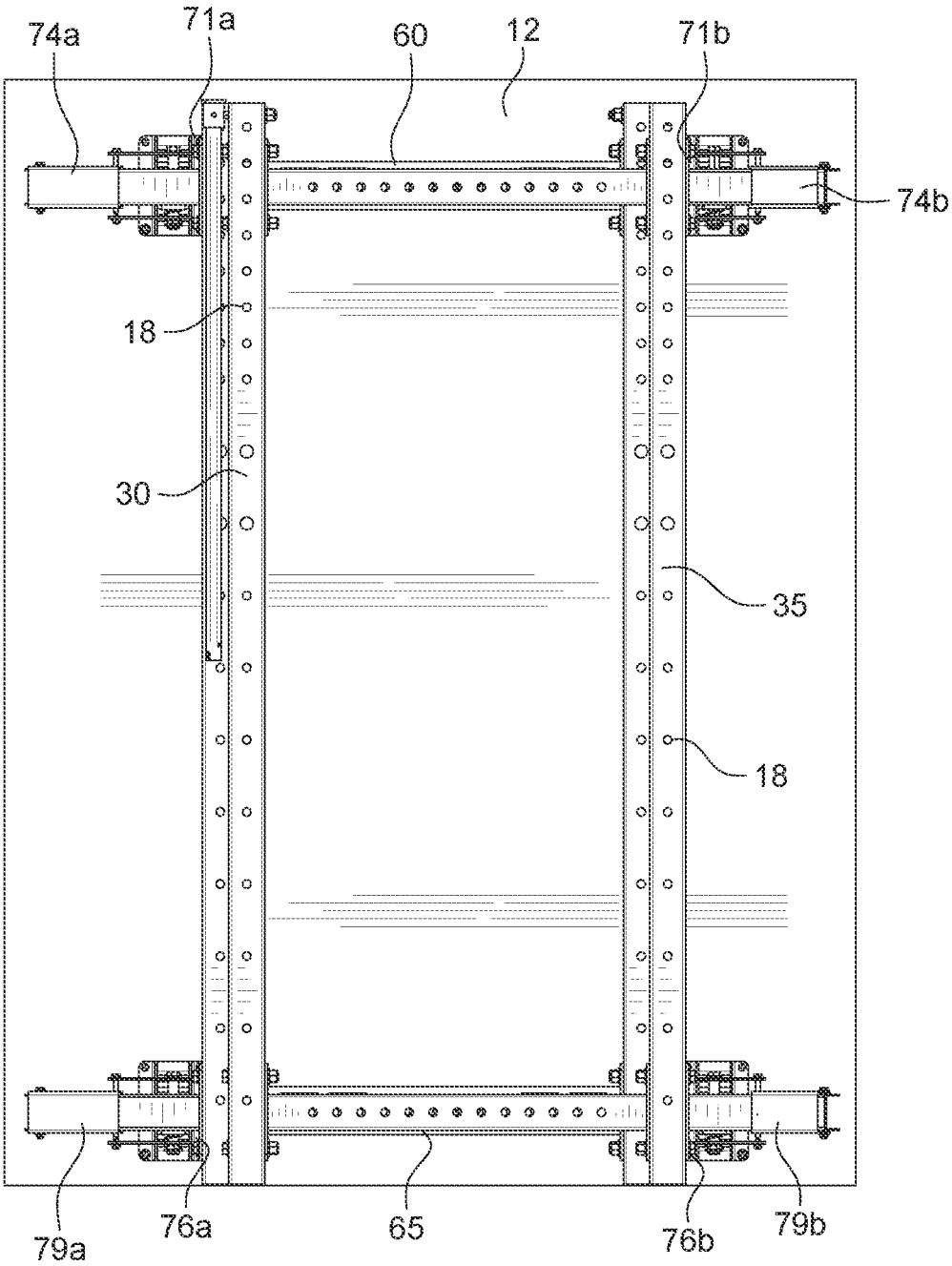
FIG. 22 is a front view of a folding exercise rack system in a retracted position in accordance with a second exemplary embodiment.
Figure 23:
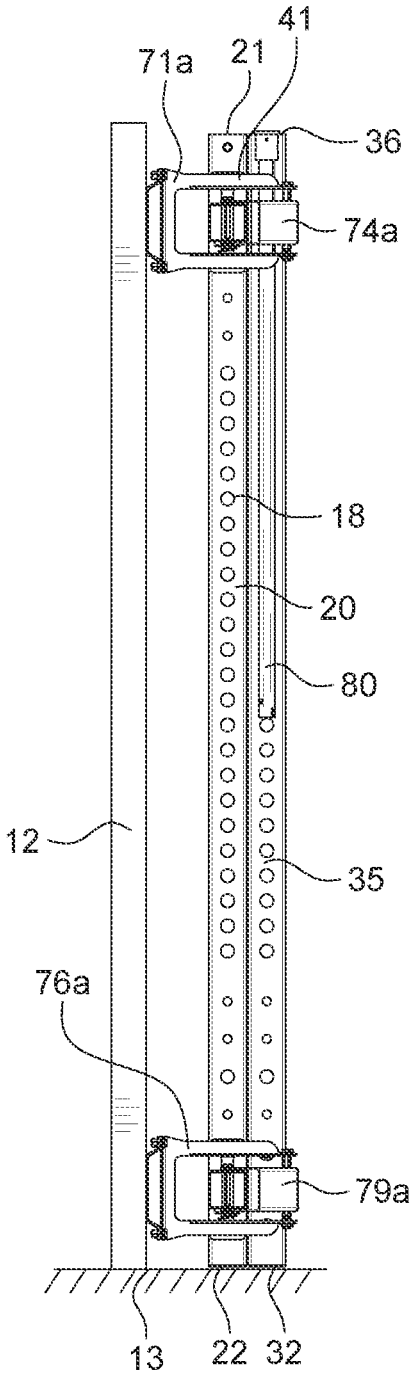
FIG. 23 is a side view of a folding exercise rack system in a retracted position in accordance with a second exemplary embodiment.
Figure 24:
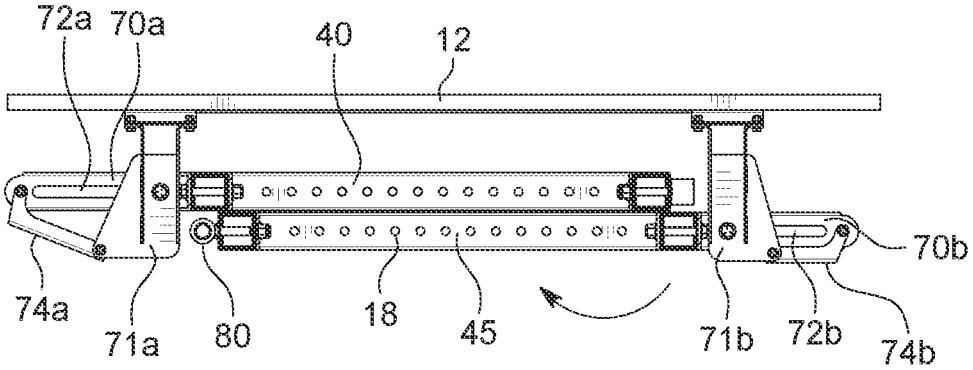
FIG. 24 is a top view of a folding exercise rack system in a retracted position in accordance with a second exemplary embodiment.
Figure 25:
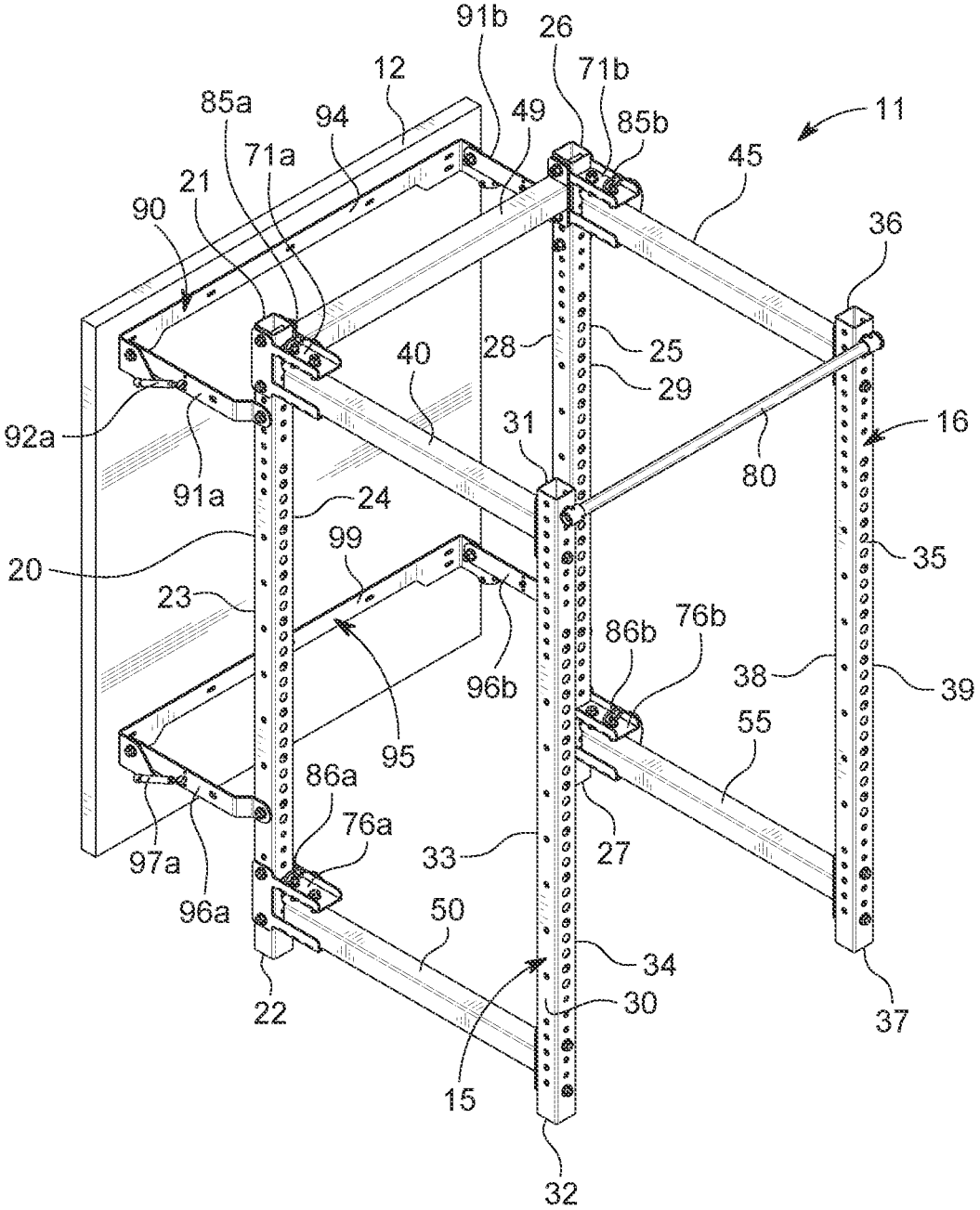
FIG. 25 is a perspective view of a folding exercise rack system in an extended position in accordance with a third exemplary embodiment.
Figure 26:
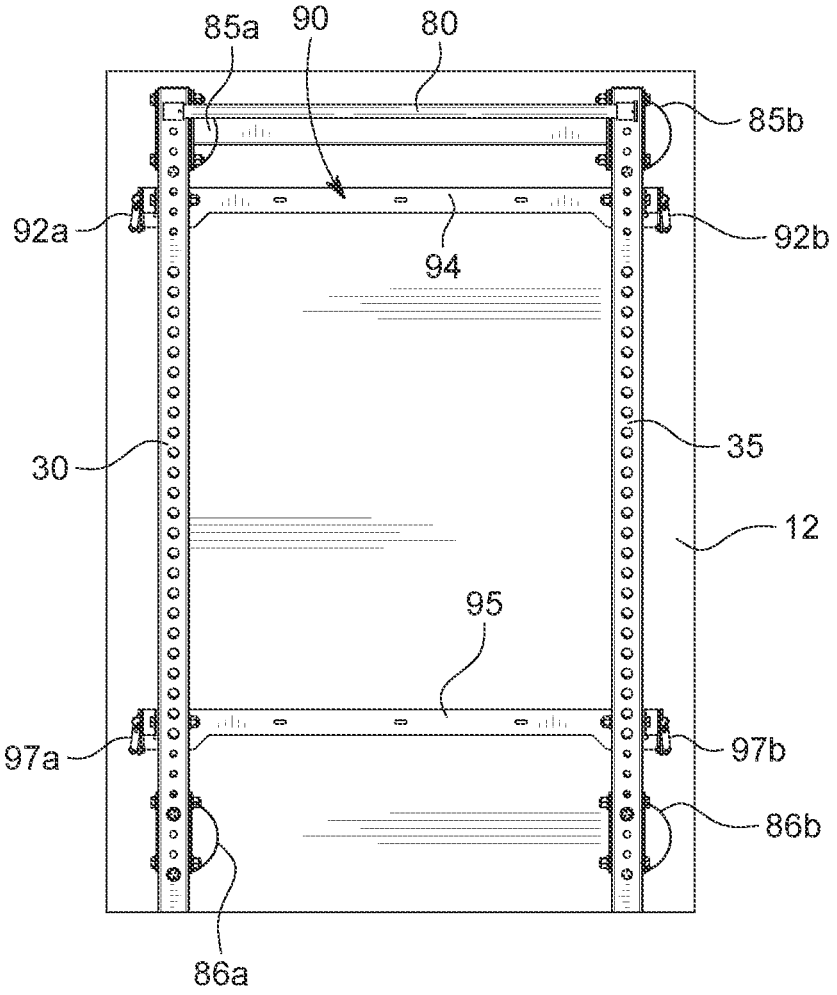
FIG. 26 is a front view of a folding exercise rack system in an extended position in accordance with a third exemplary embodiment.
Figure 27:
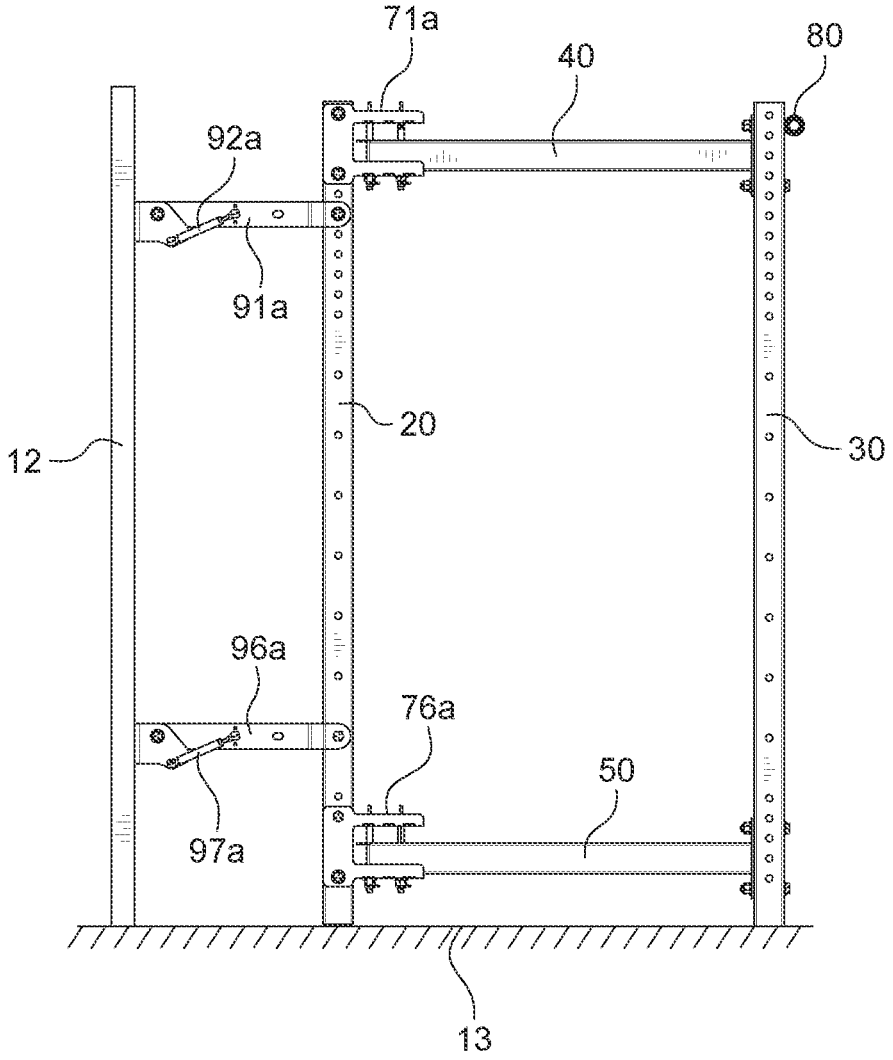
FIG. 27 is a side view of a folding exercise rack system in an extended position in accordance with a third exemplary embodiment.
Figure 28:
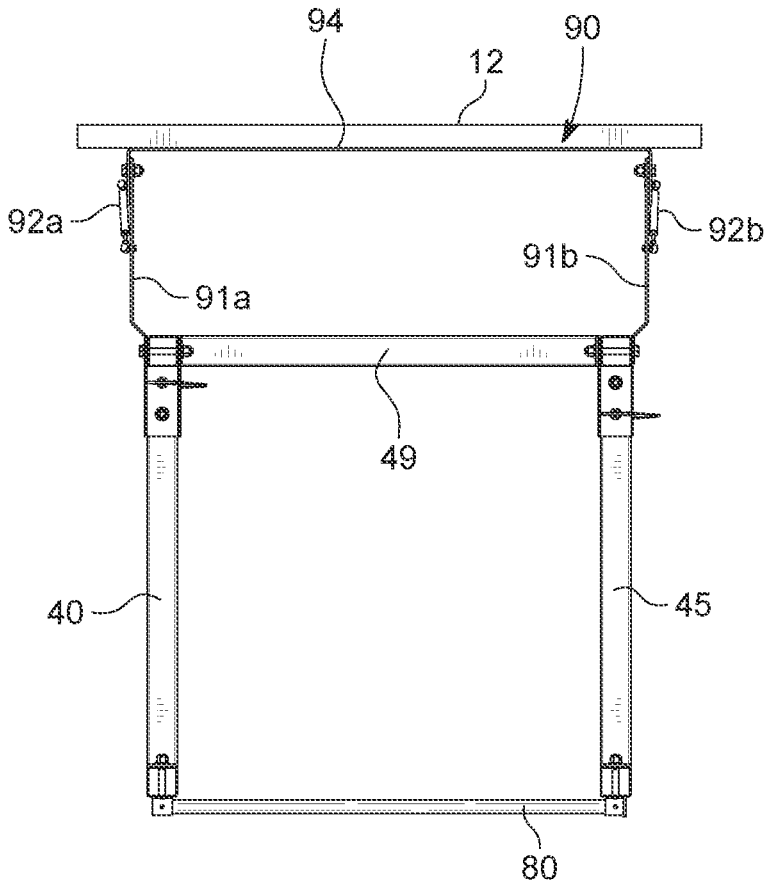
FIG. 28 is a top view of a folding exercise rack system in an extended position in accordance with a third exemplary embodiment.
Figure 29:
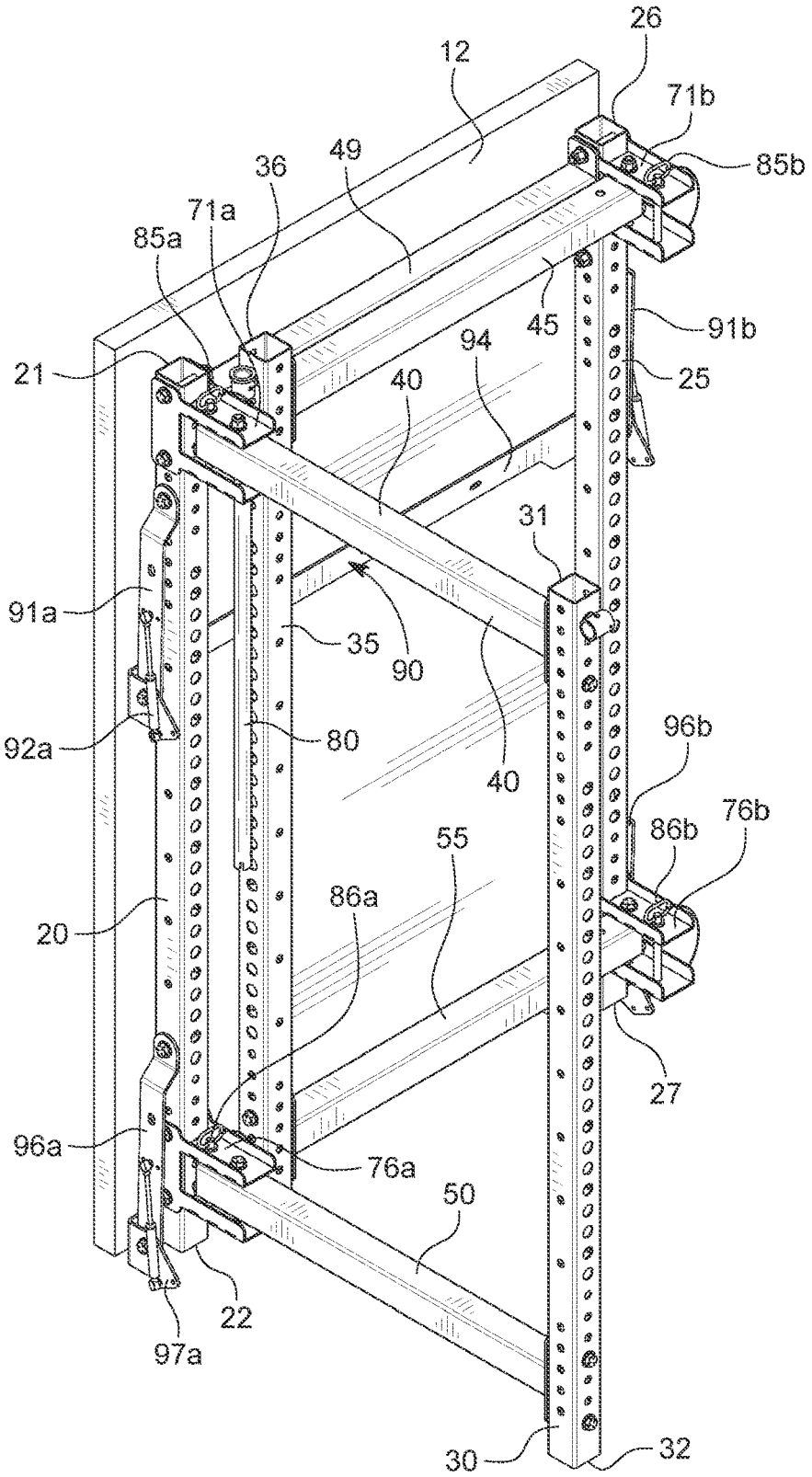
FIG. 29 is a perspective view of a folding exercise rack system during adjustment between retracted and extended positions in accordance with a third exemplary embodiment.
Figure 30:
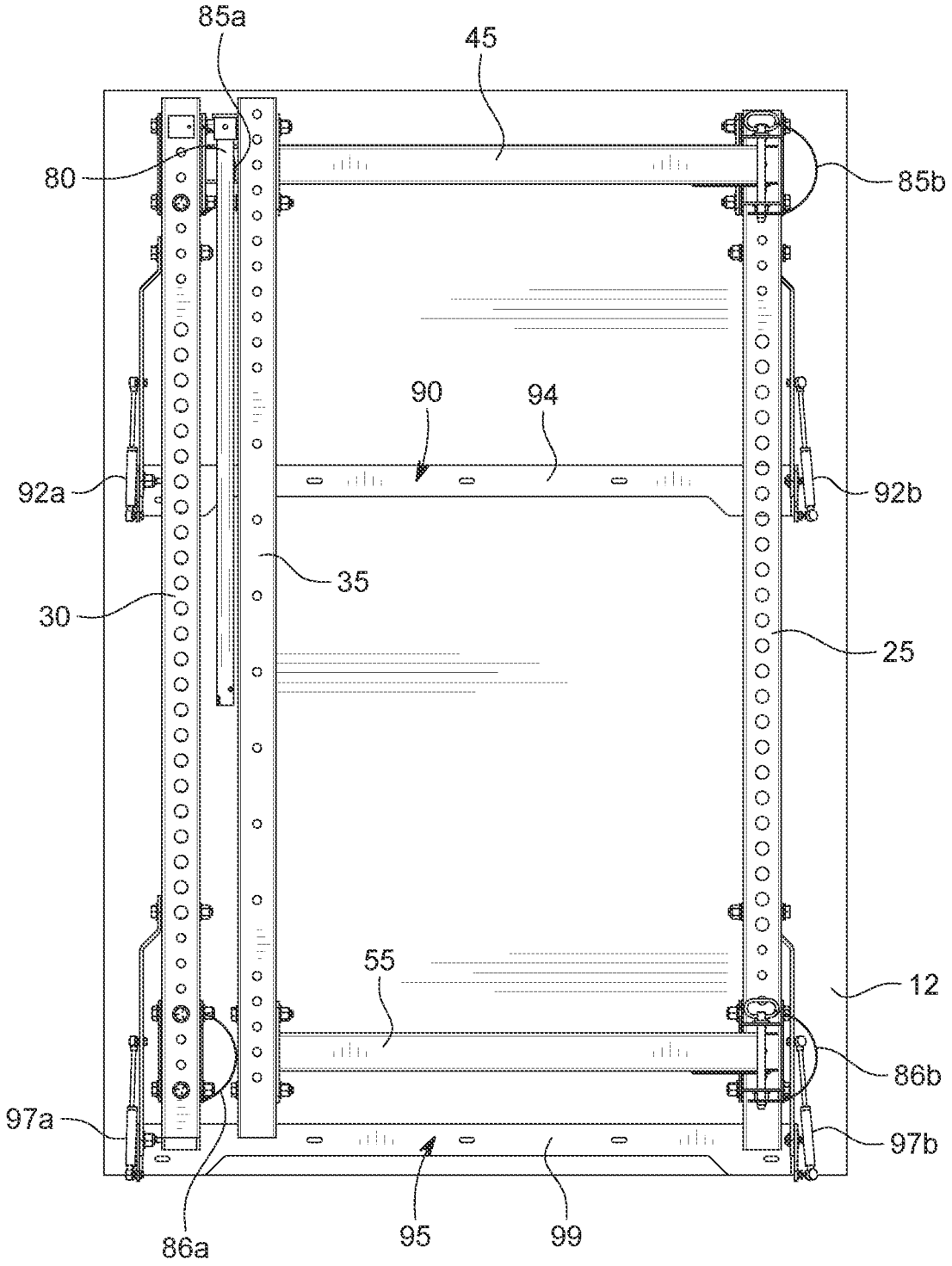
FIG. 30 is a front view of a folding exercise rack system during adjustment between retracted and extended positions in accordance with a third exemplary embodiment.
Figure 31:
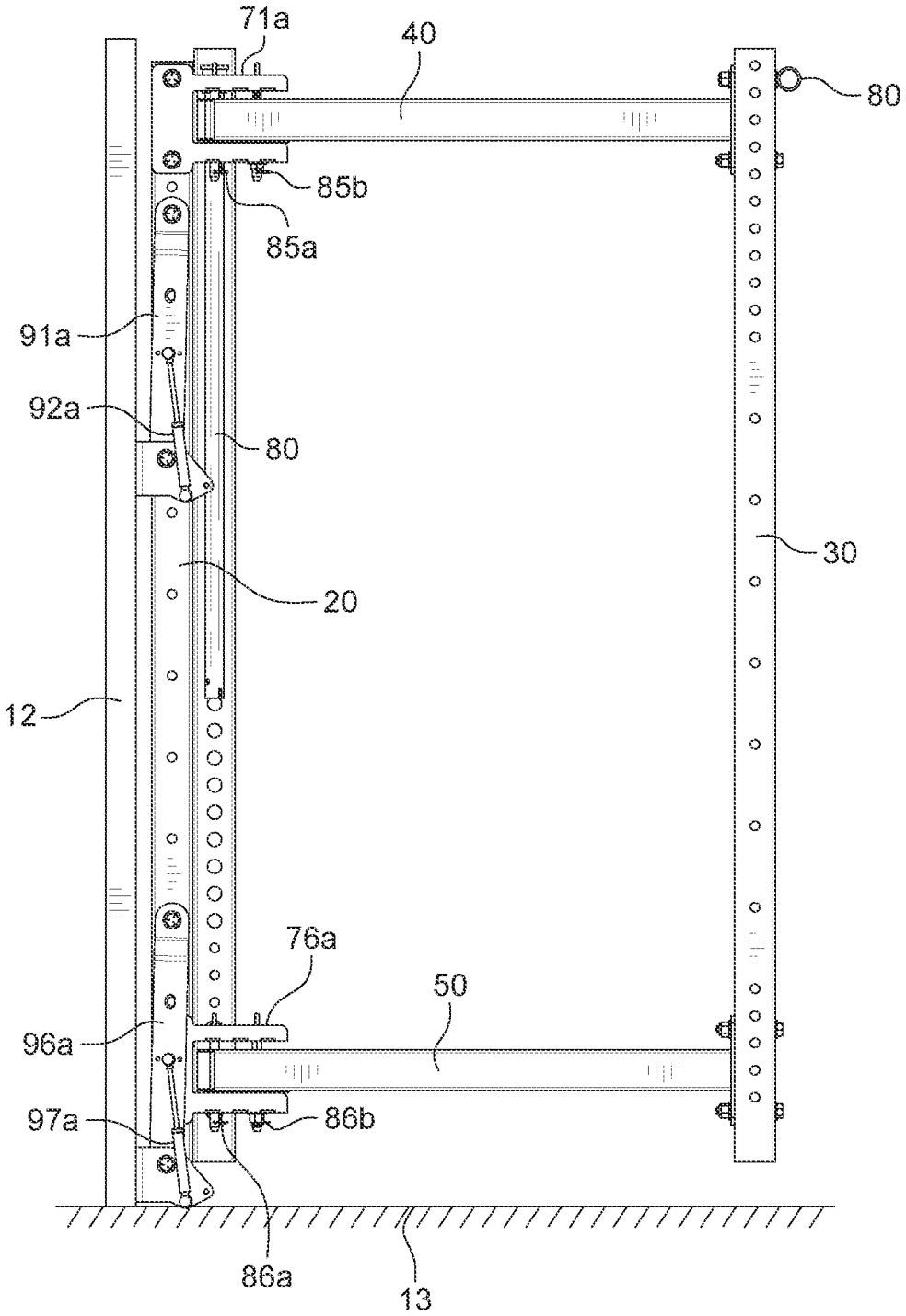
FIG. 31 is a side view of a folding exercise rack system during adjustment between retracted and extended positions in accordance with a third exemplary embodiment.
Figure 32:
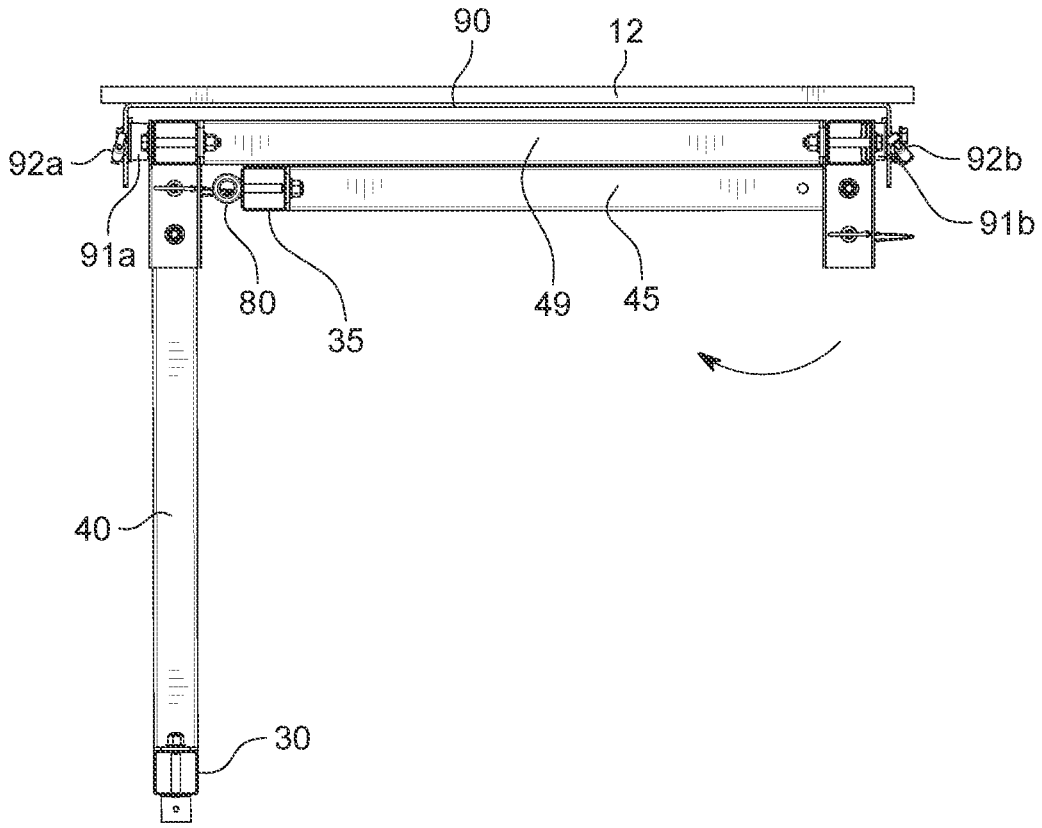
FIG. 32 is a top view of a folding exercise rack system during adjustment between retracted and extended positions in accordance with a third exemplary embodiment.
Figure 33:
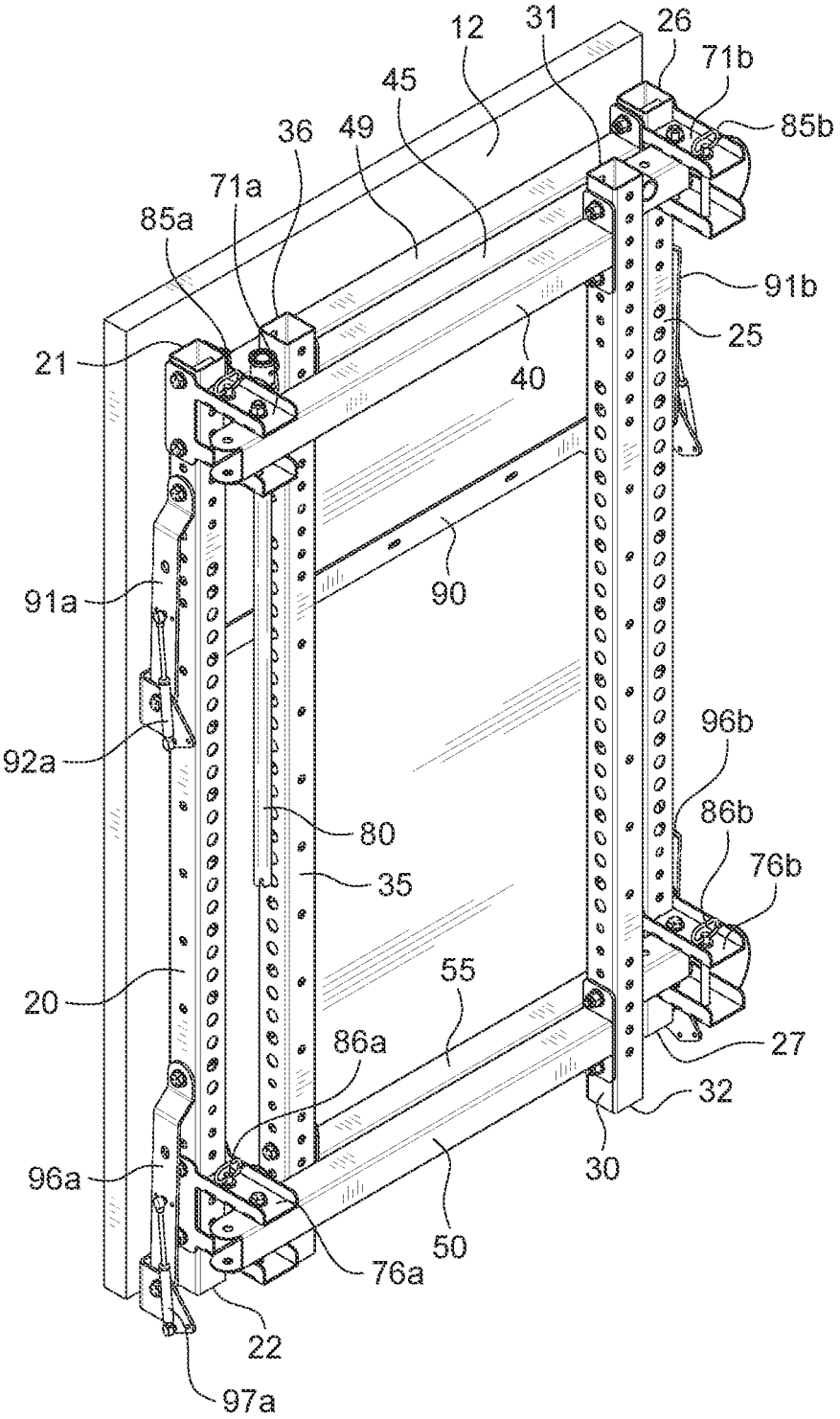
FIG. 33 is a perspective view of a folding exercise rack system in a retracted position in accordance with a third exemplary embodiment.
Figure 34:
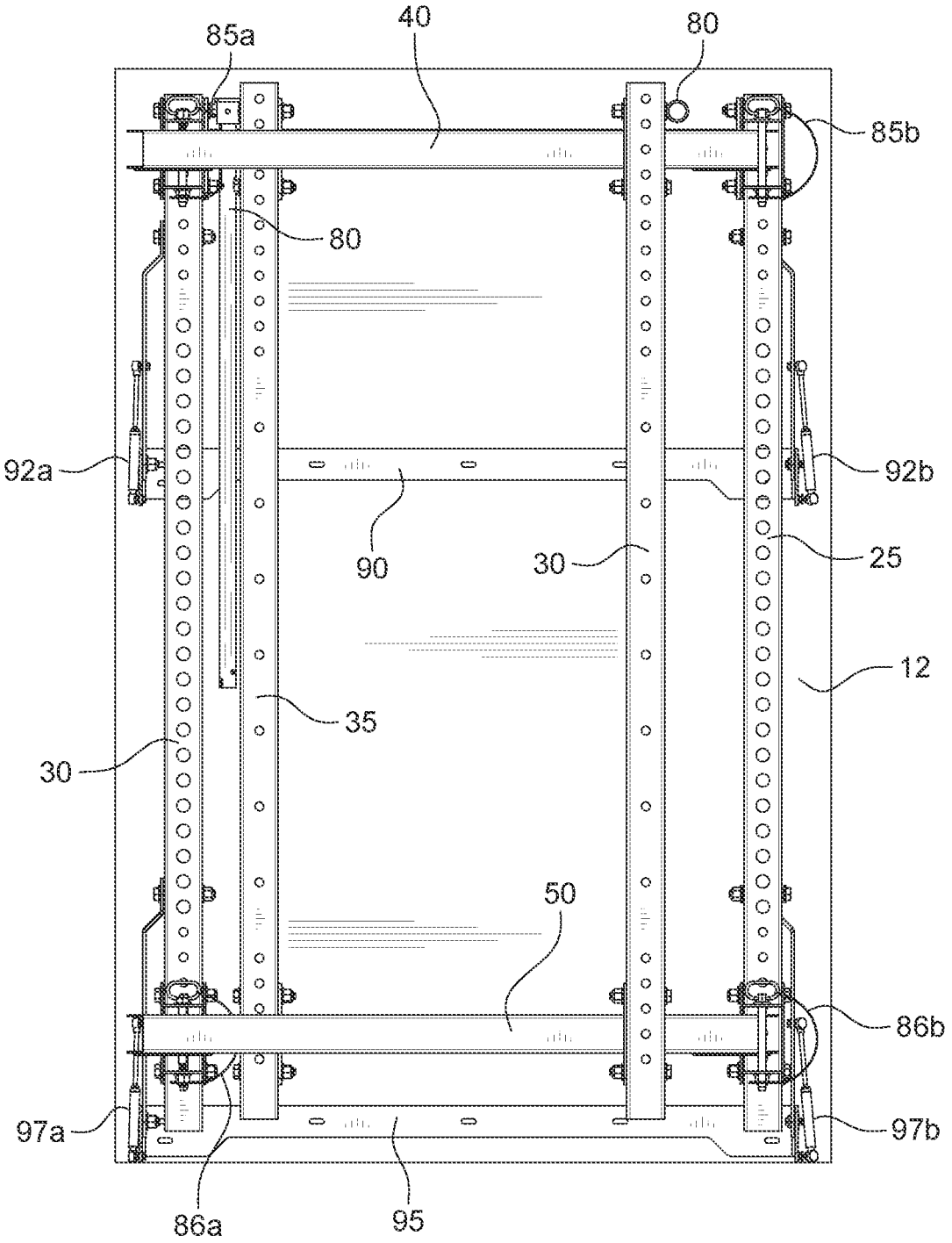
FIG. 34 is a front view of a folding exercise rack system in a retracted position in accordance with a third exemplary embodiment.
Figure 35:
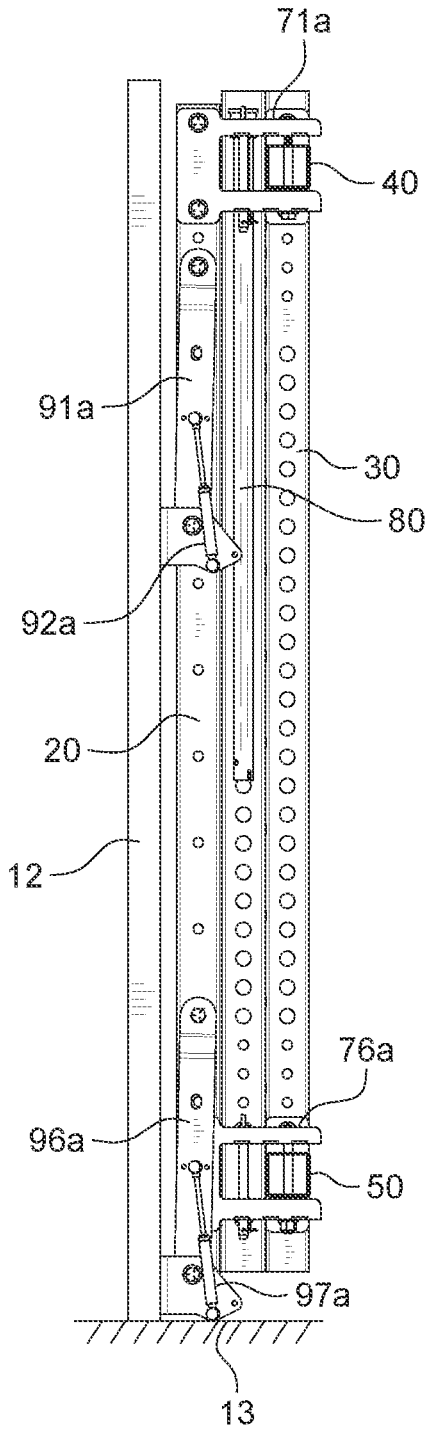
FIG. 35 is a side view of a folding exercise rack system in a retracted position in accordance with a third exemplary embodiment.

As best shown in FIGS. 13, 17, and 21, a first upper linkage **70*a* is pivotably connected between the first upper hinge 71*a* and the first inner support member 20, a second upper linkage 70*b* is pivotably connected between the second upper hinge 71*b* and the second inner support member 25, a first lower linkage 75*a* is pivotably connected between the first lower hinge 76*a* and the first inner support member 20, and a second lower linkage 75*b* is pivotably connected between the second lower hinge 76*b* and the second inner support member 25. The number of linkages 70*a*, 70*b*, 75*a*, 75*b* and/or hinges 71*a*, 71*b*, 76*a*, 76*b*** may vary in different embodiments.

Continuing to reference FIGS. 13, 17, and 21, it can be seen that the first upper linkage **70*a* may be comprised of an elongated member including a first end and a second end. The first end of the first upper linkage 70*a* may be pivotably connected to the first upper hinge 71*a* and the second end of the first upper linkage 70*a* may be connected in a non-movable manner to the first inner support member 20 near its upper end 21. However, in some embodiments, the second end of the first upper linkage 70*a* may be secured to various other positions along the length of the first inner support member 20. As shown in the figures, a bracket, fasteners, and/or other connecting devices may be utilized to secure the second end of the first upper linkage 70*a* to the first inner support member 20**.

The length of the first upper linkage 70*a* may vary in different embodiments. The figures illustrate an embodiment in which the length of the first upper linkage 70*a* is approximately a quarter of the length of the first upper arm 40. It should be appreciated that the ratio of lengths between the first upper linkage 70*a* and the first upper arm 40 may vary in different embodiments and thus should not be construed as limited by the exemplary figures.

As best shown in FIGS. 13, 17, and 21, the first upper hinge 71*a* may include a first upper pin 73*a* and the first upper linkage 70*a* may include a first upper slot 72*a*. The first upper pin 73*a* may be positioned within the first upper slot 72*a* such that the first upper pin 73*a* may slide within the first upper slot 72*a*. A first upper guide member 74*a* may be pivotably connected between the first upper linkage 70*a* and the first upper hinge 71*a*, with the first upper guide member 74*a* functioning to guide pivotal movement of the first upper linkage 70*a* with respect to the first upper hinge 71*a*.

With reference to FIGS. 13-24, it can be seen that the first lower linkage 75*a* may be comprised of an elongated member including a first end and a second end. The first end of the first lower linkage 75*a* may be pivotably connected to the first lower hinge 76*a* and the second end of the first lower linkage 75*a* may be connected in a non-movable manner to the first inner support member 20 near its lower end 22. However, in some embodiments, the second end of the first lower linkage 75*a* may be secured to various other positions along the length of the first inner support member 20. As shown in the figures, a bracket, fasteners, and/or other connecting devices may be utilized to secure the second end of the first lower linkage 75*a* to the first inner support member 20.

The length of the first lower linkage 75*a* may vary in different embodiments. The figures illustrate an embodiment in which the length of the first lower linkage 75*a* is approximately a quarter of the length of the first lower arm 50. It should be appreciated that the ratio of lengths between the first lower linkage 75*a* and the first lower arm 50 may vary in different embodiments and thus should not be construed as limited by the exemplary figures.

As shown in FIGS. 13-24, the first lower hinge 76*a* may include a first lower pin 78*a* and the first lower linkage 75*a* may include a first lower slot 77*a*. The first lower pin 78*a* may be positioned within the first lower slot 77*a* such that the first lower pin 78*a* may slide within the first lower slot 77*a*. A first lower guide member 79*a* may be pivotably connected between the first lower linkage 75*a* and the first lower hinge 76*a*, with the first lower guide member 79*a* functioning to guide pivotal movement of the first lower linkage 75*a* with respect to the first lower hinge 76*a*.

Continuing to reference FIGS. 13-24, it can be seen that the second upper linkage 70*b* may be comprised of an elongated member including a first end and a second end. The first end of the second upper linkage 70*b* may be pivotably connected to the second upper hinge 71*b* and the second end of the second upper linkage 70*b* may be connected in a non-movable manner to the second inner support member 25 near its upper end 26. However, in some embodiments, the second end of the second upper linkage 70*b* may be secured to various other positions along the length of the second inner support member 25. As shown in the figures, a bracket, fasteners, and/or other connecting devices may be utilized to secure the second end of the second upper linkage 70*b* to the second inner support member 25.

The length of the second upper linkage 70*b* may vary in different embodiments. The figures illustrate an embodiment in which the length of the second upper linkage 70*b* is approximately a quarter of the length of the second upper arm 45. It should be appreciated that the ratio of lengths between the second upper linkage 70*b* and the second upper arm 45 may vary in different embodiments and thus should not be construed as limited by the exemplary figures.

As shown in FIGS. 13-24, the second upper hinge 71*b* may include a second upper pin 73*b* and the second upper linkage 70*b* may include a second upper slot 72*b*. The second upper pin 73*b* may be positioned within the second upper slot 72*b* such that the second upper pin 73*b* may slide within the second upper slot 72*b*. A second upper guide member 74*b* may be pivotably connected between the second upper linkage 70*b* and the second upper hinge 71*b*, with the second upper guide member 74*b* functioning to guide pivotal movement of the second upper linkage 70*b* with respect to the second upper hinge 71*b*.

With reference to FIGS. 13-24, it can be seen that the second lower linkage 75*b* may be comprised of an elongated member including a first end and a second end. The first end of the second lower linkage 75*b* may be pivotably connected to the second lower hinge 76*b* and the second end of the second lower linkage 75*b* may be connected in a non-movable manner to the second inner support member 25 near its lower end 27. However, in some embodiments, the second end of the second lower linkage 75*b* may be secured to various other positions along the length of the second inner support member 25. As shown in the figures, a bracket, fasteners, and/or other connecting devices may be utilized to secure the second end of the second lower linkage 75*b* to the second inner support member 25.

The length of the second lower linkage 75*b* may vary in different embodiments. The figures illustrate an embodiment in which the length of the second lower linkage 75*b* is approximately a quarter of the length of the second lower arm 55. It should be appreciated that the ratio of lengths between the second lower linkage 75*b* and the second lower arm 55 may vary in different embodiments and thus should not be construed as limited by the exemplary figures.

As best shown in FIGS. 13-24, the second lower hinge 76*b* may include a second lower pin 78*b* and the second lower linkage 75*b* may include a second lower slot 77*b*. The second lower pin 78*b* may be positioned within the second lower slot 77*b* such that the second lower pin 78*b* may slide within the second lower slot 77*b*. A second lower guide member 79*b* may be pivotably connected between the second lower linkage 75*b* and the second lower hinge 76*b*, with the second lower guide member 79*b* functioning to guide pivotal movement of the second lower linkage 75*b* with respect to the second lower hinge 76*b*.

E. Third Exemplary Embodiment (FIGS. 25-36)

FIGS. 25-36 illustrate a third exemplary embodiment of a folding exercise rack system. As shown in the figures, the third exemplary embodiment includes an exercise rack 11 comprised of a first frame 15 comprised of a first inner support member 20, a first outer support member 30, a first upper arm 40 connected near the respective upper ends 21, 31 of the first inner support member 20 and the first outer support member 30, and a first lower arm 50 connected near the respective lower ends 22, 32 of the first inner support member 20 and the first outer support member 30.

Continuing to reference FIGS. 25-36, a second frame 16 is shown in a distally-spaced position along the wall 12 from the first frame 15. The second frame 16 may comprise a second inner support member 25, a second outer support member 35, a second upper arm 45 connected near the respective upper ends 26, 36 of the second inner support member 25 and the second outer support member 35, and a second lower arm 55 connected near the respective lower ends 27, 37 of the second inner support member 25 and the second outer support member 35.

As best shown in FIGS. 25-28, the first and second frames 15, 16, which form an exercise rack 11, may be interconnected by an inner cross bar 49. The inner cross bar 49 may be connected between a point near the respective upper ends 21, 26 of the first and second inner support members 20, 25 as shown in FIGS. 25, 26, 29, 30, 34, and 35. However, in other embodiments, the inner cross bar 49 may be positioned at various other positions along the length of the first and second inner support members 20, 25. In other embodiments, the inner cross bar 49 may be omitted entirely (in such embodiments, the first and second frames 15, 16 may not be interconnected with each other).

Generally, the exercise rack 11 shown in FIGS. 25-36 may be adjusted between an extended position and a retracted (e.g., folded) position. The manner by which the exercise rack 11 is adjusted may vary in different embodiments. As shown in FIGS. 29-32, the first upper arm 40, the first lower arm 50, and the first outer support member 30 are each pivoted inwardly or outwardly about the first inner support member 20. Similarly, the second upper arm 45, the second lower arm 55, and the second outer support member 35 are each pivoted inwardly or outwardly about the second inner support member 25.

In the figures, it is shown that the second upper arm 45, second lower arm 55, and second outer support member 35 are pivoted inwardly first, with the first upper arm 40, first lower arm 50, and first outer support member 30 being pivoted second to rest upon the first frame 15. It should be appreciated, however, that the reverse order may be utilized in some embodiments.

In the extended position as shown in FIGS. 25-28, the first upper and lower arms 40, 50 are locked in a position perpendicular to the wall 12 and the first outer support member 30 is distally positioned away from the wall 12. Similarly, in the extended position, the second upper and lower arms 45, 55 are locked in a positioned perpendicular to the wall 12 and the second outer support member 35 is distally positioned away from the wall 12.

In the retracted (e.g., folded) position as shown in FIGS. 33-36, the first upper and lower arms 40, 50 are locked in a position parallel to the wall 12 and the first outer support member 30 is positioned adjacent to the wall 12. Similarly, in the retracted (e.g., folded) position, the second upper and lower arms 45, 55 are locked in a position parallel to the wall 12 and the second outer support member 35 is positioned adjacent to the wall 12. More specifically, it can be seen that, in the retracted (e.g., folded) position, the second outer support member 35, the second upper arm 45, and the second lower arm 55 each rest against the inner cross bar 49. In such a position, the first outer support member 30, the first upper arm 40, and the first lower arm 50 each rest against the second upper and lower arms 45, 55.

FIGS. 25-28 illustrate the exercise rack 11 in an extended position, in which the first and second frames 15, 16 are each extended perpendicular to the wall 12 such that the first and second outer support members 30, 35 are distally spaced away from the wall 12. Thus, the upper and lower arms 40, 45, 50, 55 are shown as being each positioned perpendicularly with respect to the wall 12 and the inner cross bar 49. In such an extended position, the exercise rack 11 is ready for use.

FIGS. 29-32 illustrate the exercise rack 11 midway through being adjusted into the retracted (e.g., folded) position. As shown, the second upper arm 45, the second lower arm 55, and the second outer support member 35 have been pivoted inwardly towards the wall 12, with the second upper and lower arms 45, 55 being parallel to the wall 12. The first upper arm 40, the first lower arm 50, and the first outer support member 30 have not yet been pivoted inwardly, and thus the first upper and lower arms 40, 50 remain perpendicular to the wall 12.

FIGS. 33-36 illustrate the exercise rack 11 in the retracted (e.g., folded) position. As shown in FIGS. 33-36, the second outer support member 35, the second upper arm 45, and the second lower arm 55 have been pivoted inwardly about the second inner support member 25 to be positioned adjacent to and parallel with respect to the wall 12, with the second upper arm 45 resting against the inner cross bar 49. The first outer support member 30, the first upper arm 40, and the first lower arm 50 have been pivoted inwardly about the first inner support member 20 to be positioned parallel with respect to the wall 12, with the first upper arm 40 resting against the second upper arm 45. Such a position may be desirable when the exercise rack 11 is not in use so as to not take up valuable space in an exercise space (e.g., home gym, garage, exercise studio, or the like).

As shown throughout FIGS. 25-36, the exercise rack 11 itself may be adjustable with respect to the wall 12 between an extended position in which the first inner support member 20 and the second inner support member 25 are distally positioned away from the wall and a retracted position in which the first inner support member 20 and the second inner support member 25 are positioned adjacent to the wall 12.

The manner by which the exercise rack 11 is so adjusted with respect to the wall 12 may vary. In the embodiment shown in FIGS. 25-36, the inner support members 20, 25 are each adapted to be raised into the retracted position and lowered into the extended position. By way of non-limiting example, one or more brackets 90, 95 may be connected between the inner support members 20, 25 and the wall 12.

As shown in FIGS. 25-36, the exercise rack 11 may be adjustably connected to the wall 12 by one or more brackets 90, 95. Although the figures illustrate usage of a pair of brackets 90, 95, it should be appreciated that, in some embodiments (e.g., compact embodiments or embodiments utilizing lightweight materials), only a single bracket 90, 95 may be utilized. In other embodiments, additional brackets 90, 95 (e.g., three, four, five, etc.) may be utilized.

In the exemplary embodiment shown in the figures, an upper bracket 90 is connected between the wall 12 and a position at or near the upper ends 21, 26 of the inner support members 20, 25. A lower bracket 95 is connected between the wall 12 and the inner support members 20, 25 below the upper bracket 90. Each of the brackets 90, 95 are adapted to pivot the exercise rack 11 towards the wall 12 or away from the wall 12. In the embodiment shown in the figures, the exercise rack 11 is raised into the retracted position and lowered into the extended position. Such an embodiment functions to raise the exercise rack 11 off of the floor 13 when the exercise rack 11 is retracted such as shown in FIGS. 33-36.

The configuration of the brackets 90, 95 may vary in different embodiments. In the exemplary embodiment shown in FIGS. 25-36, the upper bracket 90 is shown as comprising an upper wall mount 94 which is secured to the wall 12 (e.g., by fasteners) and a pair of arms 91*a*, 91*b* which are each pivotably connected between the upper wall mount 94 and the respective inner support members 20, 25. The pair of arms 91*a*, 91*b* may comprise a first arm 91*a* connected near a first side of the upper wall mount 94 and a second arm 91*b* connected near a second side of the upper wall mount 94.

More specifically, it can be seen that a first arm 91*a* is pivotably connected at its first end to the upper wall mount 94 and is pivotably connected at its second end to the first inner support member 20. Similarly, a second arm 91*b* is pivotably connected at its first end to the upper wall mount 94 and is pivotably connected at its second end to the second inner support member 25. A first shock 92*a* may be connected between the upper wall mount 94 and the first arm 91*a*, and a second shock 92*b* may be connected between the upper wall mount 94 and the second arm 91*b*.

Continuing to reference FIGS. 25-36, it can be seen that the lower bracket 95 may comprise a lower wall mount 99 which is secured to the wall 12 (e.g., by fasteners) and a pair of arms 96*a*, 96*b* which are each pivotably connected between the lower wall mount 99 and the respective inner support members 20, 25. The pair of arms 96*a*, 96*b* may be comprised of a first arm 96*a* which is connected near a first side of the lower wall mount 99 and a second arm 96*b* which is connected near a second side of the lower wall mount 99.

The first arm 96*a* may be pivotably connected at its first end to the lower wall mount 99 and at its second end to the first inner support member 20. Similarly, the second arm 96*b* may be pivotably connected at its first end to the lower wall mount 99 and at its second end to the second inner support member 25. A first shock 97*a* may be connected between the lower wall mount 99 and the first arm 96*a*, and a second shock 97*b* may be connected between the lower wall mount 99 and the second arm 96*b*.

As shown in FIGS. 28-36, the respective brackets 90, 95 may be pivoted upwardly into the retracted position adjacent to the wall 12, and pivoted downwardly into the extended position which is distally positioned with respect to the wall 12. The arms 91*a*, 91*b*, 96*a*, 96*b* may be pivoted upwardly to raise the inner support members 20, 25 (and thus the exercise rack 11) into the retracted position adjacent to the wall 12, such as for storage. The arms 91*a*, 91*b*, 96*a*, 96*b* may conversely be pivoted downwardly to lower the inner support members 20, 25 (and thus the exercise rack 11) into the extended position away from the wall 12, ready for use. The shocks 92*a*, 92*b*, 97*a*, 97*b*, which may be comprised of various devices such as actuators and the like, may aid in raising and lowering the exercise rack 11.

As shown throughout the figures, the exercise rack 11 may comprise various openings 18 for attachment of various brackets, attachments, locking devices, and the like. The openings 18 may be positioned on various portions of the exercise rack 11, such as but not limited to the inner support members 20, 25, outer support members 30, 35, upper arms 40, 45, lower arms 50, 55, inner cross bar 49, and/or brackets 90, 95.

As shown in FIGS. 25-36, each of the upper and lower arms 40, 45, 50, 55 may be pivotably secured to a respective inner support member 20, 25 by one or more hinges 71*a*, 71*b*, 76*a*, 76*b*. Various types of hinges may be utilized, and thus the exemplary embodiment shown in the figures should not be construed as limiting in scope.

In the exemplary embodiment best shown in FIGS. 25-36, the hinges 71*a*, 71*b*, 76*a*, 76*b* are each illustrated as comprising a U-shaped bracket, with a pin extending through both the bracket and the respective upper or lower arm 40, 45, 50, 55 which is pivotably connected to the respective inner support member 20, 25. Locking members 85*a*, 85*b*, 86*a*, 86*b* may be utilized to releasably lock each of the arms 40, 45, 50, 55 in either the extended or retracted (e.g., folded) positions as discussed below.

As shown in FIGS. 29-32, the first upper arm 40 is pivotably connected at its first end 41 to the outer side 24 of the first inner support member 20 and fixedly (e.g., non-movably) connected at its second end 42 to the inner side 33 of the first outer support member 30. Thus, the first upper arm 40 may be pivoted about the first inner support member 20, with the first outer support member 30 similarly pivoting along with the first upper arm 40.

The manner by which the first upper arm 40 is pivotably connected to the first inner support member 20 may vary in different embodiments. In the embodiment shown in FIGS. 25-36, it can be seen that a first upper hinge 71*a* may be utilized. In such an embodiment, the first upper hinge 71*a* is connected at or near an upper end 21 of the outer side 24 of the first inner support member 20.

The first upper hinge 71*a* includes a pin or other elongated member which extends through the first upper arm 40 such that the first upper arm 40 may pivot about the pin. Separately, a first upper locking member 85*a* may be selectively inserted through both the first upper hinge 71*a* and the first upper arm 40 to releasably lock the first upper arm 40 in the extended position as shown in FIGS. 33-36. The first upper locking member 85*a* may comprise a pin or other elongated member such as shown in the figures. The first upper locking member 85*a* may be anchored to the first upper hinge 71*a*, such as by a cord or the like, such that the first upper locking member 85*a* remains anchored to the first upper hinge 71*a* even when the first upper arm 40 is not in the extended position.

As best shown in FIGS. 25-36, the second upper arm 45 is pivotably connected at its first end 46 to the outer side 29 of the second inner support member 25 and fixedly (e.g., non-movably) connected at its second end 47 to the inner side 38 of the second outer support member 35. Thus, the second upper arm 45 may be pivoted about the second inner support member 25, with the second outer support member 35 similarly pivoting along with the second upper arm 45.

The manner by which the second upper arm 45 is pivotably connected to the second inner support member 25 may vary in different embodiments. In the embodiment shown in FIGS. 25-36, it can be seen that a second upper hinge 71*b* may be utilized. In such an embodiment, the second upper hinge 71*b* is connected at or near an upper end 26 of the outer side 29 of the second inner support member 25.

The second upper hinge 71*b* includes a pin or other elongated member which extends through the second upper arm 45 such that the second upper arm 45 may pivot about the pin. Separately, a second upper locking member 85*b* may be selectively inserted through both the second upper hinge 71*b* and the second upper arm 45 to releasably lock the second upper arm 45 in the extended position as shown in FIGS. 33-36. The second upper locking member 85*b* may comprise a pin or other elongated member such as shown in the figures. The second upper locking member 85*b* may be anchored to the second upper hinge 71*b*, such as by a cord or the like, such that the second upper locking member 85*b* remains anchored to the second upper hinge 71*b* even when the second upper arm 45 is not in the extended position.

As best shown in FIGS. 29-32, the first lower arm 50 is pivotably connected at its first end 51 to the outer side 24 of the first inner support member 20 and fixedly (e.g., non-movably) connected at its second end 52 to the inner side 33 of the first outer support member 30. Thus, the first lower arm 50 may be pivoted about the first inner support member 20, with the first outer support member 30 similarly pivoting along with the first lower arm 50. The first lower arm 50 is illustrated as being connected between the first inner and outer support members 20, 30 below the first upper arm 40.

The manner by which the first lower arm 50 is pivotably connected to the first inner support member 20 may vary in different embodiments. In the embodiment shown in FIGS. 25-36, it can be seen that a first lower hinge 76*a* may be utilized. In such an embodiment, the first lower hinge 76*a* is connected at or near an upper end 21 of the outer side 24 of the first inner support member 20.

The first lower hinge 76*a* includes a pin or other elongated member which extends through the first lower arm 50 such that the first lower arm 50 may pivot about the pin. Separately, a first lower locking member 86*a* may be selectively inserted through both the first lower hinge 76*a* and the first lower arm 50 to releasably lock the first lower arm 50 in the extended position as shown in FIGS. 33-36. The first lower locking member 86*a* may comprise a pin or other elongated member such as shown in the figures. The first lower locking member 86*a* may be anchored to the first lower hinge 76*a*, such as by a cord or the like, such that the first lower locking member 86*a* remains anchored to the first lower hinge 76*a* even when the first lower arm 50 is not in the extended position.

As shown in FIGS. 25-36, the second lower arm 55 is pivotably connected at its first end 56 to the outer side 29 of the second inner support member 25 and fixedly (e.g., non-movably) connected at its second end 57 to the inner side 38 of the second outer support member 35. Thus, the second lower arm 55 may be pivoted about the second inner support member 25, with the second outer support member 35 similarly pivoting along with the second lower arm 55. The second lower arm 55 is illustrated as being connected between the second inner and outer support members 25, 35 below the second upper arm 45.

The manner by which the second lower arm 55 is pivotably connected to the second inner support member 25 may vary in different embodiments. In the embodiment shown in FIGS. 25-36, it can be seen that a second lower hinge 76*b* may be utilized. In such an embodiment, the second lower hinge 76*b* is connected at or near an upper end 26 of the outer side 29 of the second inner support member 25.

The second lower hinge 76*b* includes a pin or other elongated member which extends through the second lower arm 55 such that the second lower arm 55 may pivot about the pin. Separately, a second lower locking member 86*b* may be selectively inserted through both the second lower hinge 76*b* and the second lower arm 55 to releasably lock the second lower arm 55 in the extended position as shown in FIGS. 33-36. The second lower locking member 86*b* may comprise a pin or other elongated member such as shown in the figures. The second lower locking member 86*b* may be anchored to the second lower hinge 76*b*, such as by a cord or the like, such that the second lower locking member 86*b* remains anchored to the second lower hinge 76*b* even when the second lower arm 55 is not in the extended position.

F. Fourth Exemplary Embodiment (FIGS. 37-48)

FIGS. 37-48 illustrate a fourth exemplary embodiment of a folding exercise rack system. It should be readily apparent from the figures that the fourth exemplary embodiment is substantially the same as the third exemplary embodiment with some variations, e.g., in the manner by which the fourth exemplary embodiment is adjustably secured to the wall 12. Thus, the preceding section covering the third exemplary embodiment and describing its constituent structures is hereby incorporated by reference into this section.

As shown in FIGS. 37-48, an exemplary embodiment may be adjustably connected to the wall 12 by usage of a plurality of scissor connectors 101*a*, 101*b*, 106*a*, 106*b* such that the exercise rack 11 may be adjusted between at least two positions with respect to the wall 12. As shown, the exercise rack 11 may be adjustable between an extended position and a retracted position. In the extended position, the inner support members 20, 25 are distally positioned away from the wall 12. In the retracted position, the inner support members 20, 25 are positioned adjacent to the wall 12. In such an embodiment, the exercise rack 11 may be adjusted only horizontally, without any vertical movement. However, in some embodiments, the exercise rack 11 may also be adjusted vertically.

Continuing to reference FIGS. 37-48, it can be seen that a plurality of scissor connectors 101*a*, 101*b*, 106*a*, 106*b* are utilized to adjustably connect the exercise rack 11 to the wall 12. In the exemplary embodiment shown in the figures, the plurality of scissor connectors 101*a*, 101*b*, 106*a*, 106*b* are connected between the inner support members 20, 25 and the wall 12.

While the figures illustrate the usage of four scissor connectors 101*a*, 101*b*, 106*a*, 106*b*, with each of the inner support members 20, 25 being connected to a pair of scissor connectors 101*a*, 101*b*, 106*a*, 106*b*, it should be appreciated that more or less scissor connectors 101*a*, 101*b*, 106*a*, 106*b* may be utilized in different embodiments. By way of example, a pair of scissor connectors 101*a*, 101*b* may be utilized, with each inner support member 20, 25 being connected to only one scissor connector 101*a*, 101*b*, 106*a*, 106*b*. As a further example, only a single scissor connector 101*a*, 101*b*, 106*a*, 106*b* could be utilized in some embodiments. In yet other embodiments, five or more scissor connectors 101*a*, 101*b*, 106*a*, 106*b* may be utilized.

In the exemplary embodiment best shown in FIGS. 37-48, a first pair of scissor connectors 101*a*, 106*a* are connected between the first inner support member 20 and the wall 12, and a second pair of scissor connectors 101*b*, 106*b* are connected between the second inner support member 25 and the wall 12. More specifically, a first upper scissor connector 101*a* and a first lower scissor connector 106*a* are each connected between the wall 12 and the first inner support member 20. Similarly, a second upper scissor connector 101*b* and a second lower scissor connector 106*b* are each connected between the wall 12 and the second inner support member 25.

As shown in FIGS. 37-48, the first upper scissor connector 101*a* is connected between the first inner support member 20 and the wall 12. In the exemplary embodiment shown in the figures, the first upper scissor connector 101*a* is connected to the inner side 23 of the first inner support member 20 near its upper end 21, just below the first upper hinge 71*a*. However, it should be appreciated that the first upper scissor connector 101*a* may be connected to various other positions along the length of the first inner support member 20.

The first upper scissor connector 101*a* is illustrated as comprising a first upper wall mount 100*a*, a first connector 102*a*, and a second connector 103*a*. The first upper wall mount 100*a* may comprise a bracket or other structure (e.g., a plate member) which may be secured to the wall 12, such as by fasteners or the like. The first connector 102*a* is pivotably connected at its first end to the first upper wall mount 100*a*, such as by use of a hinge or other pivoting device. The second connector 103*a* is pivotably connected at its first end to the second end of the first connector 102*a*, and pivotably connected at its second end to the first inner support member 20, such as by usage of a pivot pin or the like. A first upper shock 92*a* may be connected between the first upper wall mount 100*a* and the first connector 102*a* to smoothen and/or assist with adjustment.

As best shown in FIGS. 37-48, the first upper scissor connector 101*a* is adapted to adjust inwardly towards the wall 12 by pivoting both the first and second connectors 102*a*, 103*a* upwardly and towards each other. FIGS. 37-40 illustrates the first upper scissor connector 101*a* in an extended position, in which the first and second connectors 102*a*, 103*a* of the first upper scissor connector 101*a* are linearly aligned in a horizontal (e.g., parallel to the floor 13, perpendicular to the wall 12) orientation. FIGS. 41-48 illustrate the first upper scissor connector 101*a* in a retracted position, in which the first and second connectors 102*a*, 103*a* of the first upper scissor connector 101*a* are drawn together towards each other in a vertical (e.g., perpendicular to the floor 13, parallel to the wall 12) orientation.

As shown in FIGS. 37-48, the first lower scissor connector 106*a* is connected between the first inner support member 20 and the wall 12, below the first upper scissor connector 101*a*. In the exemplary embodiment shown in the figures, the first lower scissor connector 106*a* is connected to the inner side 23 of the first inner support member 20 near its lower end 22, just above the first lower hinge 76*a*. However, it should be appreciated that the first lower scissor connector 106*a* may be connected to various other positions along the length of the first inner support member 20.

The first lower scissor connector 106*a* is illustrated as comprising a first lower wall mount 105*a*, a first connector 107*a*, and a second connector 108*a*. The first lower wall mount 105*a* may comprise a bracket or other structure (e.g., a plate member) which may be secured to the wall 12, such as by fasteners or the like. The first connector 107*a* is pivotably connected at its first end to the first lower wall mount 105*a*, such as by use of a hinge or other pivoting device. The second connector 108*a* is pivotably connected at its first end to the second end of the first connector 107*a*, and pivotably connected at its second end to the first inner support member 20, such as by usage of a pivot pin or the like. A first lower shock 97*a* may be connected between the first lower wall mount 105*a* and the first connector 107*a* to smoothen and/or assist with adjustment.

As best shown in FIGS. 37-48, the first lower scissor connector 106*a* is adapted to adjust inwardly towards the wall 12 by pivoting both the first and second connectors 107*a*, 108*a* upwardly and towards each other. FIGS. 41-48 illustrate the first lower scissor connector 106*a* in an extended position, in which the first and second connectors 107*a*, 108*a* of the first lower scissor connector 106*a* are linearly aligned in a horizontal (e.g., parallel to the floor 13, perpendicular to the wall 12) orientation. FIGS. 45-48 illustrate the first lower scissor connector 106*a* in a retracted position, in which the first and second connectors 107*a*, 108*a* of the first lower scissor connector 106*a* are drawn together towards each other in a vertical (e.g., perpendicular to the floor 13, parallel to the wall 12) orientation.

As shown in FIGS. 37-48, the second upper scissor connector 101*b* is connected between the second inner support member 25 and the wall 12. In the exemplary embodiment shown in the figures, the second upper scissor connector 101*b* is connected to the inner side 28 of the second inner support member 25 near its upper end 26, just below the second upper hinge 71*b*. However, it should be appreciated that the second upper scissor connector 101*b* may be connected to various other positions along the length of the second inner support member 25.

The second upper scissor connector 101*b* is illustrated as comprising a second upper wall mount 100*b*, a first connector 102*b*, and a second connector 103*b*. The second upper wall mount 100*b* may comprise a bracket or other structure (e.g., a plate member) which may be secured to the wall 12, such as by fasteners or the like. The first connector 102*b* is pivotably connected at its first end to the second upper wall mount 100*b*, such as by use of a hinge or other pivoting device. The second connector 103*b* is pivotably connected at its first end to the second end of the first connector 102*b*, and pivotably connected at its second end to the second inner support member 25, such as by usage of a pivot pin or the like. A second upper shock 92*b* may be connected between the second upper wall mount 100*b* and the first connector 102*b* to smoothen and/or assist with adjustment.

As shown in FIGS. 37-48, the second upper scissor connector 101*b* is adapted to adjust inwardly towards the wall 12 by pivoting both the first and second connectors 102*b*, 103*b* upwardly and towards each other. FIGS. 37-40 illustrate the second upper scissor connector 101*b* in an extended position, in which the first and second connectors 102*b*, 103*b* of the second upper scissor connector 101*b* are linearly aligned in a horizontal (e.g., parallel to the floor 13, perpendicular to the wall 12) orientation. FIGS. 41-48 illustrate the second upper scissor connector 101*b* in a retracted position, in which the first and second connectors 102*b*, 103*b* of the second upper scissor connector 101*b* are drawn together towards each other in a vertical (e.g., perpendicular to the floor 13, parallel to the wall 12) orientation.

As shown in FIGS. 37-48, the second lower scissor connector 106*b* is connected between the second inner support member 25 and the wall 12, below the second upper scissor connector 101*b*. In the exemplary embodiment shown in the figures, the second lower scissor connector 106*b* is connected to the inner side 28 of the second inner support member 25 near its lower end 27, just above the second lower hinge 76*b*. However, it should be appreciated that the second lower scissor connector 106*b* may be connected to various other positions along the length of the second inner support member 25.

The second lower scissor connector 106*b* is illustrated as comprising a second lower wall mount 105*b*, a first connector 107*b*, and a second connector 108*b*. The second lower wall mount 105*b* may comprise a bracket or other structure (e.g., a plate member) which may be secured to the wall 12, such as by fasteners or the like. The first connector 107*b* is pivotably connected at its first end to the second lower wall mount 105*b*, such as by use of a hinge or other pivoting device. The second connector 108*b* is pivotably connected at its first end to the second end of the first connector 107*b*, and pivotably connected at its second end to the second inner support member 25, such as by usage of a pivot pin or the like. A second lower shock 97*b* may be connected between the second lower wall mount 105*b* and the first connector 107*b* to smoothen and/or assist with adjustment.

As best shown in FIGS. 41-44, the second lower scissor connector 106*b* is adapted to adjust inwardly towards the wall 12 by pivoting both the first and second connectors 107*b*, 108*b* upwardly and towards each other. FIGS. 37-40 illustrate the second lower scissor connector 106*b* in an extended position, in which the first and second connectors 107*b*, 108*b* of the second lower scissor connector 106*b* are linearly aligned in a horizontal (e.g., parallel to the floor 13, perpendicular to the wall 12) orientation. FIGS. 41-48 illustrate the second lower scissor connector 106*b* in a retracted position, in which the first and second connectors 107*b*, 108*b* of the second lower scissor connector 106*b* are drawn together towards each other in a vertical (e.g., perpendicular to the floor 13, parallel to the wall 12) orientation.

As best shown in FIGS. 37-48, one or more wheels 88*a*, 88*b* may be connected to the exercise rack 11 to aid in and smoothen movement of the exercise rack 11 when being adjusted inwardly or outwardly with respect to the wall 12, or when being collapsed or folded. While wheels 88*a*, 88*b* are only shown in use with the fourth exemplary embodiment shown in FIGS. 37-48, it should be appreciated that wheels 88*a*, 88*b* may be utilized with any of the other embodiments described or shown herein.

In the exemplary embodiment shown in FIGS. 37-48, it can be seen that a first wheel 88*a* is connected to the lower end 22 of the first inner support member 20 and that a second wheel 88*b* is connected to the lower end 27 of the second inner support member 25. Although not shown, it should be appreciated that additional or alternate wheels may be positioned on the lower ends 32, 37 of the outer support members 30, 35 in some embodiments. Various types of wheels 88*a*, 88*b* may be utilized, such as but not limited to caster wheels. The wheels 88*a*, 88*b* may be pivotably or rotatably connected to the support members 20, 25, 30, 35, or may be fixed so as to allow movement only towards or away from the wall 12.

G. Operation of Exemplary Embodiments

In use, the exercise rack 11 is both adjustable with respect to the wall 12 and foldable into a compact, folded position. The manner by which the exercise rack 11 is adjusted in both respects may vary in different embodiments. It should be appreciated that any combination of adjustment methods and/or devices shown in the figures may be utilized in different embodiments. By way of example, the scissor connectors 101*a*, 101*b*, 106*a*, 106*b* of the embodiment shown in FIGS. 37-48 could be utilized in combination with any of the embodiments shown in FIGS. 1-36.

Generally, the exercise rack 11 may be adjustable by grasping various portions of the exercise rack 11 and applying force (e.g., pivotable or rotational force). In the embodiments shown in FIGS. 1-12 and 25-48, the exercise rack 11 may be adjusted between positions adjacent to and distally spaced away from the wall 12 by, generally, grasping different portions of the exercise rack 11 and applying force in the desired direction of movement.

In each of the exemplary embodiments shown in the figures, the exercise rack 11 may be folded into a compact state, with the outer support members 30, 35 being adjusted inwardly towards the wall 12. In the exemplary embodiment shown in FIGS. 25-48, the upper and lower arms 40, 45, 50, 55 may be pivoted inwardly about the inner support members 20, 25. In the exemplary embodiment shown in FIGS. 1-12, the outer support members 30, 35 may be slid or otherwise moved towards the inner support members 20, 25, with the upper and lower arms 40, 45, 50, 55 pivoting inwardly towards a respective folded outer support member 30, 35.

i. Operation of First Exemplary Embodiment (FIGS. 1-12)

In use, the exemplary embodiment shown in FIGS. 1-12 may be adjusted with respect to the wall 12 by grasping any portion of the exercise rack 11, e.g., the inner support members 20, 25, the outer support members 30, 35, the upper arms 40, 45, the lower arms 50, 55, the cross bar 80, and/or the inner cross bar 49, and applying upward or downward force.

When upward force is applied to any portion of the exercise rack 11, the upper and lower brackets 90, 95 will pivot upwardly towards the wall 12, thus causing the exercise rack 11 to be similarly drawn upwardly and towards the wall 12 such as shown in FIGS. 5-8. The arms 91*a*, 91*b*, 96*a*, 96*b* of the upper and lower brackets 90, 95 will pivot with respect to the upper and lower wall mounts 94, 99, and the inner support members 20, 25 will pivot with respect to the arms 91*a*, 91*b*, 96*a*, 96*b*. In this manner, the exercise rack 11 may be adjusted inwardly and upwardly towards the wall 12, whether in its expanded or retracted (e.g., collapsed, folded) position.

When downward force is applied to any portion of the exercise rack 11, the upper and lower brackets 90, 95 will pivot downwardly away from the wall 12, thus causing the exercise rack 11 to be similarly drawn downwardly and away from the wall 12. The arms 91*a*, 91*b*, 96*a*, 96*b* of the upper and lower brackets 90, 95 will pivot with respect to the upper and lower wall mounts 94, 99 and the inner support members 20, 25 will pivot with respect to the arms 91*a*, 91*b*, 96*a*, 96*b*. In this manner, the exercise rack 11 may be adjusted outwardly and downwardly away from the wall 12, whether in its expanded or retracted (e.g., collapsed, folded) position.

As best shown in FIG. 6, the brackets 90, 95 may include shocks 92*a*, 92*b*, 97*a*, 97*b* such as actuators or the like which may aid the user in adjusting the exercise rack 11 with respect the wall 12. The shocks 92*a*, 92*b*, 97*a*, 97*b* may comprise actuators or other devices known to aid movement of objects. In some embodiments, the shocks 92*a*, 92*b*, 97*a*, 97*b* may be adapted to automatically adjust the brackets 90, 95 without user force being applied. In such embodiments, various input devices such as buttons, remote controllers, and the like may be utilized to adjust the exercise rack 11. In other embodiments, the exercise rack 11 may still be manually adjustable (e.g., by manual force applied by the user), with the shocks 92*a*, 92*b*, 97*a*, 97*b* functioning to aid adjustment (e.g., by reducing the force necessary).

Additionally, the exercise rack 11 may be collapsed or folded in on itself as shown in FIGS. 9-12. To collapse the exercise rack 11, the upper and lower locking members 85*a*, 85*b*, 86*a*, 86*b* may first be removed from extending through the upper and lower brackets 120*a*, 120*b*, 125*a*, 125*b*. The user may then apply inward force to the outer support members 30, 35, which traverse along the upper and lower arms 40, 45, 50, 55 towards the inner support members 20, 25. The inward force may be applied, for example, by grasping and pushing on the outer support members 30, 35. The force may be ceased upon the outer support members 30, 35 being pressed against the inner support members 20, 25.

To complete folding or collapsing the exercise rack 11, the upper and lower arms 40, 45, 50, 55 will be pivoted inwardly to rest against the respective outer support members 30, 35. In some embodiments, the upper and lower arms 40, 45, 55, 55 may pivot automatically as the outer support members 30, 35 are pushed inwardly. In other embodiments, the upper and lower arms 40, 45, 50, 55 may be separately pivoted inwardly after the outer support members 30, 35 have been pushed in.

As shown in FIGS. 5-8, the first upper arm 40 pivots downwardly and inwardly towards the first outer support member 30, the second upper arm 45 pivots downwardly and inwardly towards the second outer support member 35, the first lower arm 50 pivots upwardly and inwardly towards the first outer support member 30, and the second lower arm 55 pivots upwardly and inwardly towards the second outer support member 35.

The exercise rack 11 may be locked in the collapsed or folded position such as shown in FIGS. 9-12. In the illustrated exemplary embodiment, the upper and lower locking members 85*a*, 85*b*, 86*a*, 86*b* may be engaged to lock the upper and lower arms 40, 45, 50, 55 in position against the outer support members 30, 35, parallel to the wall 12. More specifically, the first upper locking member 85*a* may be inserted through adjacent openings 18 in the first upper bracket 120*a* and the first outer support member 30, the second upper locking member 85*b* may be inserted through adjacent openings 18 in the second upper bracket 120*b* and the second outer support member 35, the first lower locking member 86*a* may be inserted through adjacent openings 18 in the first lower bracket 125*a* and the first outer support member 30, and the second lower locking member 86*b* may be inserted through adjacent openings 18 in the second lower bracket 125*b* and the second outer support member 35.

When desired, the exercise rack 11 may be extended (e.g., unfolded) back to its extended position. The locking members 85*a*, 85*b*, 86*a*, 86*b* are first removed by pulling them outwardly. The upper arms 40, 45 are pivoted outwardly and upwardly to extend perpendicular to the wall 12 and the lower arms 50, 55 are pivoted outwardly and downwardly to extend perpendicular to the wall 12. The outer support members 30, 35 are pulled outwardly to traverse between the upper and lower arms 40, 45, 50, 55, and the locking members 85*a*, 85*b*, 86*a*, 86*b* are repositioned in their locked positions between the upper and lower arms 40, 45, 50, 55 and the outer support members 30, 35.

ii. Operation of Second Exemplary Embodiment (FIGS. 13-24)

In use, the second exemplary embodiment shown in FIGS. 13-24 may be collapsed or folded in on itself as shown in FIGS. 21-24. To collapse the exercise rack, the cross bar 80 is first removed. The cross bar 80 may be stored separately, or may be removably connected to various portions of the exercise rack 11, such as but not limited to the inner support members 20,25 or outer support members 30, 35. In the exemplary embodiment shown in the figures, the cross bar 80 is removably secured to the outer side 39 of the second outer support member 35.

As shown in FIGS. 17-20, the frames 15, 16 of the exercise rack 11 may be individually pivoted inwardly towards the wall 12. A user may first grasp the first outer support member 30, or the first upper and lower arms 40, 50, and pivot the first frame 15 inwardly towards the wall 12. The first frame 15, including the first inner support member 20, first outer support member 30, first upper arm 40, and first lower arm 50, pivot with respect to the first upper hinge 71*a* and first lower hinge 76*a*. When fully collapsed or folded, the first frame 15 rests against the wall 12 such as shown in FIGS. 21-24.

After collapsing or folding the first frame 15, the second frame 16 may similarly be collapsed or folded by grasping the second outer support member 35, or the second upper and lower arms 45, 55, and pivoting the second frame 16 inwardly towards the wall 12. The second frame 16, including the second inner support member 25, second outer support member 35, second upper arm 45, and second lower arm 55, pivot with respect to the second upper hinge 71*b* and second lower hinge 76*b*. When fully collapsed or folded, the second frame 16 rests against the first frame 15 such as shown in FIGS. 21-24. However, it should be appreciated that, in some embodiments, the reverse order may be utilized (e.g., the second frame 16 is folded first).

To extend the exercise rack 11, the reverse steps may be performed. The second frame 16 may be grasped at various locations and pivoted outwardly to be perpendicular to the wall 12. The first frame 15 then may be grasped at various locations and pivoted outwardly to be perpendicular to the wall 12 and parallel to the second frame 16. The cross bar 80 may be removed and then secured between the outer support members 30, 35. The exercise rack 11 is then ready for use.

iii. Operation of Third and Fourth Exemplary Embodiments (FIGS. 25-48)

In use, the exemplary embodiment shown in FIGS. 25-36 and the exemplary embodiment shown in FIGS. 37-48 are both adjustable with respect to the wall 12 and foldable into a retracted (e.g., compact, folded) position. Both exemplary embodiments are adjustable with respect to the wall 12 in different manners, while collapsing in the same manner.

The embodiment shown in FIGS. 25-36 is illustrated as being adjustably connected to the wall 12 by one or more brackets 90, 95, each comprising a wall mount 94, 99 and a pair of arms 91*a*, 91*b*, 96*a*, 96*b* pivotably connected between the wall mount 94, 99 and an inner support member 20, 25. The embodiment shown in FIGS. 37-48 is illustrated as being adjustably connected to the wall 12 by a plurality of scissor connectors 101*a*, 101*b*, 106*a*, 106*b*, each comprising a wall mount 100*a*, 100*b*, 105*a*, 105*b*, a first connector 102*a*, 102*b*, 107*a*, 107*b* pivotably connected to the wall mount 100*a*, 100*b*, 105*a*, 105*b*, and a second connector 103*a*, 103*b*, 108*a*, 108*b* pivotably connected between the first connector 102*a*, 102*b*, 107*a*, 107*b* and an inner support member 20, 25.

The exemplary embodiment shown in FIGS. 25-36 may be adjusted with respect to the wall 12 by grasping any portion of the exercise rack 11, e.g., the inner support members 20, 25, the outer support members 30, 35, the upper arms 40, 45, the lower arms 50, 55, the cross bar 80, and/or the inner cross bar 49, and applying upward or downward force.

When upward force is applied to any portion of the exercise rack 11, the upper and lower brackets 90, 95 will pivot upwardly towards the wall 12, thus causing the exercise rack 11 to be similarly drawn upwardly and towards the wall 12 such as shown in FIGS. 25-48. The arms 91*a*, 91*b*, 96*a*, 96*b* of the upper and lower brackets 90, 95 will pivot with respect to the upper and lower wall mounts 94, 99, and the inner support members 20, 25 will pivot with respect to the arms 91*a*, 91*b*, 96*a*, 96*b*. In this manner, the exercise rack 11 may be adjusted inwardly and upwardly towards the wall 12, whether in its expanded or retracted (e.g., collapsed, folded) position.

When downward force is applied to any portion of the exercise rack 11, the upper and lower brackets 90, 95 will pivot downwardly away from the wall 12, thus causing the exercise rack 11 to be similarly drawn downwardly and away from the wall 12 such as shown in FIGS. 25-48. The arms 91*a*, 91*b*, 96*a*, 96*b* of the upper and lower brackets 90, 95 will pivot with respect to the upper and lower wall mounts 94, 99 and the inner support members 20, 25 will pivot with respect to the arms 91*a*, 91*b*, 96*a*, 96*b*. In this manner, the exercise rack 11 may be adjusted outwardly and downwardly away from the wall 12, whether in its expanded or retracted (e.g., collapsed, folded) position.

As best shown in FIGS. 34, 38, 42, and 46 the brackets 90, 95 may include shocks 92*a*, 92*b*, 97*a*, 97*b* such as actuators or the like which may aid the user in adjusting the exercise rack 11 with respect the wall 12. The shocks 92*a*, 92*b*, 97*a*, 97*b* may comprise actuators or other devices known to aid movement of objects. In some embodiments, the shocks 92*a*, 92*b*, 97*a*, 97*b* may be adapted to automatically adjust the brackets 90, 95 without user force being applied. In such embodiments, various input devices such as buttons, remote controllers, and the like may be utilized to adjust the exercise rack 11. In other embodiments, the exercise rack 11 may still be manually adjustable (e.g., by manual force applied by the user), with the shocks 92*a*, 92*b*, 97*a*, 97*b* functioning to aid adjustment (e.g., by reducing the force necessary).

Both the embodiment shown in FIGS. 25-36 and the embodiment shown in FIGS. 37-48 are collapsible in the same manner. To collapse the exercise rack 11, the cross bar 80 is first removed. The cross bar 80 may be stored separately, or may be removably connected to various portions of the exercise rack 11, such as but not limited to the inner support members 20,25 or outer support members 30, 35. In the exemplary embodiment shown in the figures, the cross bar 80 is removably secured to the outer side 39 of the second outer support member 35.

In the embodiments shown in FIGS. 25-48, it can be seen that each of the frames 15, 16 is pivotable about the inner support member 20, 25 through use of a plurality of hinges 71*a*, 71*b*, 76*a*, 76*b*. In the illustrated embodiments, the second frame 16 is illustrated as being pivoted inwardly first, followed by the first frame 15. It should be appreciated, however, that the reverse order may be utilized in some embodiments (e.g., the first frame 15 is pivoted inwardly first). To collapse the embodiments shown in FIGS. 25-48, a user will first release the locking members 85*a*, 85*b*, 86*a*, 86*b* to unlock the frames 15, 16. The first upper and lower locking members 85*a*, 86*a* are thus removed from engagement with the first ends 41, 51 of the first upper and lower arms 40, 50, allowing the first upper and lower arms 40, 50 to freely pivot about the first upper and lower hinges 71*a*, 76*a*. Similarly, the second upper and lower locking members 86*b*, 86*b* are removed from engagement with the first ends 46, 56 of the second upper and lower arms 45, 55 to freely pivot about the second upper and lower hinges 71*b*, 76*b*.

The user may then grasp a portion of the second frame 16, such as the second outer support member 35, the second upper arm 45, and/or the second lower arm 55, and pivot inwardly towards the wall 12 until the second outer support member 35 is positioned adjacent to the wall 12 and the inner cross bar 49, with the upper and lower arms 45, 55 being parallel to the wall 12 and to the inner cross bar 49.

Figure 36:
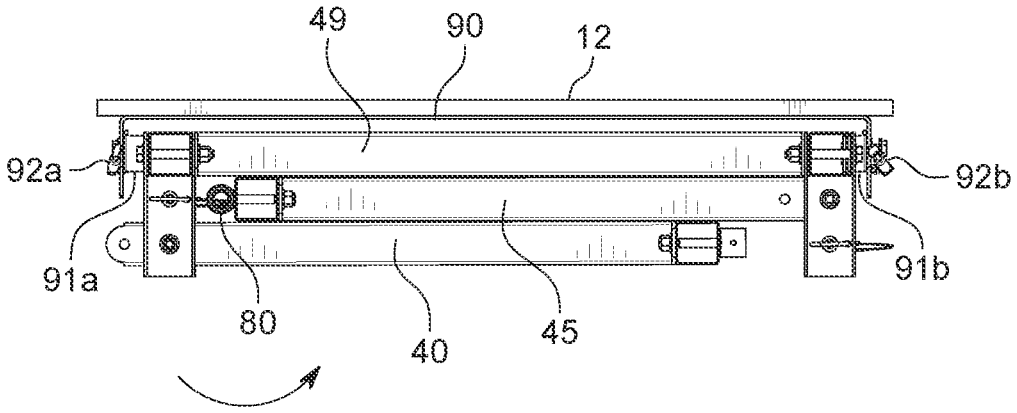
FIG. 36 is a top view of a folding exercise rack system in a retracted position in accordance with a third exemplary embodiment.
Figure 37:
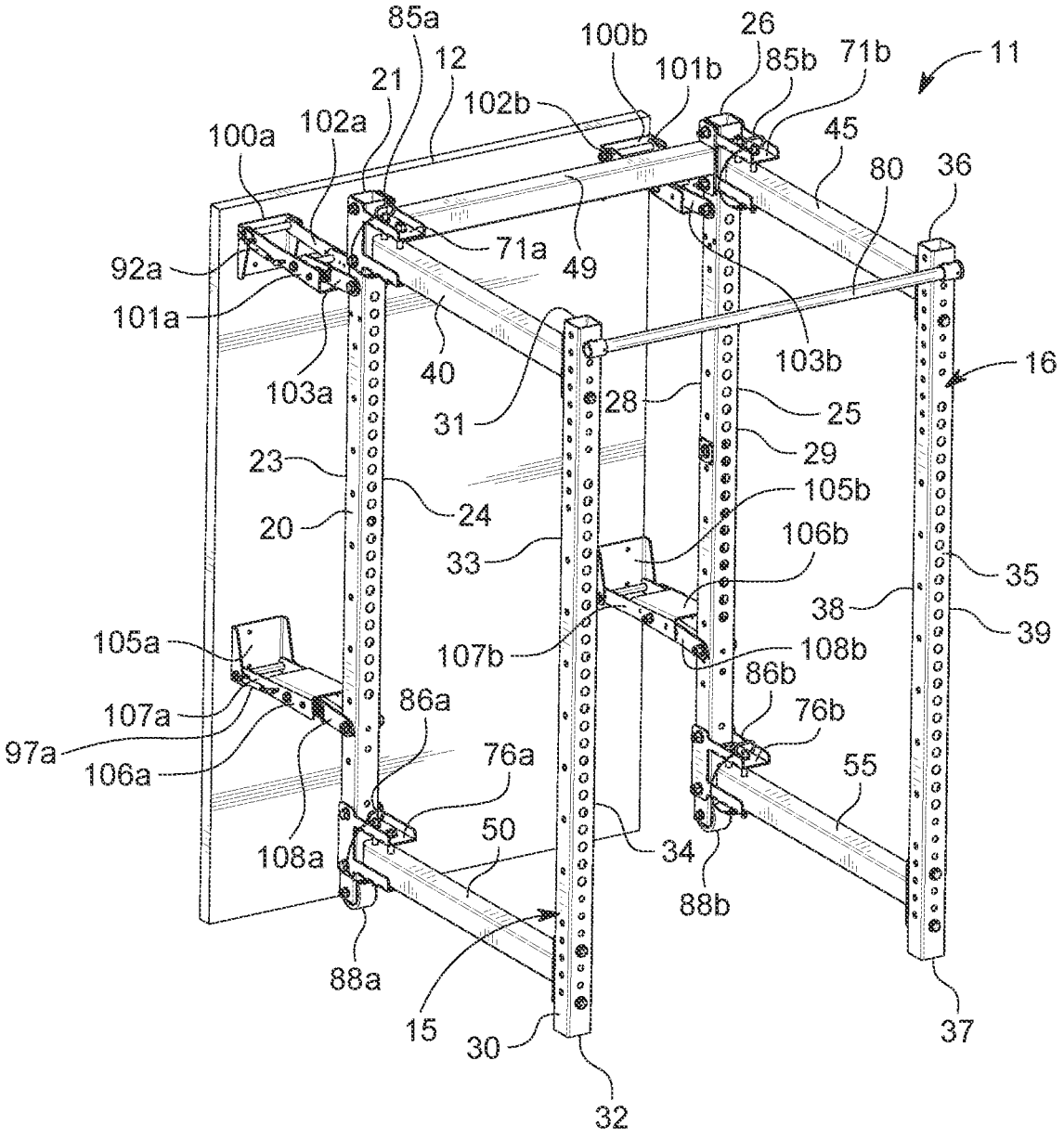
FIG. 37 is a perspective view of a folding exercise rack system in an extended position in accordance with a fourth exemplary embodiment.
Figure 38:
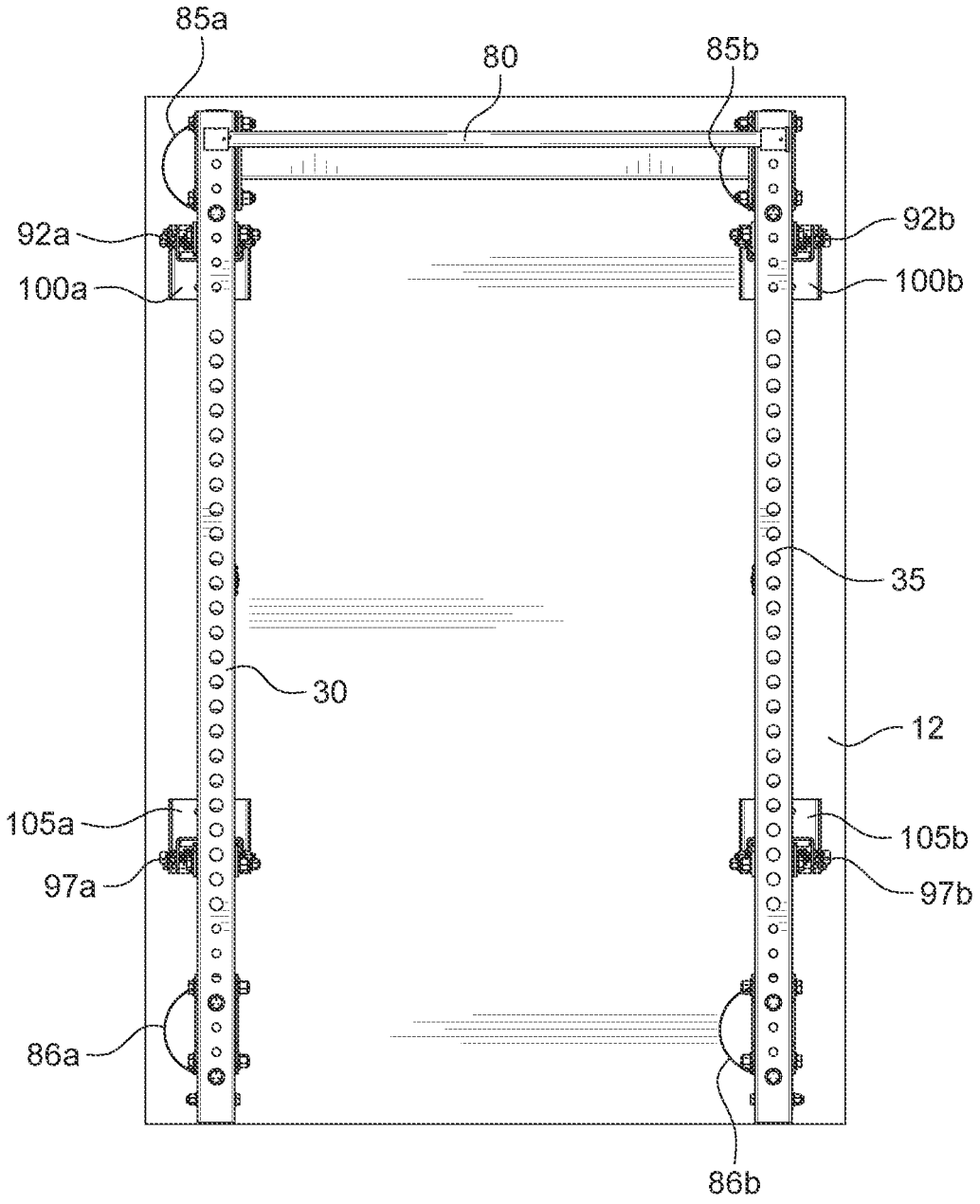
FIG. 38 is a front view of a folding exercise rack system in an extended position in accordance with a fourth exemplary embodiment.
Figure 39:
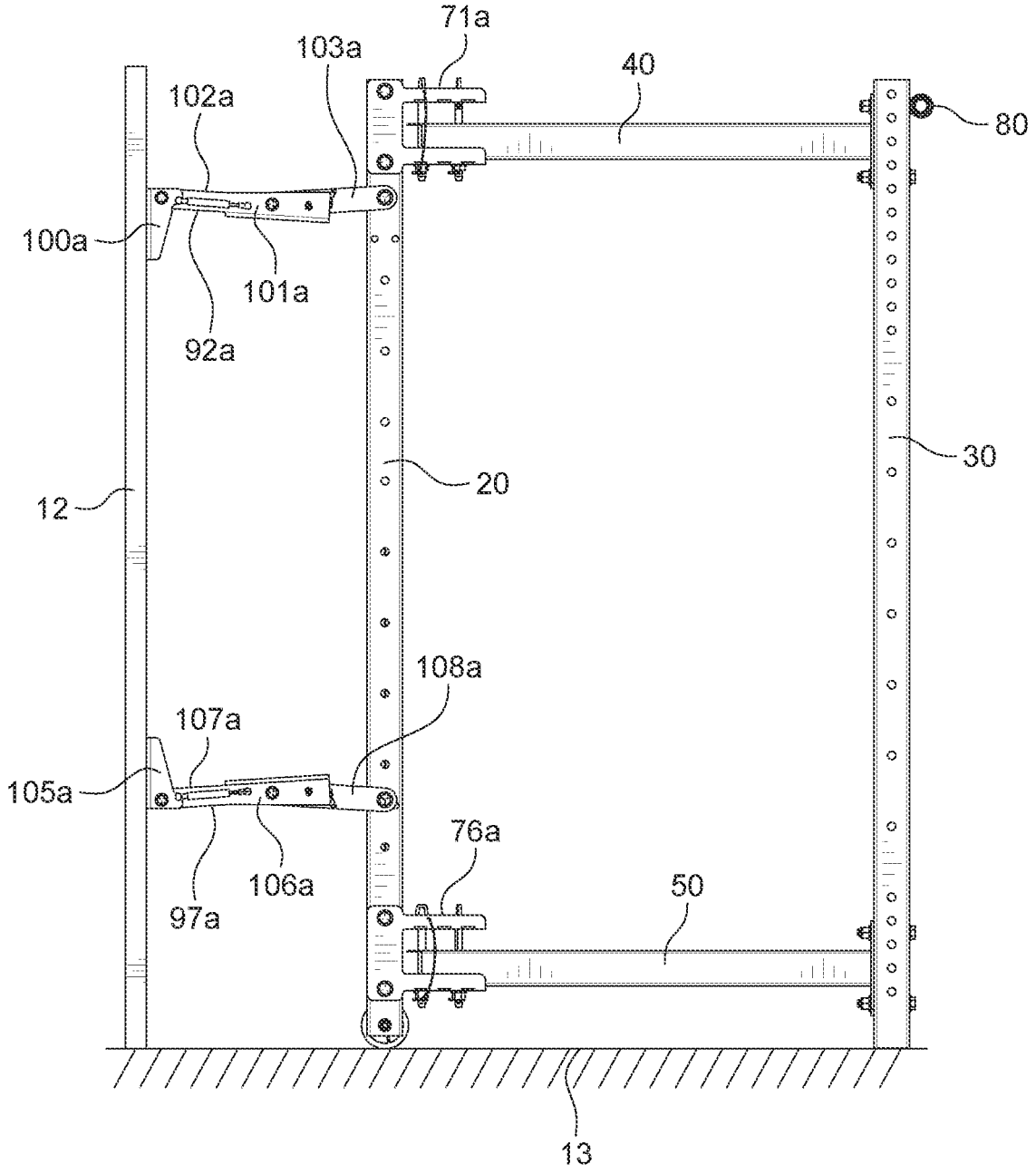
FIG. 39 is a side view of a folding exercise rack system in an extended position in accordance with a fourth exemplary embodiment.
Figure 40:
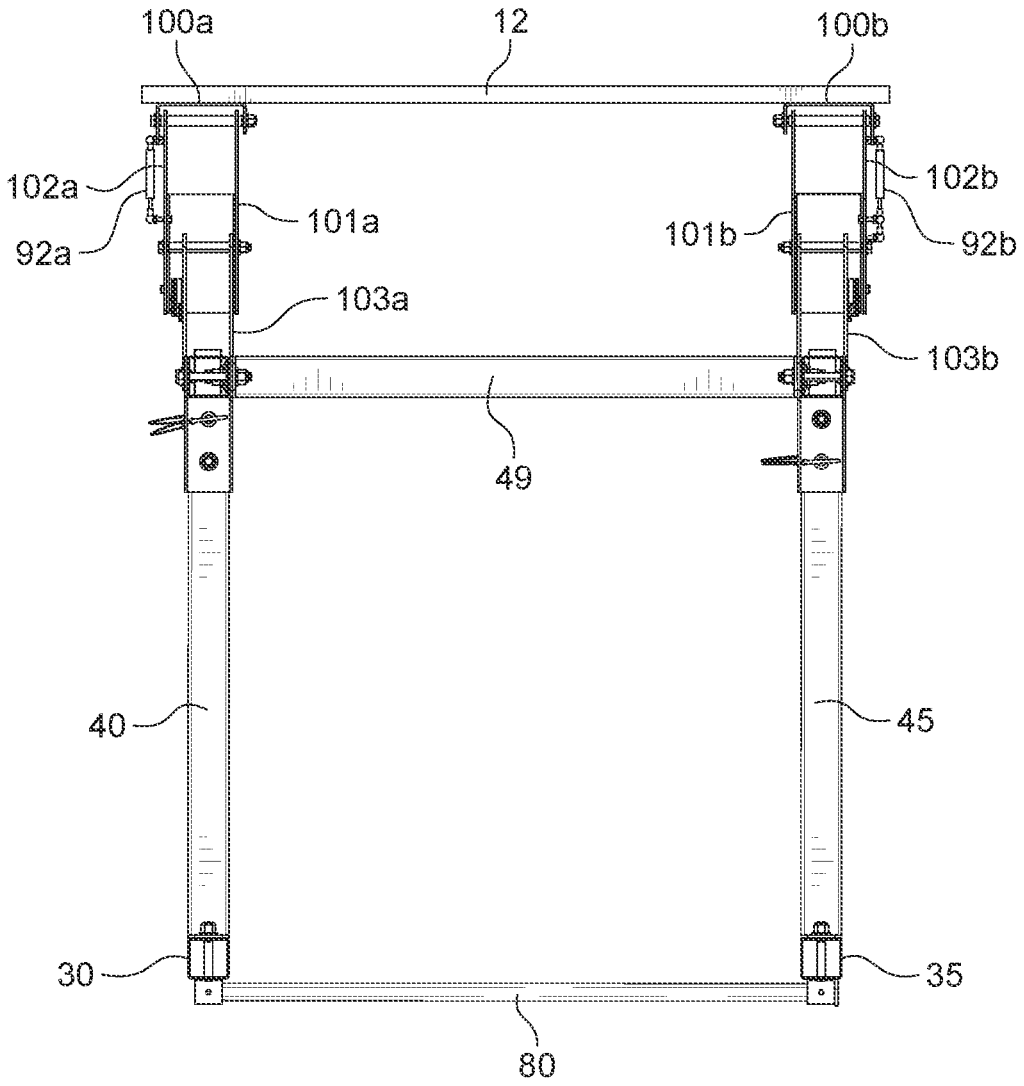
FIG. 40 is a top view of a folding exercise rack system in an extended position in accordance with a fourth exemplary embodiment.
Figure 41:
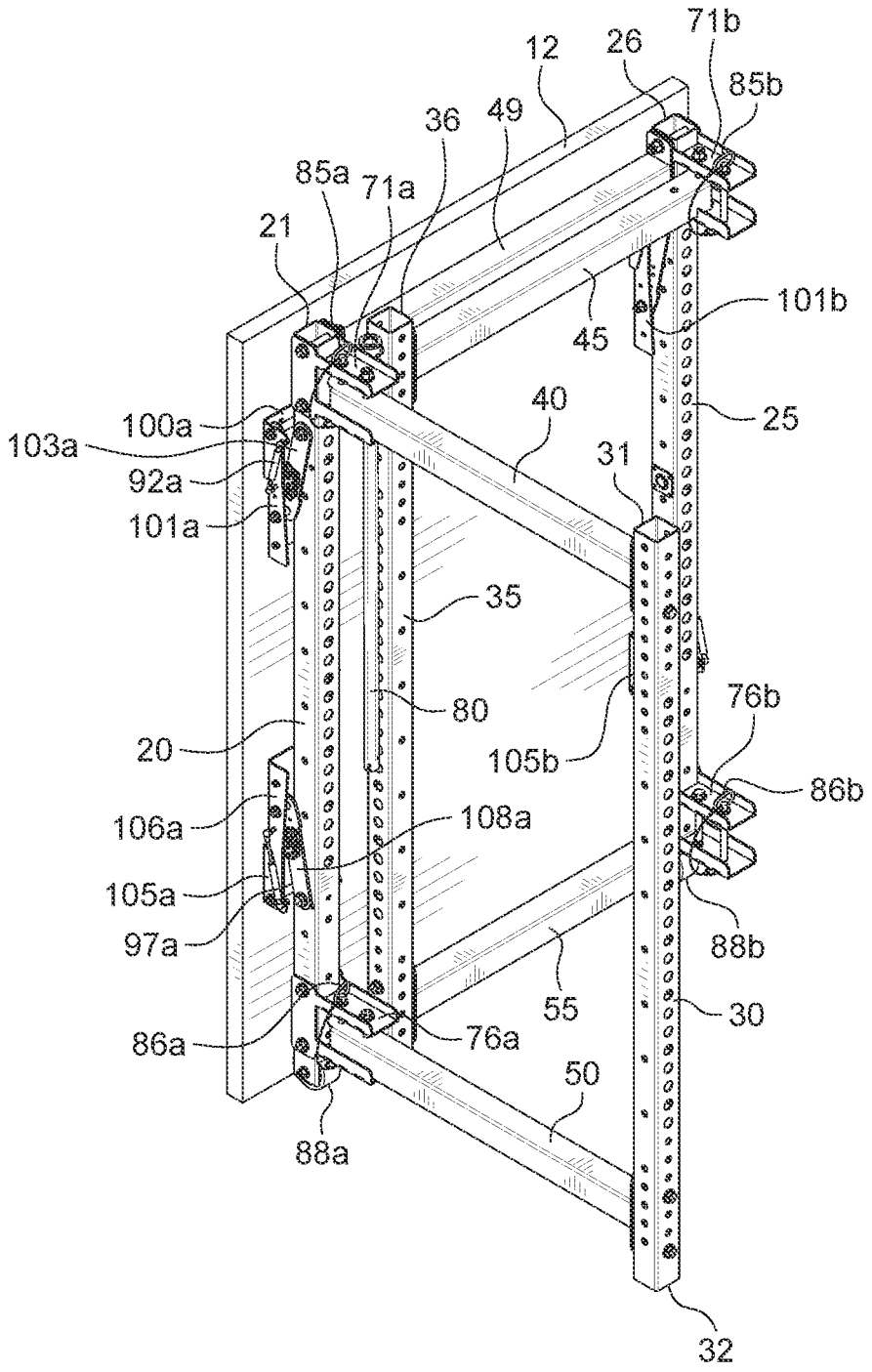
FIG. 41 is a perspective view of a folding exercise rack system during adjustment between retracted and extended positions in accordance with a fourth exemplary embodiment.
Figure 42:
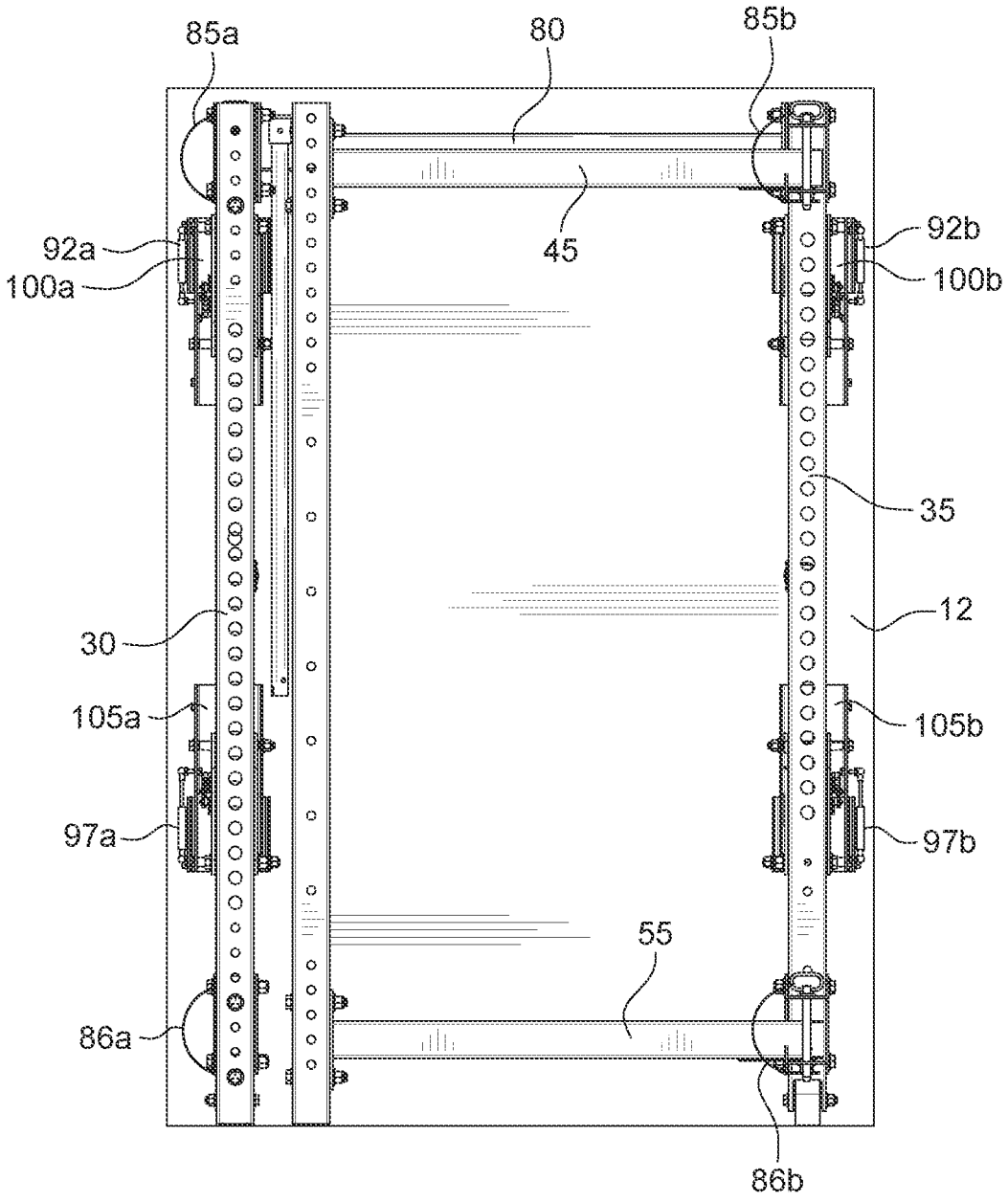
FIG. 42 is a front view of a folding exercise rack system during adjustment between retracted and extended positions in accordance with a fourth exemplary embodiment.
Figure 43:
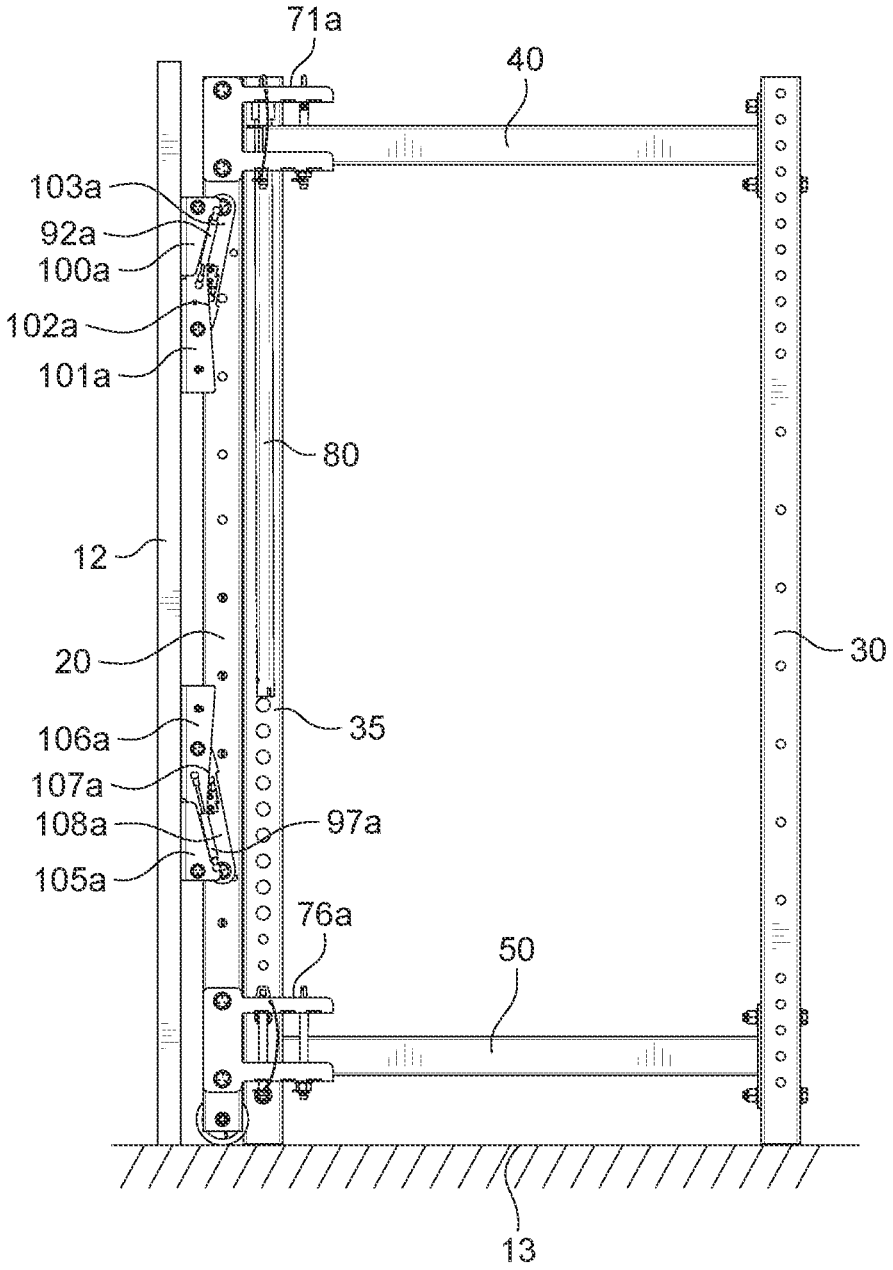
FIG. 43 is a side view of a folding exercise rack system during adjustment between retracted and extended positions in accordance with a fourth exemplary embodiment.
Figure 44:
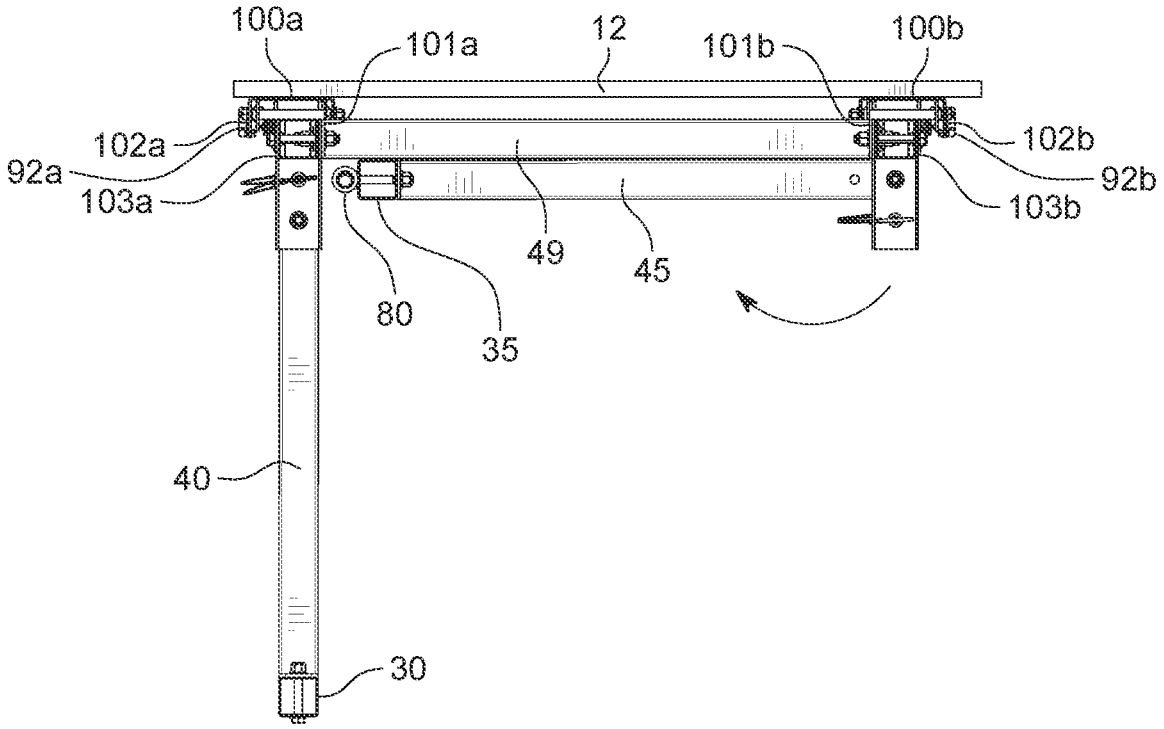
FIG. 44 is a top view of a folding exercise rack system during adjustment between retracted and extended positions in accordance with a fourth exemplary embodiment.
Figure 45:
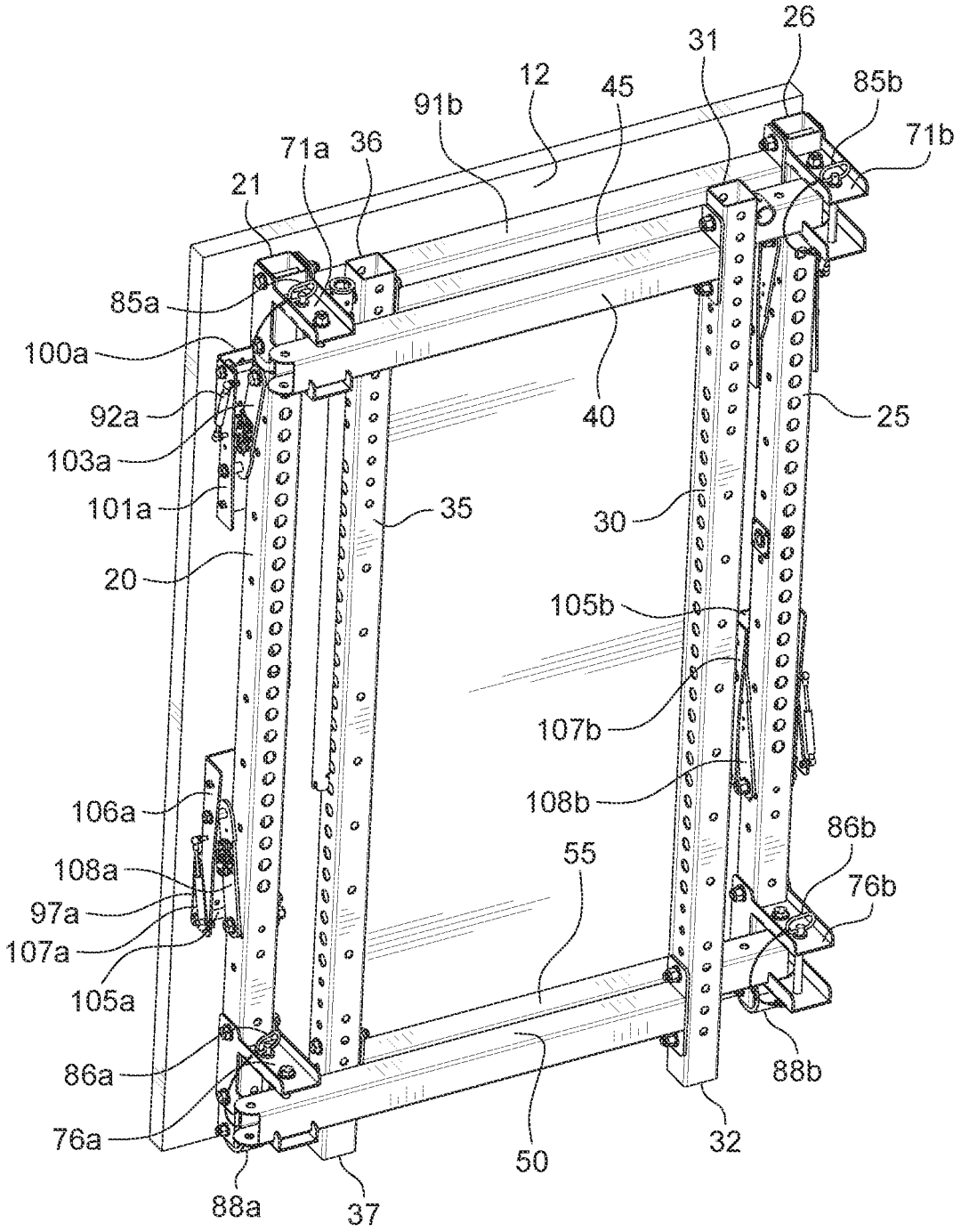
FIG. 45 is a perspective view of a folding exercise rack system in a retracted position in accordance with a fourth exemplary embodiment.
Figure 46:
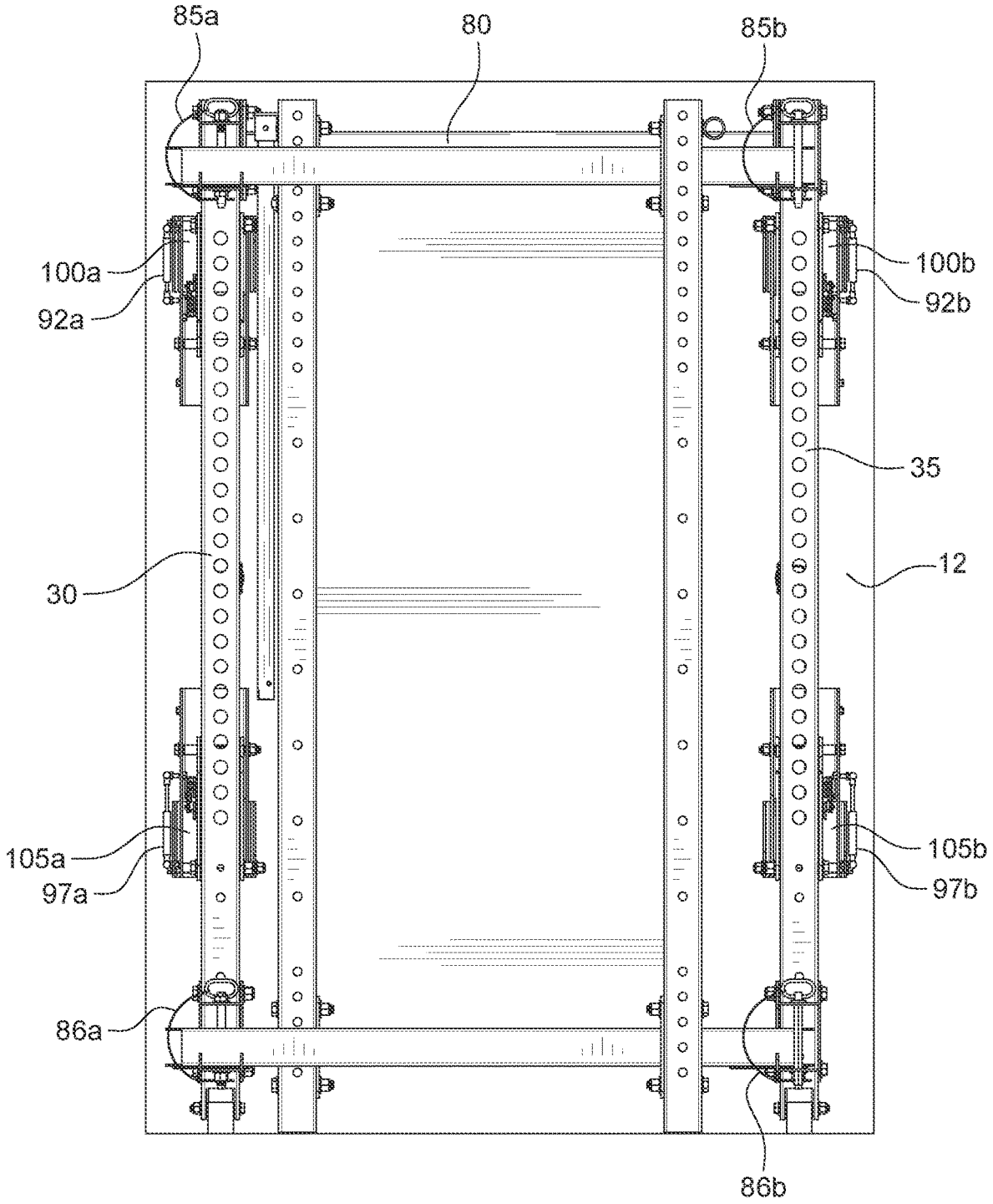
FIG. 46 is a front view of a folding exercise rack system in a retracted position in accordance with a fourth exemplary embodiment.
Figure 47:
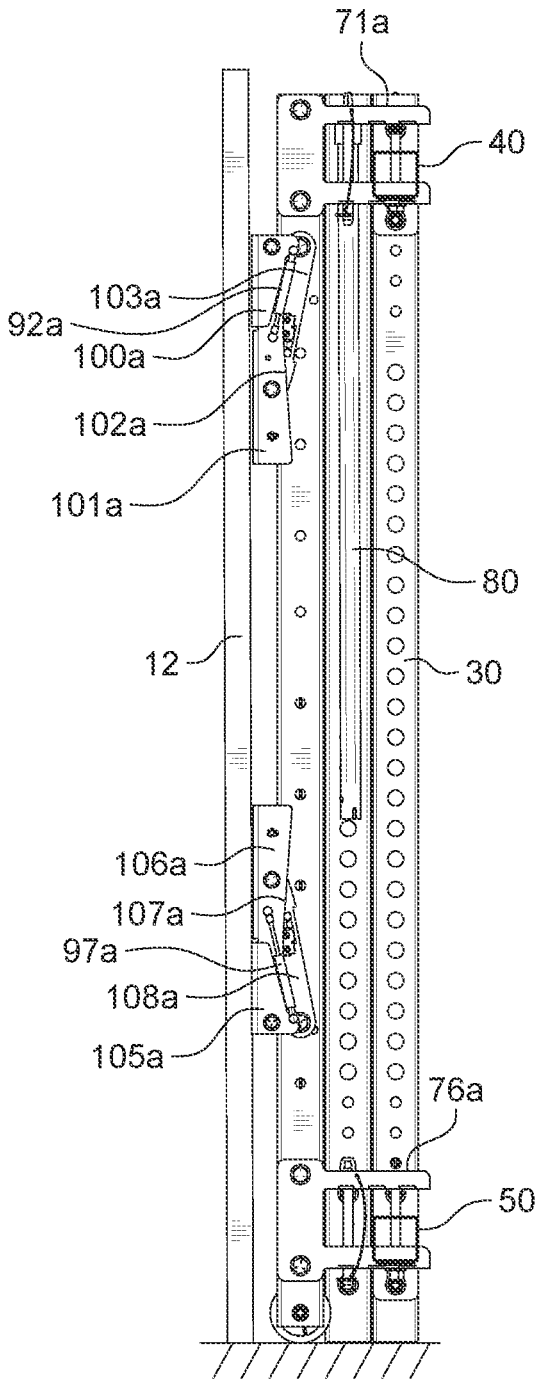
FIG. 47 is a side view of a folding exercise rack system in a retracted position in accordance with a fourth exemplary embodiment.
Figure 48:
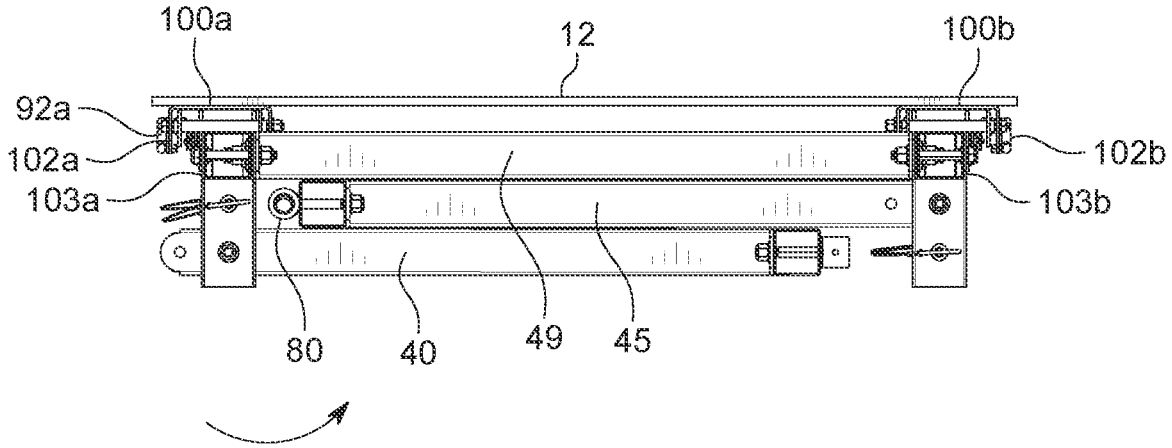
FIG. 48 is a top view of a folding exercise rack system in a retracted position in accordance with a fourth exemplary embodiment.

With the second frame 16 pivoted inwardly towards the wall 12, the user may grasp a portion of the first frame 15, such as the first outer support member 30, the first upper arm 40, and/or the first lower arm 50, and pivot inwardly towards the wall 12 until the first outer support member 30 is positioned adjacent to the wall 12 and the second frame 16, with the first upper and lower arms 40, 50 being parallel to the wall 12, the inner cross bar 49, and the second upper and lower arms 45, 55. As shown in FIGS. 36 and 48, the first frame 15 will thus rest against the second frame 16.

When desired, the exercise rack 11 may be extended (e.g., unfolded) back to its extended position. The user may first grasp the first frame 15 and pivot outwardly away from the wall 12 until the first upper and lower arms 40, 50 are perpendicular to the wall 12. The first upper and lower locking members 85*a*, 86*a* may be inserted through both the first upper and lower hinges 71*a*, 76*a* and the first upper and lower arms 40, 50 to lock the first frame 15 in the extended position.

The user may then grasp the second frame 16 and pivot outwardly away from the wall 12 until the second upper and lower arms 45, 55 are perpendicular to the wall 12. The second upper and lower locking members 85*b*, 86*b* may be inserted through both the second upper and lower hinges 71*b*, 76*b* and the second upper and lower arms 45, 55 to lock the second frame 16 in the extended position. The cross bar 80 may be connected between the outer support members 30, 35. The exercise rack 11 is then ready for use.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A folding exercise rack system, comprising:

a first inner support member;

a first upper linkage connected to the first inner support member, wherein the first upper linkage is adapted to be adjustably connected to a wall;

a first upper hinge adapted to be connected to the wall, wherein the first upper linkage is pivotably and slidably connected to the first upper hinge;

a second inner support member;

a second upper linkage connected to the second inner support member, wherein the second upper linkage is adapted to be adjustably connected to the wall;

a second upper hinge adapted to be connected to the wall, wherein the second upper linkage is pivotably and slidably connected to the second upper hinge;

a first upper arm connected to the first inner support member;

a first lower arm connected to the first inner support member below the first upper arm;

a first outer support member connected to the first upper arm and the first lower arm;

a second upper arm connected to the second inner support member;

a second lower arm connected to the second inner support member below the second upper arm; and a second outer support member connected to the second upper arm and the second lower arm;

wherein the first outer support member is adjustable between a first extended position in which the first outer support member is distally positioned away from the wall and a first folded position in which the first outer support member is positioned adjacent to the wall by pivotably moving the first upper linkage relative to the first upper hinge;

wherein the second outer support member is adjustable between a second extended position in which the second outer support member is distally positioned away from the wall and a second folded position in which the second outer support member is positioned adjacent to the wall by pivotably moving the second upper linkage relative to the second upper hinge.

2. The folding exercise rack system of claim 1, further comprising a first lower linkage connected to the first inner support member below the first upper linkage, wherein the first lower linkage is adapted to be adjustably connected to the wall.

3. The folding exercise rack system of claim 2, further comprising a second lower linkage connected to the second inner support member below the second upper linkage, wherein the second lower linkage is adapted to be adjustably connected to the wall.

4. The folding exercise rack system of claim 3, further comprising a first lower hinge adapted to be connected to the wall and a second lower hinge adapted to be connected to the wall, wherein the first lower linkage is pivotably connected to the first lower hinge, and wherein the second lower linkage is pivotably connected to the second lower hinge.

5. The folding exercise rack system of claim 1, wherein the first upper arm and the first lower arm are each parallel to the wall when the first outer support member is in the first folded position, and wherein the first upper arm and the first lower arm are each perpendicular to the wall when the first outer support member is in the first extended position.

6. The folding exercise rack system of claim 5, wherein the second upper arm and the second lower arm are each parallel to the wall when the second outer support member is in the first folded position, and wherein the second upper arm and the second lower arm are each perpendicular to the wall when the second outer support member is in the second extended position.

7. The folding exercise rack system of claim 1, further comprising a cross bar adapted to be removably connected between the first outer support member and the second outer support member.

8. A method of folding the folding exercise rack system of claim 1, comprising the steps of:

pivoting the first outer support member inwardly towards the wall into the first folded position; and pivoting the second outer support member inwardly towards the wall into the second folded position.

9. A method of extending the folding exercise rack system of claim 1, comprising the steps of:

pivoting the first outer support member outwardly away from the wall into the first extended position; and pivoting the second outer support member outwardly away from the wall into the second extended position.

10. A folding exercise rack system, comprising:

a first inner support member;

a first upper linkage connected to the first inner support member, wherein the first upper linkage includes a first upper slot, and wherein the first upper linkage is pivotably connected to the first upper hinge;

a first upper hinge adapted to be connected to a wall, the first upper hinge including a fixedly secured first upper pin that extends through the first upper slot;

a second inner support member;

a second upper linkage connected to the second inner support member, wherein the second upper linkage includes a second upper slot, and wherein the second upper linkage is pivotably connected to the second upper hinge;

a second upper hinge adapted to be connected to the wall, the second upper hinge including a fixedly secured second upper pin that extends through the second upper slot;

a first upper arm connected to the first inner support member;

a first lower arm connected to the first inner support member below the first upper arm;

a first outer support member connected to the first upper arm and the first lower arm;

a second upper arm connected to the second inner support member;

a second lower arm connected to the second inner support member below the second upper arm; and a second outer support member connected to the second upper arm and the second lower arm;

wherein the first outer support member is adjustable between a first extended position in which the first outer support member is distally positioned away from the wall and a first folded position in which the first outer support member is positioned adjacent to the wall by pivotably moving the first upper slot of the first upper linkage about the first upper pin of the first upper hinge;

wherein the second outer support member is adjustable between a second extended position in which the second outer support member is distally positioned away from the wall and a second folded position in which the second outer support member is positioned adjacent to the wall by pivotably moving the second upper slot of the second upper linkage about the second upper pin of the second upper hinge.

11. The folding exercise rack system of claim 10, further comprising a first lower hinge adapted to be connected to the wall and a first lower linkage pivotably connected to the first lower hinge, wherein the first lower linkage is connected to the first inner support member below the first upper linkage.

12. The folding exercise rack system of claim 11, further comprising a second lower hinge adapted to be connected to the wall and a second lower linkage pivotably connected to the second lower hinge, wherein the second lower linkage is connected to the second inner support member below the second upper linkage.

13. The folding exercise rack system of claim 10, further comprising a cross bar adapted to be removably connected between the first outer support member and the second outer support member.

14. A method of folding the folding exercise rack system of claim 10, comprising the steps of:

pivoting the first outer support member inwardly towards the wall into the first folded position; and pivoting the second outer support member inwardly towards the wall into the second folded position.

15. A method of extending the folding exercise rack system of claim 10, comprising the steps of:

pivoting the first outer support member outwardly away from the wall into the first extended position; and pivoting the second outer support member outwardly away from the wall into the second extended position.

16. The folding exercise rack system of claim 10, wherein the first upper arm and the first lower arm are each parallel to the wall when the first outer support member is in the first folded position, wherein the first upper arm and the first lower arm are each perpendicular to the wall when the first outer support member is in the first extended position, wherein the second upper arm and the second lower arm are each parallel to the wall when the second outer support member is in the first folded position, and wherein the second upper arm and the second lower arm are each perpendicular to the wall when the second outer support member is in the second extended position.

* * * * *